US007902946B2

(12) United States Patent
Niblock

(10) Patent No.: US 7,902,946 B2
(45) Date of Patent: Mar. 8, 2011

(54) MEMS RELAY WITH A FLUX PATH THAT IS DECOUPLED FROM AN ELECTRICAL PATH THROUGH THE SWITCH AND A SUSPENSION STRUCTURE THAT IS INDEPENDENT OF THE CORE STRUCTURE AND A METHOD OF FORMING THE SAME

(75) Inventor: Trevor Niblock, Santa Clara, CA (US)

(73) Assignee: National Semiconductor Corporation, Santa Clara, CA (US)

( * ) Notice: Subject to any disclaimer, the term of this patent is extended or adjusted under 35 U.S.C. 154(b) by 80 days.

(21) Appl. No.: 12/218,368

(22) Filed: Jul. 11, 2008

(65) Prior Publication Data

US 2010/0007448 A1 Jan. 14, 2010

(51) Int. Cl.
*H01H 51/22* (2006.01)

(52) U.S. Cl. ..... 335/78; 200/181

(58) Field of Classification Search ..... 335/78; 200/181

See application file for complete search history.

(56) References Cited

U.S. PATENT DOCUMENTS

| | | | | |
|---|---|---|---|---|
| 5,578,976 | A | 11/1996 | Yao | |
| 5,880,921 | A | 3/1999 | Tham et al. | 361/233 |
| 6,016,092 | A | 1/2000 | Qiu et al. | |
| 6,094,116 | A | 7/2000 | Tai et al. | |
| 6,169,826 | B1 | 1/2001 | Nishiyama et al. | |
| 6,310,526 | B1 * | 10/2001 | Yip et al. | 333/262 |
| 6,360,036 | B1 | 3/2002 | Couillard | |
| 6,469,602 | B2 | 10/2002 | Ruan et al. | |
| 6,573,822 | B2 | 6/2003 | Ma et al. | 336/223 |
| 6,803,843 | B2 * | 10/2004 | Kato et al. | 335/78 |
| 6,842,558 | B2 | 1/2005 | Mitsuoka et al. | |
| 7,095,919 | B2 | 8/2006 | Kawamoto et al. | |
| 7,202,763 | B2 | 4/2007 | Six | |
| 7,327,211 | B2 | 2/2008 | Ruan et al. | |
| 7,381,663 | B2 | 6/2008 | Sato et al. | 438/942 |
| 7,382,218 | B2 * | 6/2008 | Charvet | 335/78 |
| 7,444,042 | B1 | 10/2008 | Niblock et al. | |
| 7,464,459 | B1 | 12/2008 | Niblock et al. | |
| 2003/0030998 | A1 | 2/2003 | Mhani et al. | |
| 2003/0137374 | A1 * | 7/2003 | Ruan et al. | 335/78 |
| 2004/0001667 | A1 | 1/2004 | Childers | |
| 2004/0012469 | A1 * | 1/2004 | Huang | 335/78 |
| 2004/0022484 | A1 | 2/2004 | Sigloch et al. | |
| 2006/0049900 | A1 | 3/2006 | Ruan et al. | |

FOREIGN PATENT DOCUMENTS

JP 2006210065 A 8/2006

OTHER PUBLICATIONS

U.S. Appl. No. 11/805,933, filed May 25, 2007 to Niblock et al.

(Continued)

*Primary Examiner* — Elvin G Enad
*Assistant Examiner* — Bernard Rojas
(74) *Attorney, Agent, or Firm* — Mark C. Pickering

(57) ABSTRACT

A micro-electromechanical (MEMS) relay decouples a flux path from magnetic actuation from the electrical path through the switch to eliminate signal degradations that result from fluctuations in the current around the core and, thereby the flux. In addition, the MEMS relay has a suspension structure that is independent of the core.

20 Claims, 55 Drawing Sheets

OTHER PUBLICATIONS

U.S. Appl. No. 11/807,162, filed May 25, 2007 to Niblock et al.
U.S. Appl. No. 11/805,934, filed May 25, 2007 to Niblock et al.
U.S. Appl. No. 12/283,969, filed Sep. 17, 2008 to Niblock et al.
John A. Wright, et al., "Micro-Miniature Electromagnetic Switches Fabricated Using MEMS Technology," Proceedings: 46th Annual International Relay Conference:NARM '98, Oak Brook, Illinois, Apr. 1998, pp. 13-1 to 13-4.
Gary D. Gray Jr., et al. "Magnetically Bistable Actuator Part 2. Fabrication and Performance", Sensors and Actuators A: Physical, vol. 119, Issue 2, Apr. 13, 2005, pp. 502-511.
Gary D. Gray Jr. and Paul A. Kohl, "Magnetically Bistable Actuator Part 1. Ultra-Low Switching Energy And Modeling", Sensors and Actuators A: Physical, vol. 119, Issue 2, Apr. 13, 2005, pp. 489-501.
U.S. Appl. No. 11/805,955, filed May 25, 2007, Niblock et al.
U.S. Appl. No. 11/805,933, filed May 25, 2007, Niblock et al.
U.S. Appl. No. 11/807,162, filed May 25, 2007, Niblock et al.
U.S. Appl. No. 11/807,161, filed May 25, 2007, Niblock et al.
U.S. Appl. No. 11/805,934, filed May 25, 2007, Niblock et al.
John A. Wright, et al., "Micro-Miniature Electromagnetic Switches Fabricated Using MEMS Technology", Proceedings: 46th Annual International Relay Conference: NARM '98, Oak Brook, Illinois, Apr. 1998, pp. 13-1 to 13-4.
Han S. Lee, et al., "Micro-Electro-Mechanical Relays—Design Concepts and Process Demonstrations", Joint 22nd International Conference on Electrical Contacts and 50th IEEE HOLM Conference on Electrical Contacts, Sep. 20-23, 2004, pp. 242-247.
J.H. Fabian, et al., "Matrix Cominbination of MEMS Relays", 17th IEEE International Conference on Micro Electro Mechanical Systems, 2004, pp. 861-864.
Ernst Thielicke and Ernst Obermeier, "A Fast Switching Surface Micromachined Electrostatic Relay", The 12th International Conference on Solid State Sensors, Actuators and Microsystems, Boston, Jun. 8-12, 2003, pp. 899-902.
Ren Wanbin, et al., "Finite Element Analysis of Magnetic Structures for Micro-Electro-Mechanical Relays", Proceedings of the 51st IEEE HOLM Conference on Electrical Contacts, Sep. 26-28, 2005, pp. 265-269.
John A. Wright, et al., "Magnetostatic MEMS Relays For The Miniaturization Of Brushless DC Motor Controllers", 12th IEEE International Conference on Micro Electro Mechanical Systems, Jan. 17-21, 1999, pp. 594-599.
U.S. Appl. No. 11/807,161, filed May 25, 2007 to Niblock et al.
U.S. Appl. No. 11/805,955, filed May 25, 2007 to Niblock et al.
International Search Report for PCT/US2009/049675 filed on Jul. 6, 2009.
Written Opinion of the International Searching Authority for PCT/US2009/049675 filed on Jul. 6, 2009.

* cited by examiner

MEMS RELAY WITH A FLUX PATH THAT IS DECOUPLED FROM AN ELECTRICAL PATH THROUGH THE SWITCH AND A SUSPENSION STRUCTURE THAT IS INDEPENDENT OF THE CORE STRUCTURE AND A METHOD OF FORMING THE SAME

BACKGROUND OF THE INVENTION

1. Field of the Invention

The present invention relates to relays and, more particularly, to a MEMS relay that has a flux path from magnetic actuation that is decoupled from an electrical path through the switch, and a suspension structure that is independent of the core structure, and a method of forming the same.

2. Description of the Related Art

A switch is a well-known device that connects, disconnects, or changes connections between devices. An electrical switch is a switch that provides a low-impedance electrical pathway when the switch is "closed," and a high-impedance electrical pathway when the switch is "opened." A mechanical-electrical switch is a type of switch where the low-impedance electrical pathway is formed by physically bringing two electrical contacts together, and the high-impedance electrical pathway is formed by physically separating the two electrical contacts from each other.

An actuator is a well-known mechanical device that moves or controls a mechanical member to move or control another device. Actuators are commonly used with mechanical-electrical switches to move or control a mechanical member that closes and opens the switch, thereby providing the low-impedance and high-impedance electrical pathways, respectively, in response to the actuator.

A relay is a combination of a switch and an actuator where the mechanical member in the actuator moves in response to electromagnetic changes in the conditions of an electrical circuit. For example, electromagnetic changes due to the presence or absence of a current in a coil can cause the mechanical member in the actuator to close and open the switch.

One approach to implementing actuators and relays is to use micro-electromechanical system (MEMS) technology. MEMS devices are formed using the same fabrication processes that are used to form conventional semiconductor structures, such as the interconnect structures that provide electrical connectivity to the transistors on a die.

One drawback of conventional MEMS relays is that the flux path that actuates the device also typically follows the electrical path through the switch. Traditionally, relays are used for power switching, and thus signal attenuation through the switch due to fluctuations in the current around the core and, thereby the flux, has not been a concern.

However, when MEMS relays are passing signals with very small amplitudes through the switch, fluctuations in the current around the core and, thereby the flux, can lead to an unacceptable degradation of the signal passing through the switch. Thus, there is a need for a MEMS relay that has a flux path that is decoupled from the electrical path through the switch.

Another drawback of conventional MEMS relays is that the suspension structure is typically formed as part of the core structure. The suspension and core structures, however, commonly have conflicting requirements. The ideal geometry of the core structure is a short flux path with a large cross-sectional area. However, the ideal geometry of the suspension structure is a long path with a small cross-sectional area because this reduces the spring stiffness of the beam, and thus the force required to close the switch. Thus, there is also a need for a MEMS relay that has a suspension structure that is independent of the core structure.

BRIEF DESCRIPTION OF THE DRAWINGS

FIGS. 2A-15A, 2B-15B, 2C-15C, 2D-15D, and 2E-15E are a series of views that illustrate an example of method 100 in accordance with the present invention. FIGS. 2A-15A are plan views. FIGS. 2B-15B are cross-sectional views taken along lines 2B-2B of FIGS. 2A through 15B-15B of FIG. 15A, respectively. FIGS. 2C-15C are cross-sectional views taken along lines 2C-2C of FIGS. 2A through 15C-15C of FIG. 15A, respectively. FIGS. 2D-15D are cross-sectional views taken along lines 2D-2D of FIGS. 2A through 15D-15D of FIG. 15A, respectively. FIGS. 2E-15E are cross-sectional views taken along lines 2E-2E of FIGS. 2A through 15E-15E of FIG. 15A, respectively.

FIGS. 16A-18A, 16B-18B, 16C-18C, 16D-18D, and 16E-18E are a series of views illustrating a first example of an alternate way of implementing element 110 of method 100 in accordance with the present invention. FIGS. 16A-18A are plan views. FIGS. 16B-18B are cross-sectional views taken along lines 16B-16B of FIG. 16A through 18B-18B of FIG. 18A, respectively. FIGS. 16C-18C are cross-sectional views taken along lines 16C-16C of FIG. 16A through 18C-18C of FIG. 18A, respectively. FIGS. 16D-18D are cross-sectional views taken along lines 16D-16D of FIG. 16A through 18D-18D of FIG. 18A, respectively. FIGS. 16E-18E are cross-sectional views taken along lines 16E-16E of FIG. 16A through 18E-18E of FIG. 18A, respectively.

FIGS. 19A-21A, 19B-21B, 19C-21C, 19D-21D, and 19E-21E are a series of views illustrating a second example of an alternate way of implementing element 110 of method 100 in accordance with the present invention. FIGS. 19A-21A are plan views. FIGS. 19B-21B are cross-sectional views taken along lines 19B-19B of FIG. 19A through 21B-21B of FIG. 21A, respectively. FIGS. 19C-21C are cross-sectional views taken along lines 19C-19C of FIG. 19A through 21C-21C of FIG. 21A, respectively. FIGS. 19D-21D are cross-sectional views taken along lines 19D-19D of FIG. 19A through 21D-21D of FIG. 21A, respectively. FIGS. 19E-21E are cross-sectional views taken along lines 19E-19E of FIG. 19A through 21E-21E of FIG. 21A, respectively.

FIGS. 22A-26A, 22B-26B, 22C-26C, 22D-26D, and 22E-26E are a series of views illustrating an example of an alternate way of implementing element 118 of method 100 in accordance with the present invention. FIGS. 22A-26A are plan views. FIGS. 22B-26B are cross-sectional views taken along lines 22B-22B of FIG. 22A through 26B-26B of FIG. 26A, respectively. FIGS. 22C-26C are cross-sectional views taken along lines 22C-22C of FIG. 22A through 26C-26C of FIG. 26A, respectively. FIGS. 22D-26D are cross-sectional views taken along lines 22D-22D of FIG. 22A through 26D-26D of FIG. 26A, respectively. FIGS. 22E-26E are cross-sectional views taken along lines 22E-22E of FIG. 22A through 26E-26E of FIG. 26A, respectively.

DETAILED DESCRIPTION OF THE INVENTION

As described in greater detail below, the present invention is a MEMS relay, and a method of forming the relay, that has a flux path from magnetic actuation which is decoupled from the electrical path through the switch. In addition, the MEMS relay has a suspension structure that is independent of the core structure.

Figure 1:
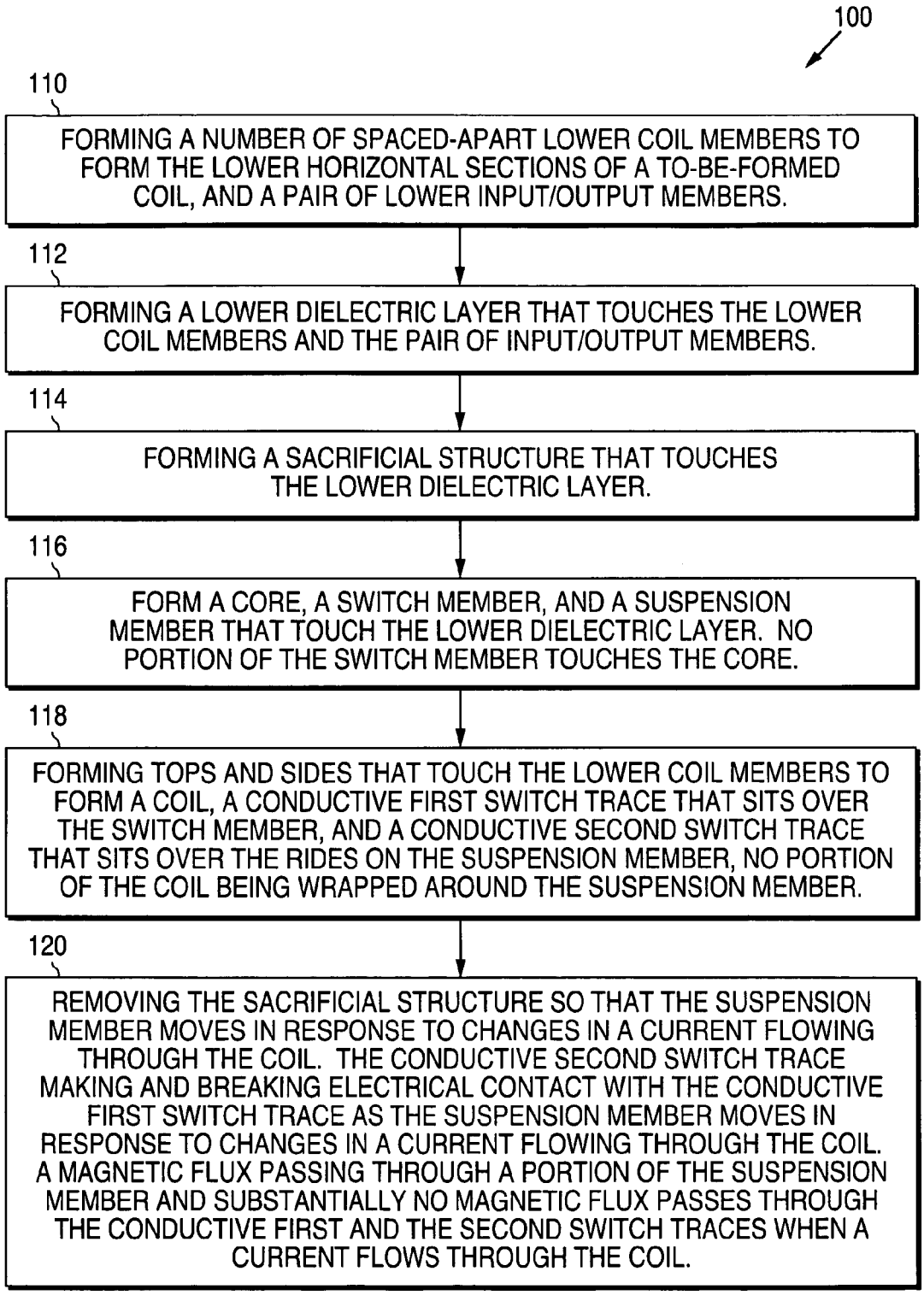
FIG. 1 is a view illustrating an example of a method 100 of forming a MEMS relay in accordance with the present invention.
Figure 2A:
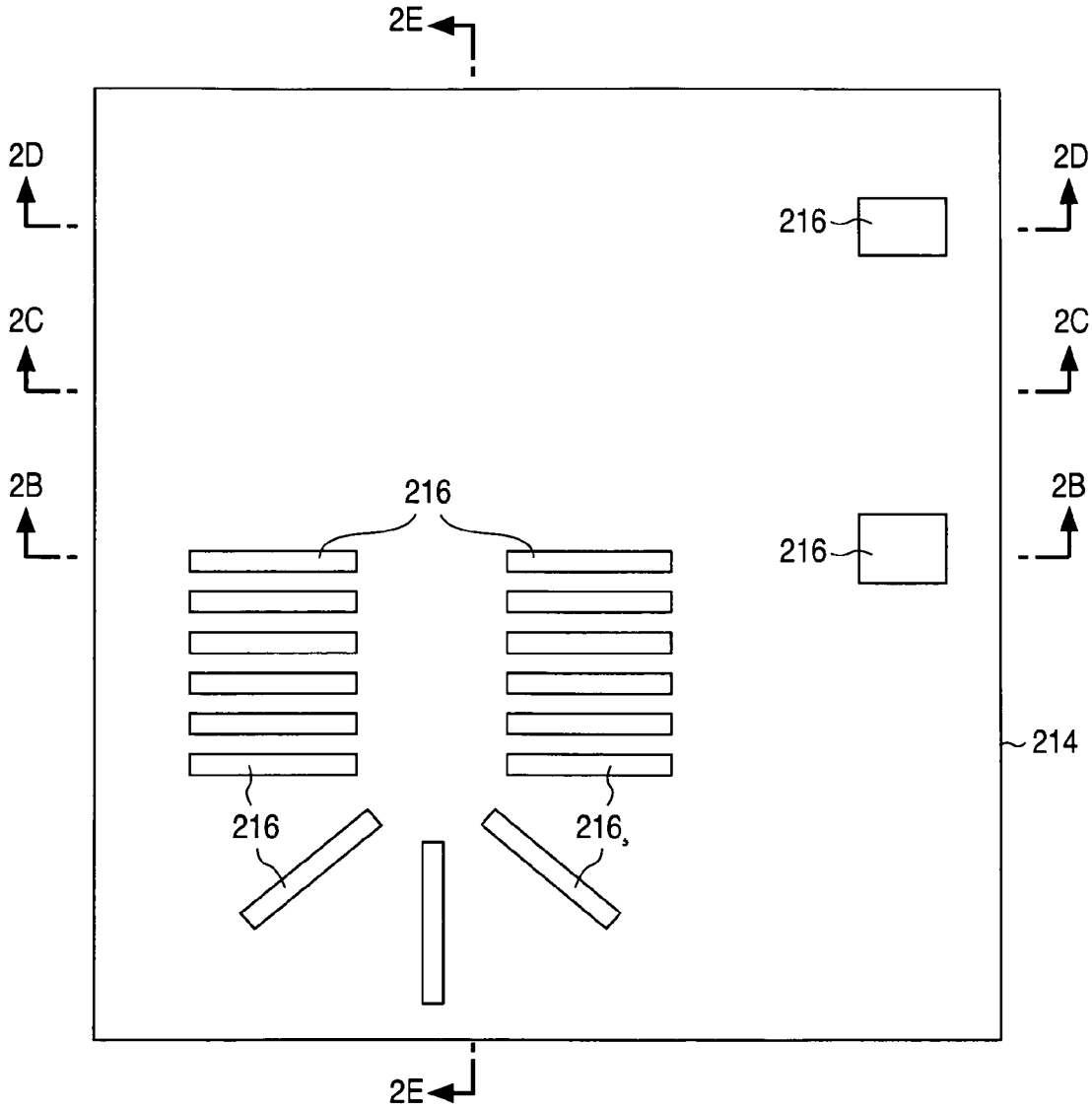
Figure 2B:
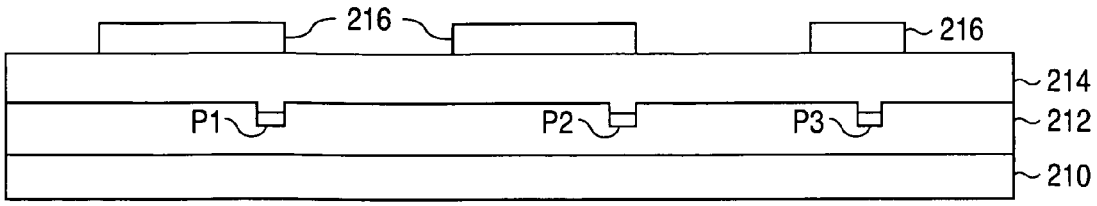
Figure 2C:
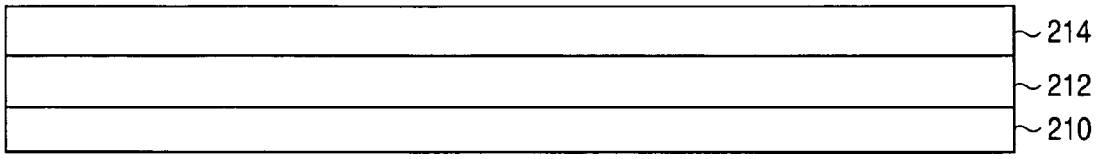
Figure 2D:
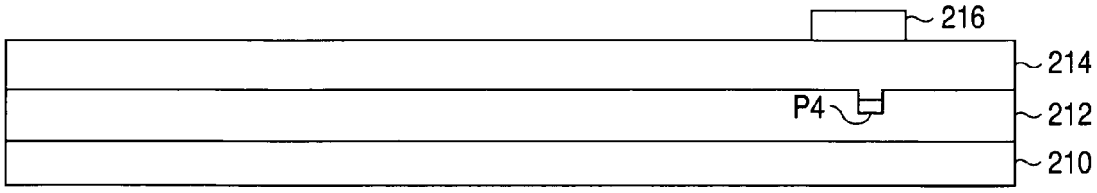
Figure 2E:
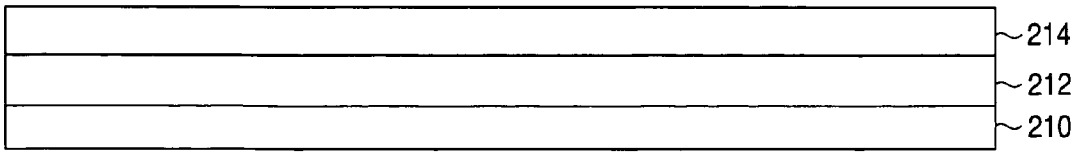
Figure 3A:
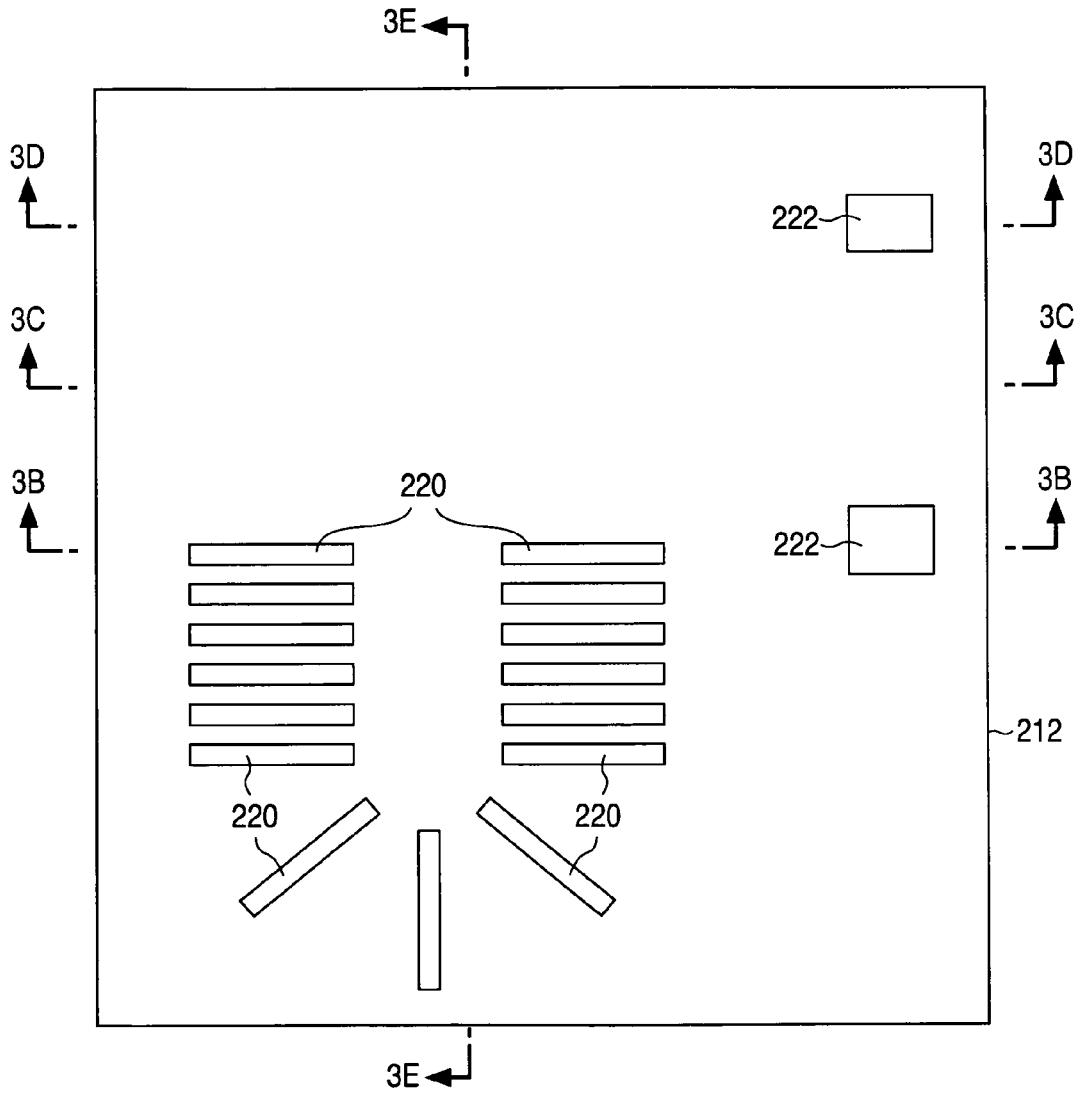
Figure 3B:
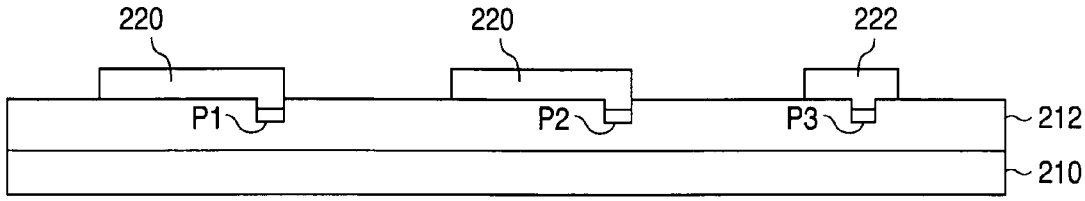
Figure 3C:
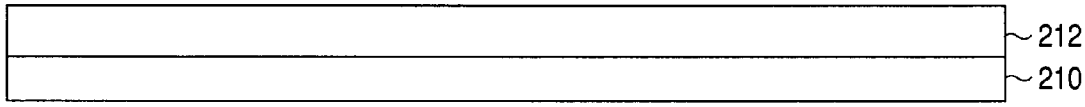
Figure 3D:
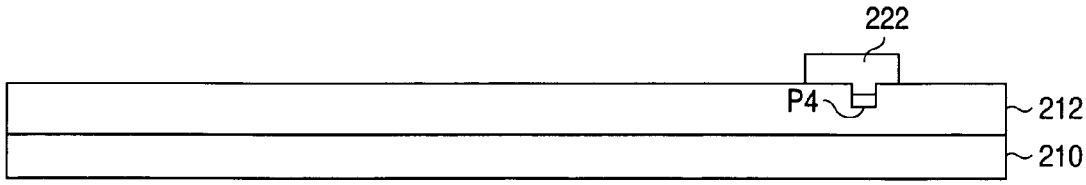
Figure 3E:
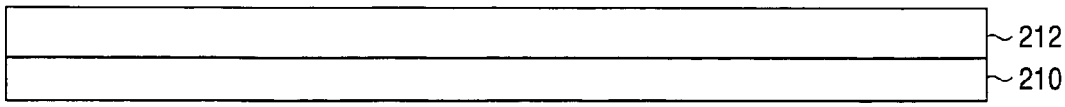
Figure 4A:
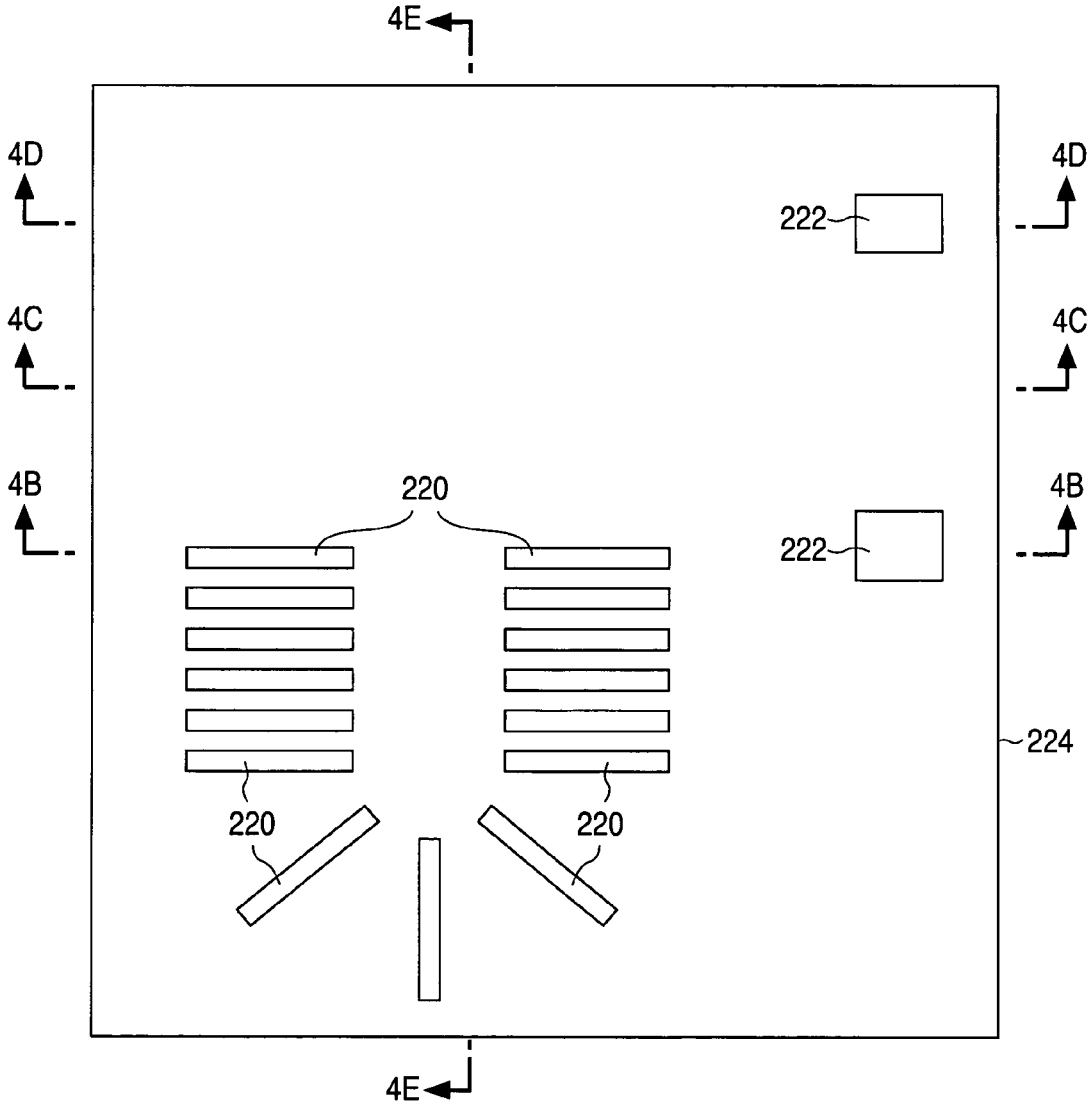
Figure 4B:
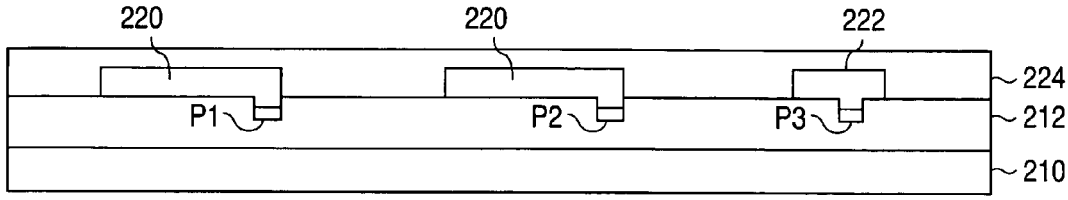
Figure 4C:
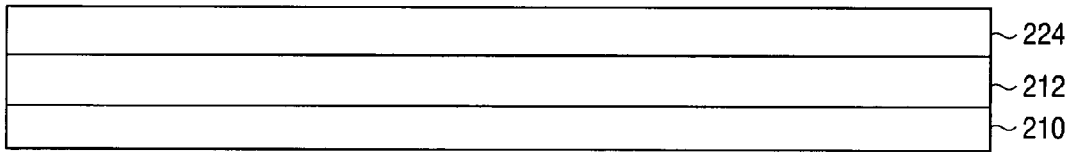
Figure 4D:
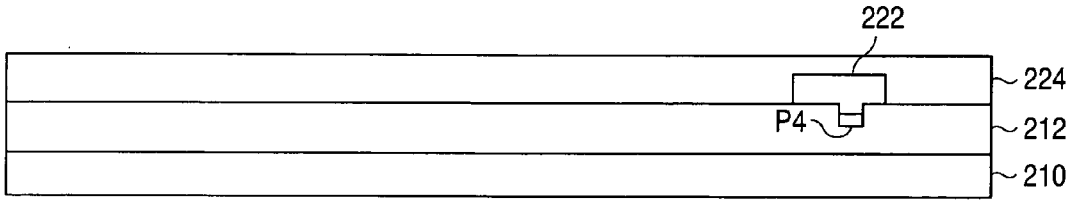
Figure 4E:
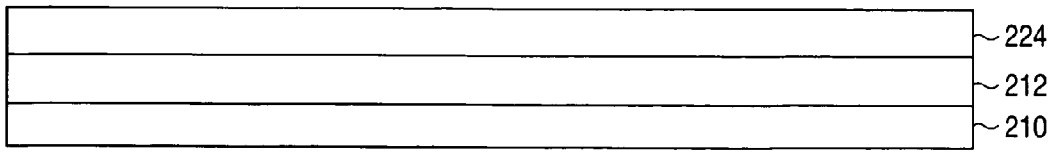
Figure 5A:
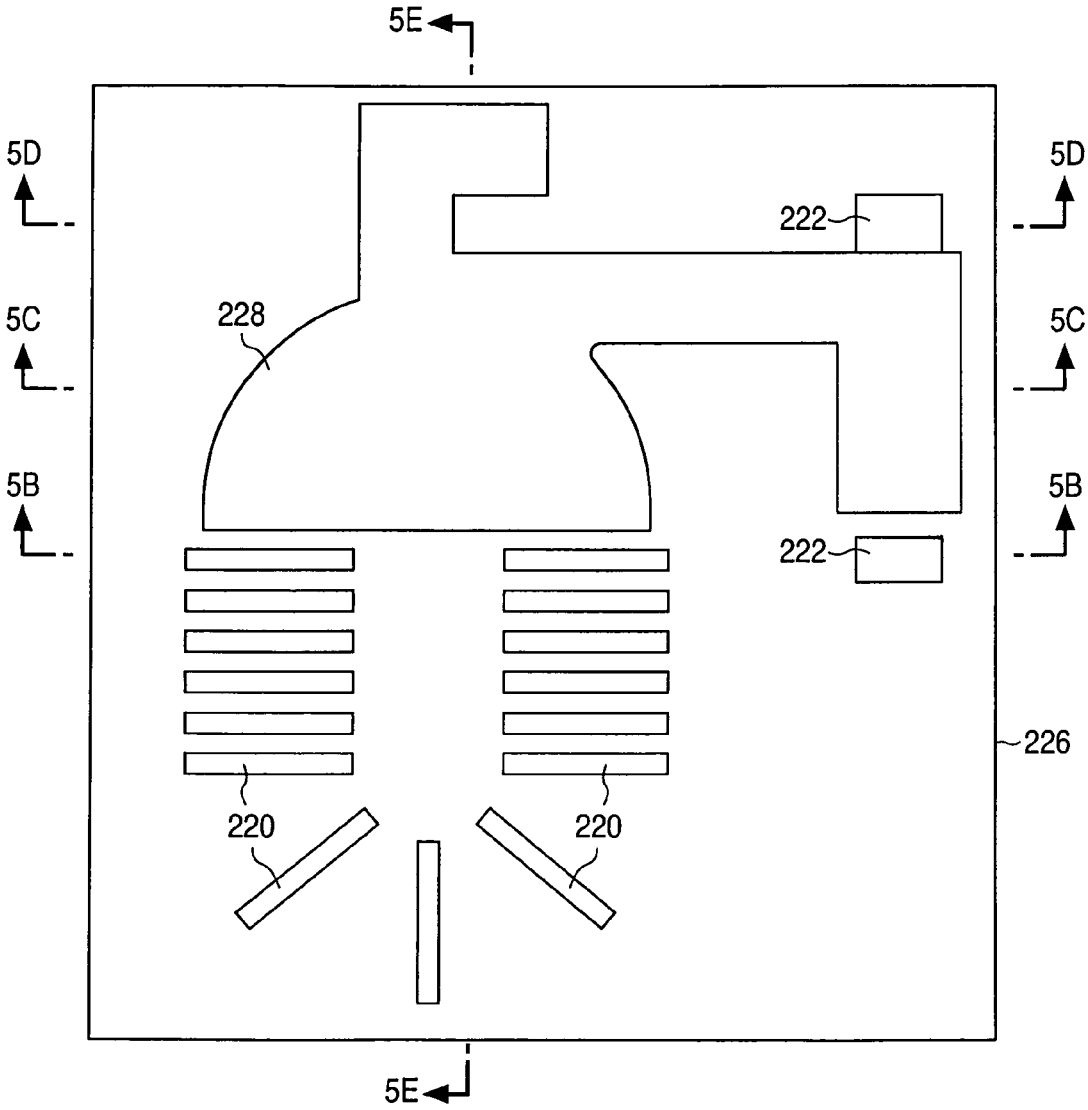
Figure 5B:
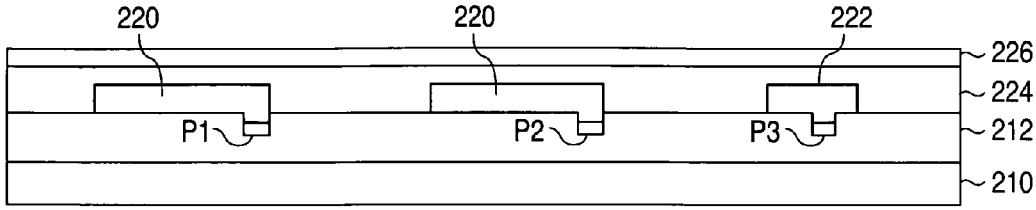
Figure 5C:
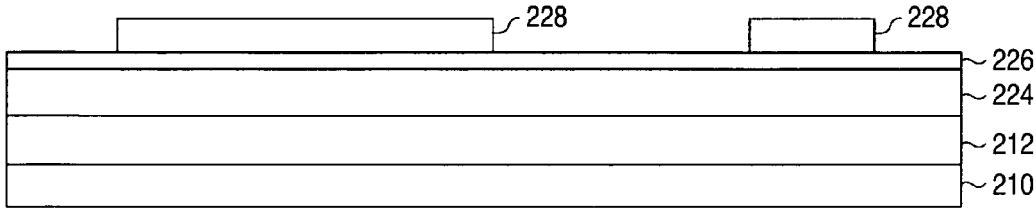
Figure 5D:
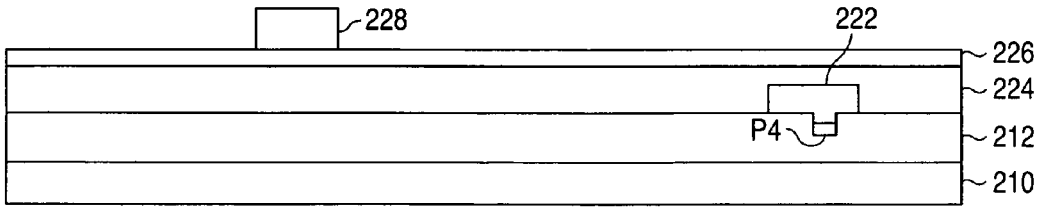
Figure 5E:
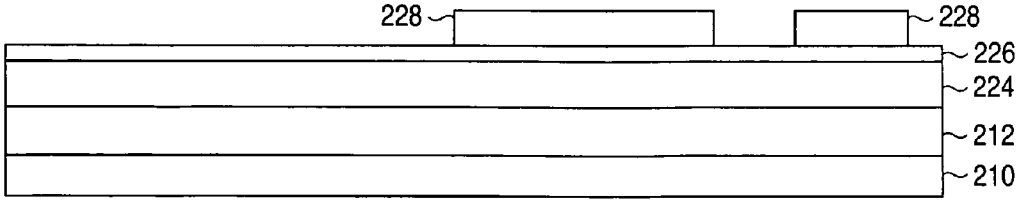
Figure 6A:
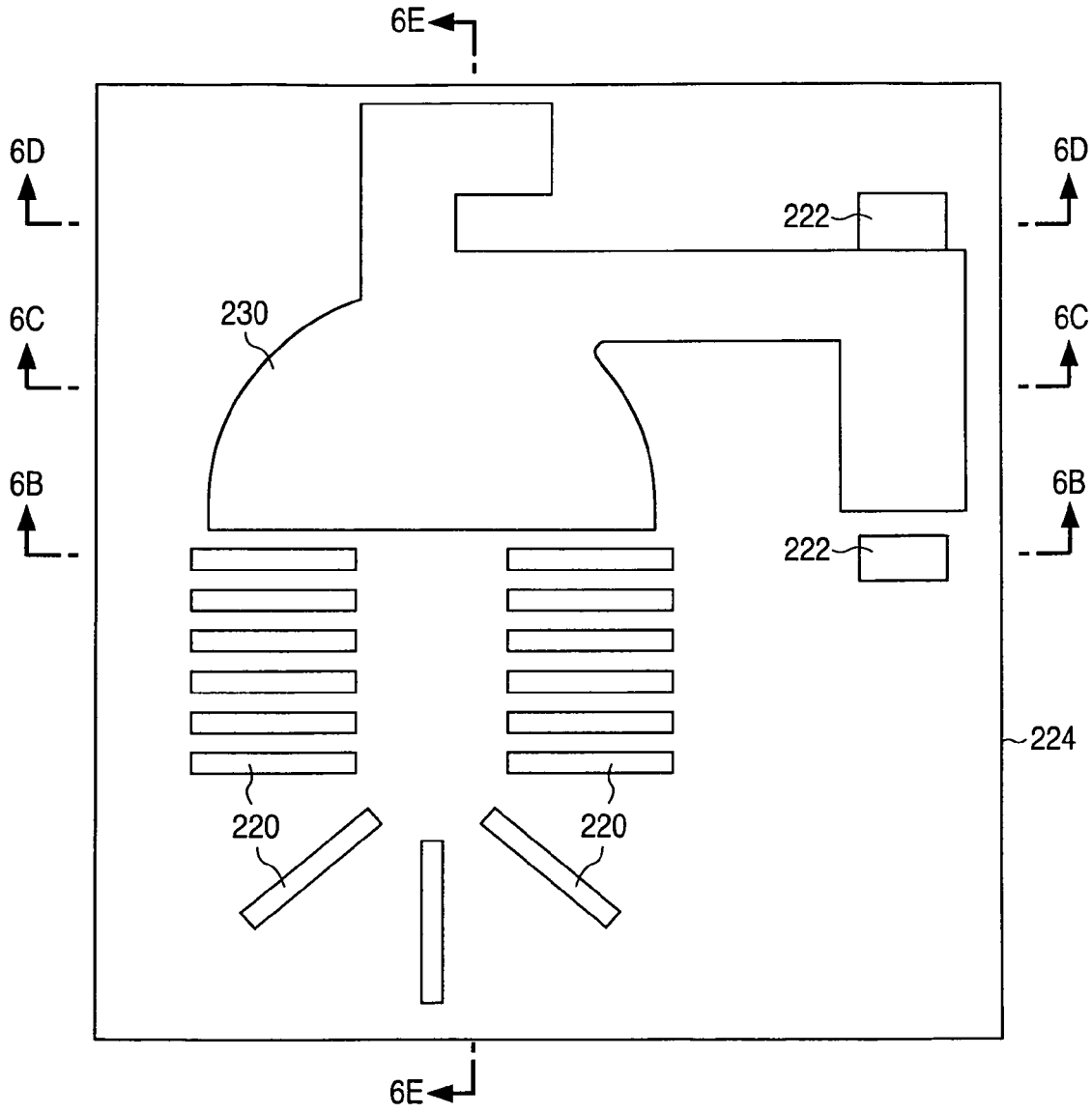
Figure 6B:
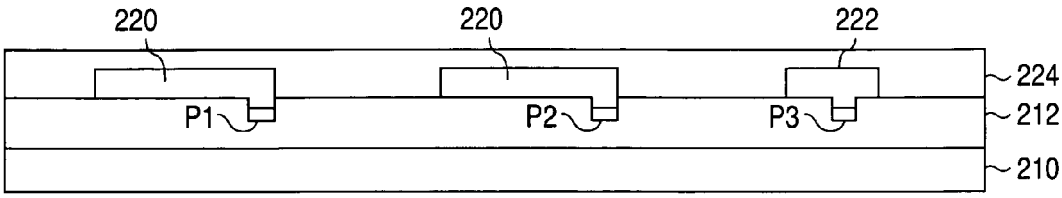
Figure 6C:
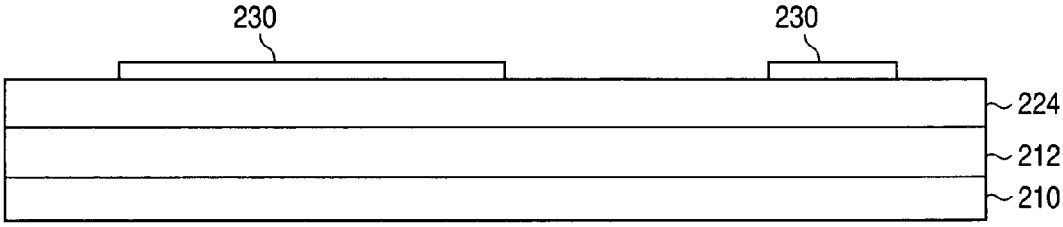
Figure 6D:
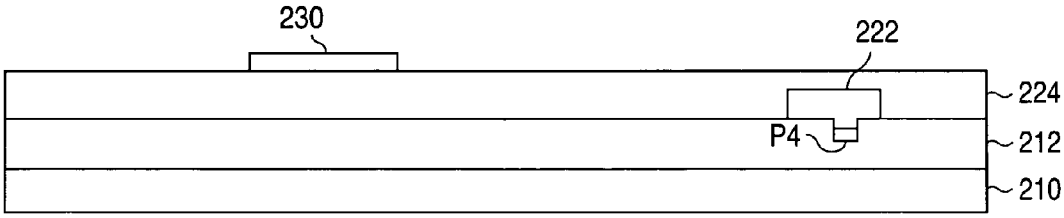
Figure 6E:
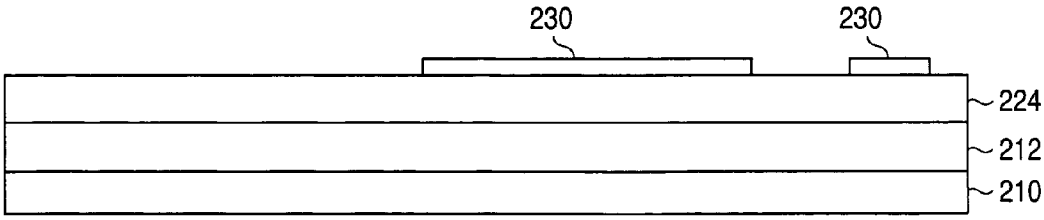
Figure 7A:
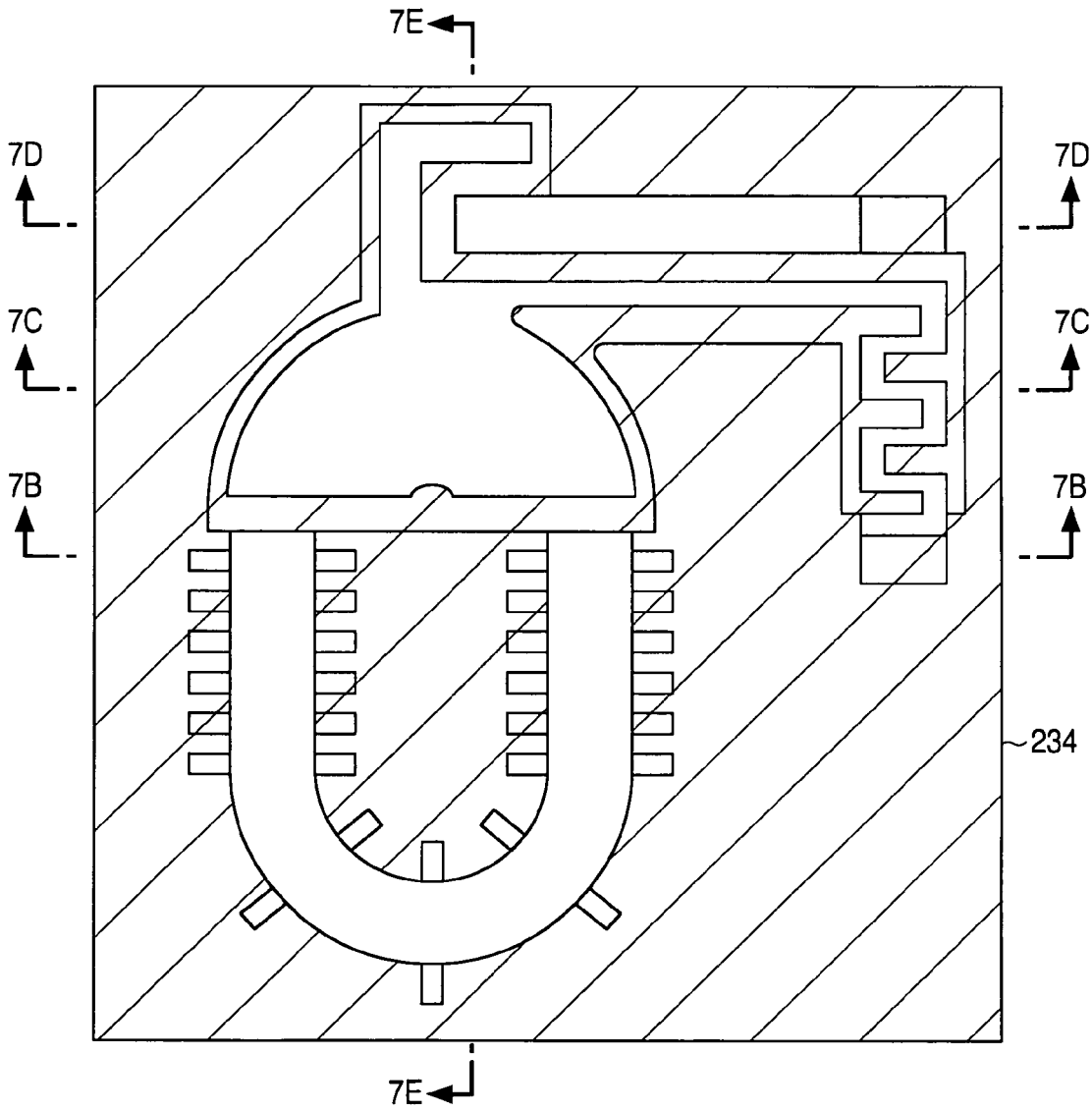
Figure 7B:
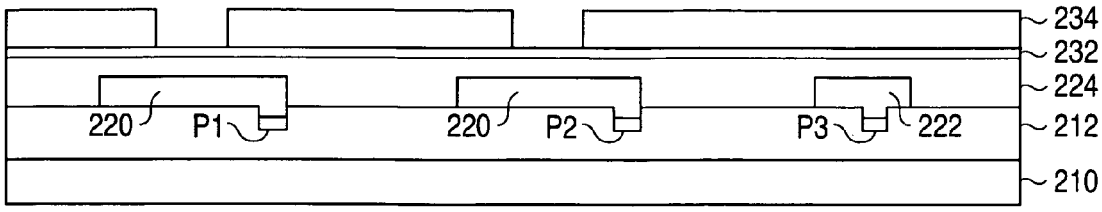
Figure 7C:
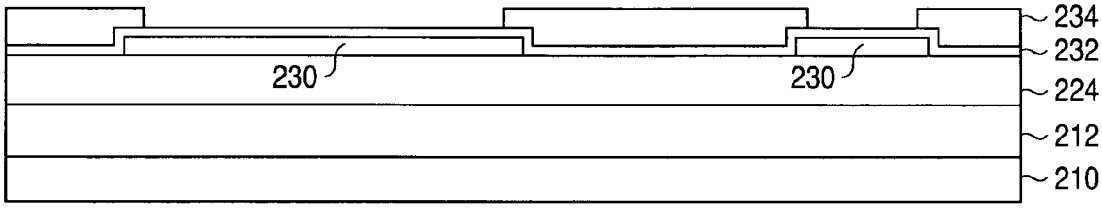
Figure 7D:
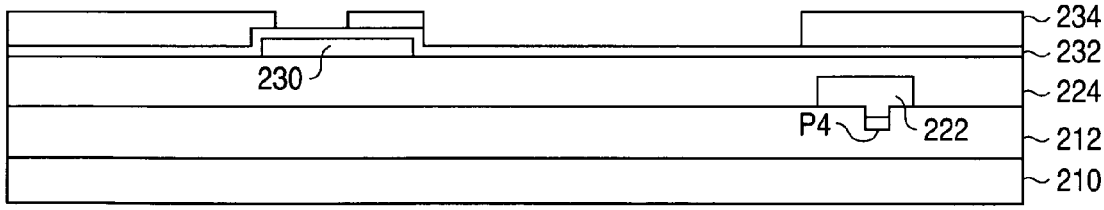
Figure 7E:
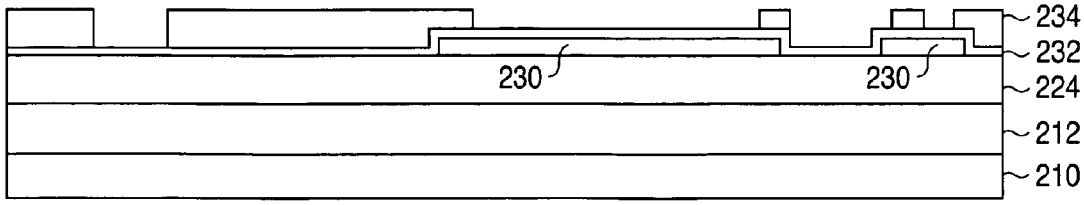
Figure 8A:
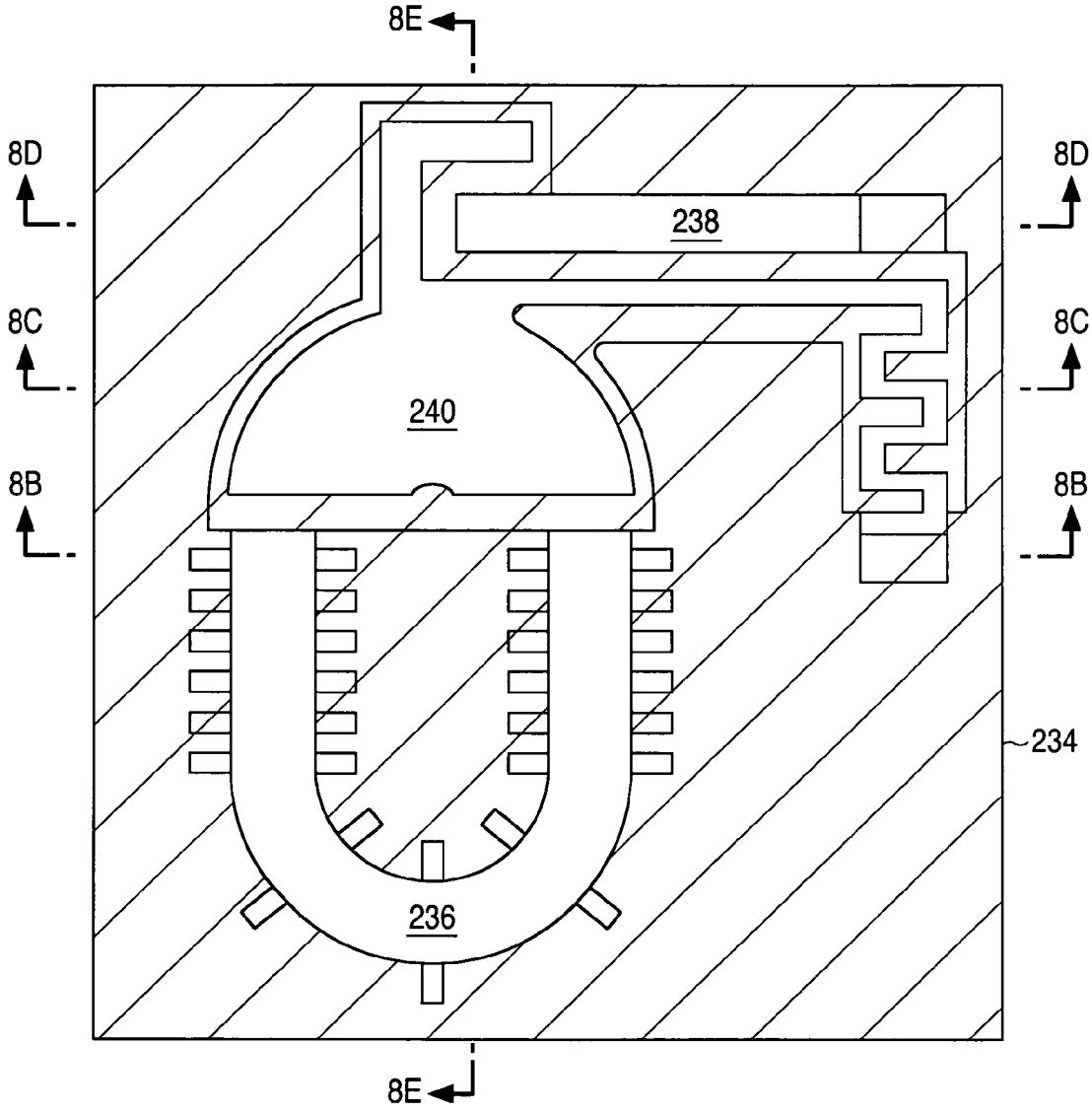
Figure 8B:
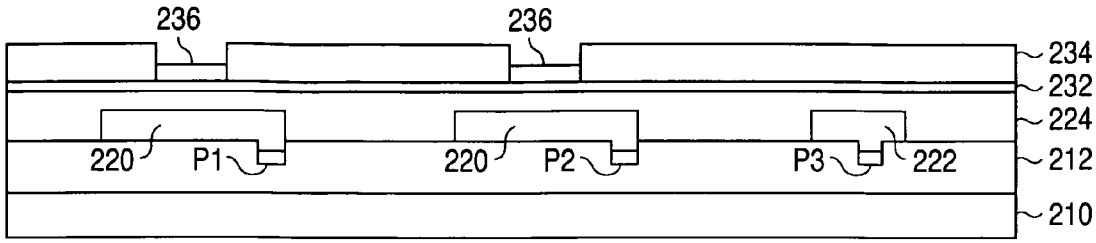
Figure 8C:
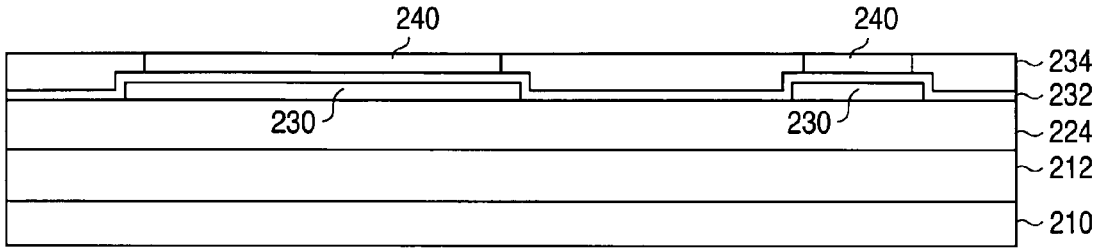
Figure 8D:
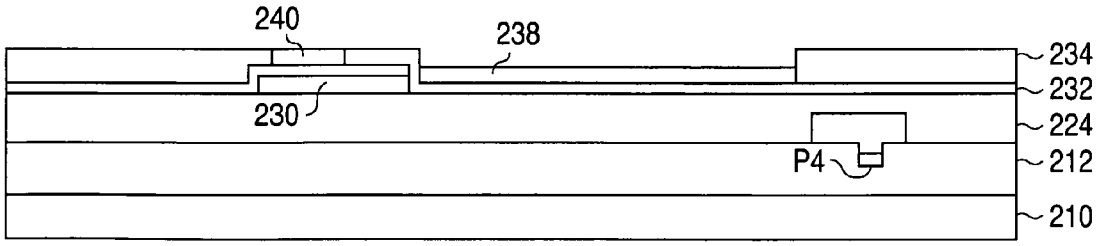
Figure 8E:
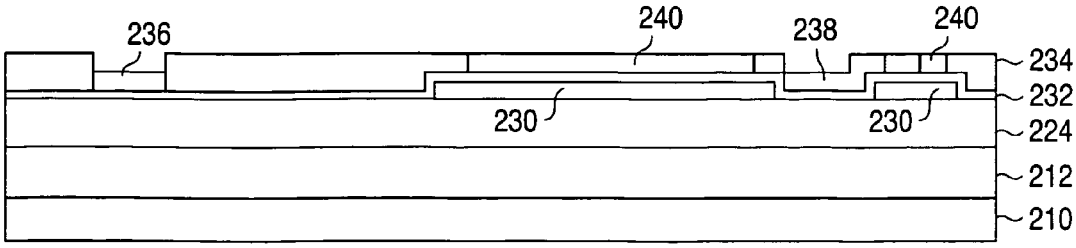
Figure 9A:
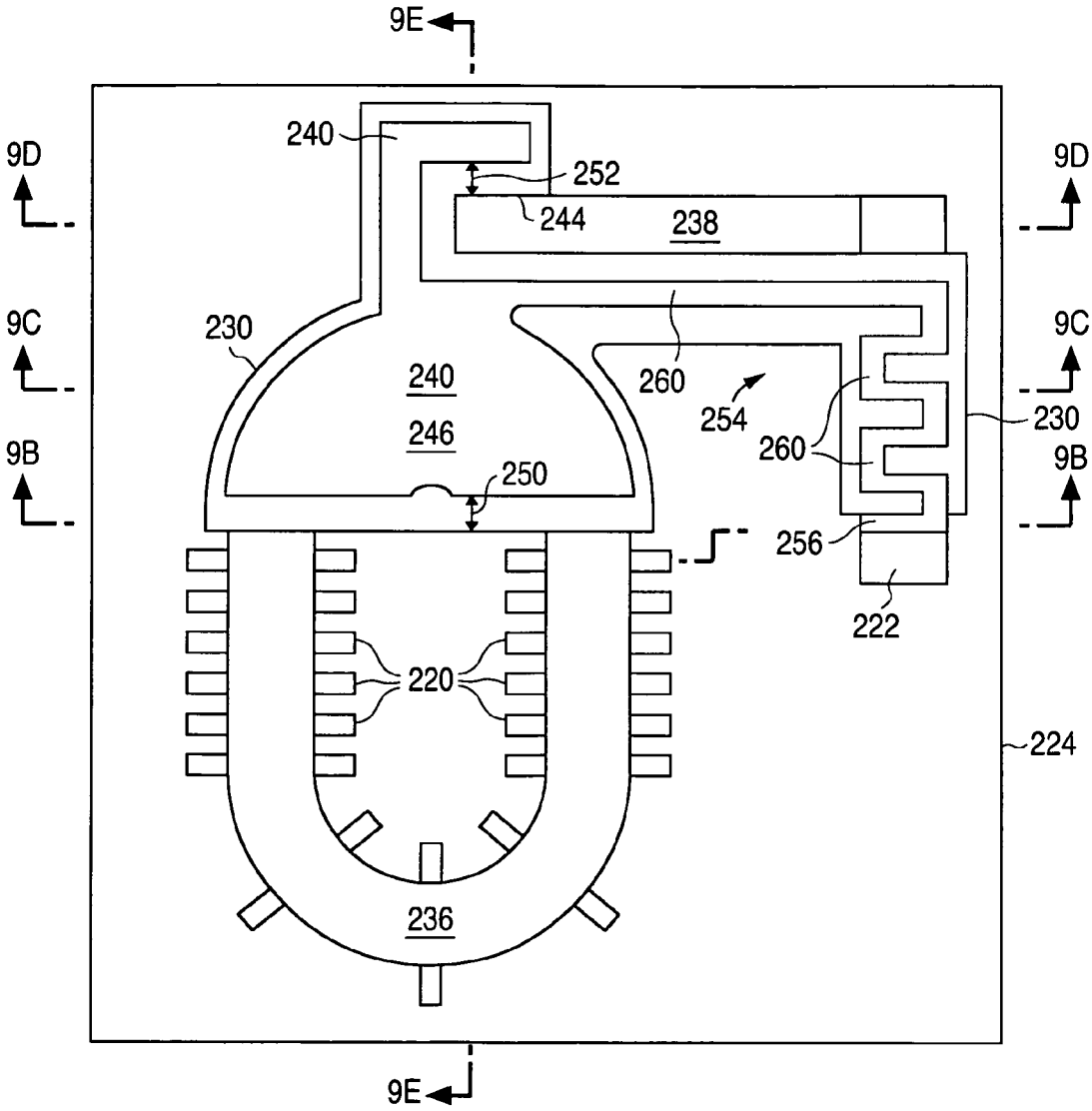
Figure 9B:
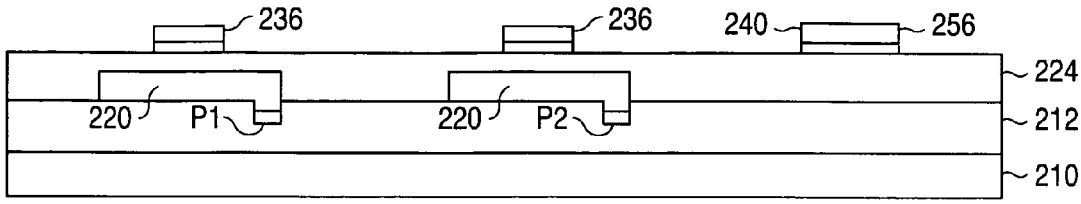
Figure 9C:
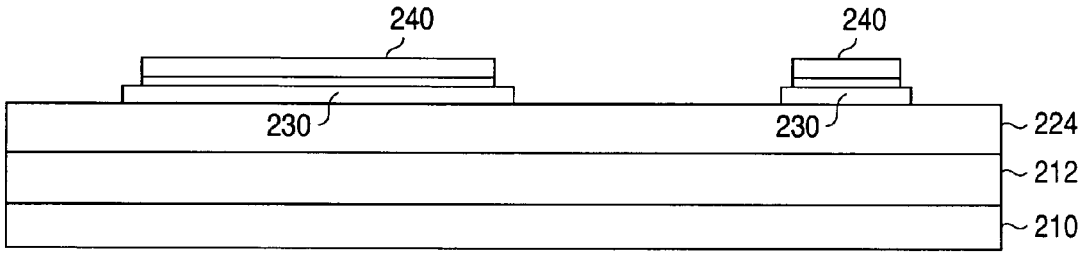
Figure 9D:
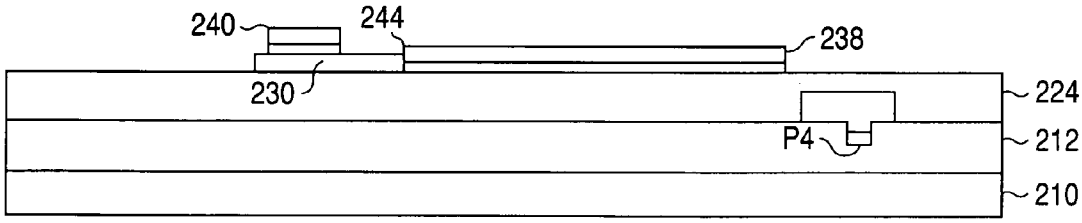
Figure 9E:
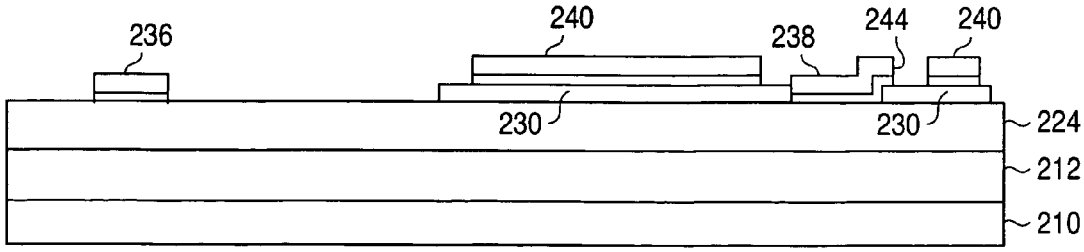
Figure 10A:
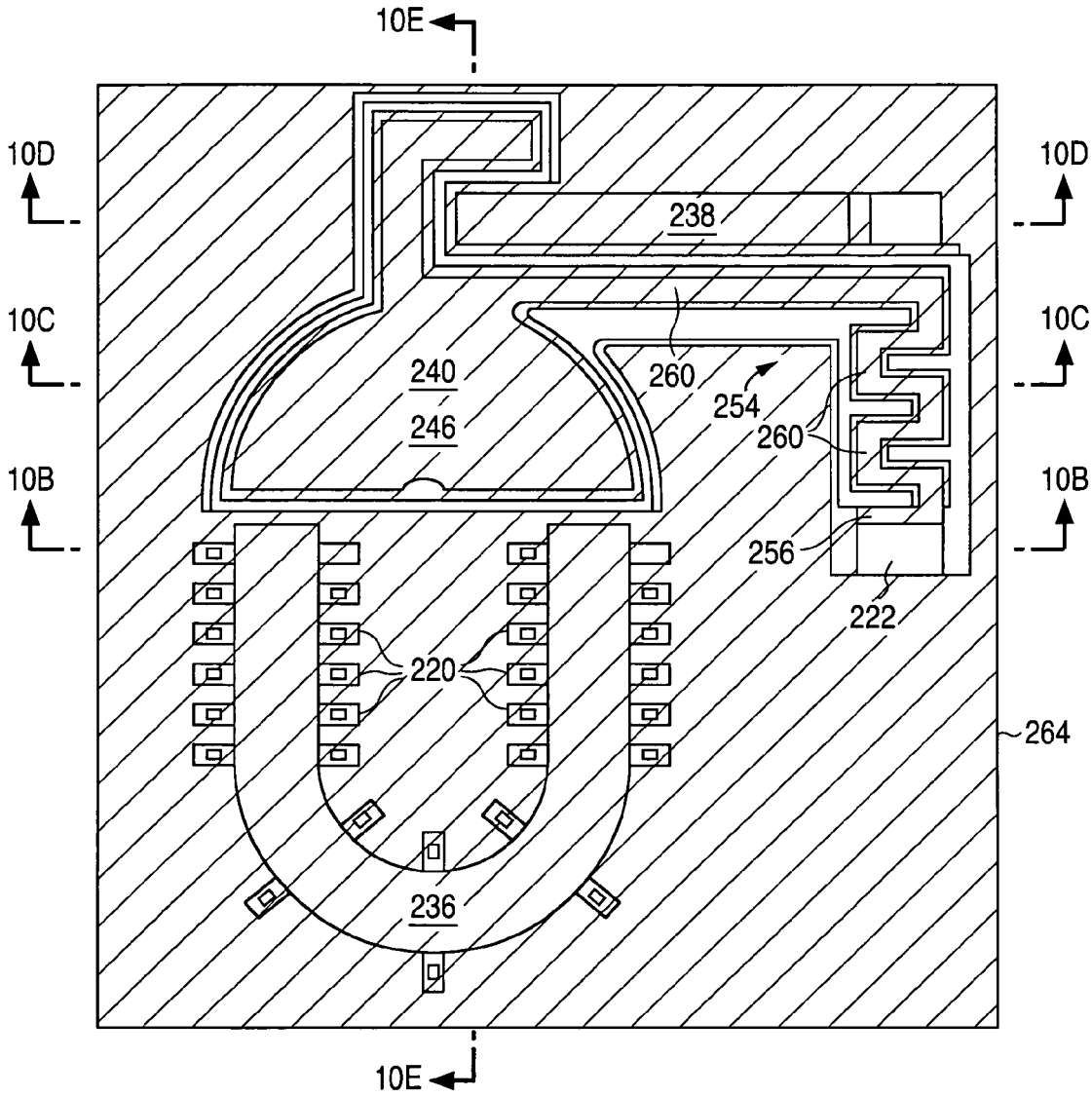
Figure 10B:
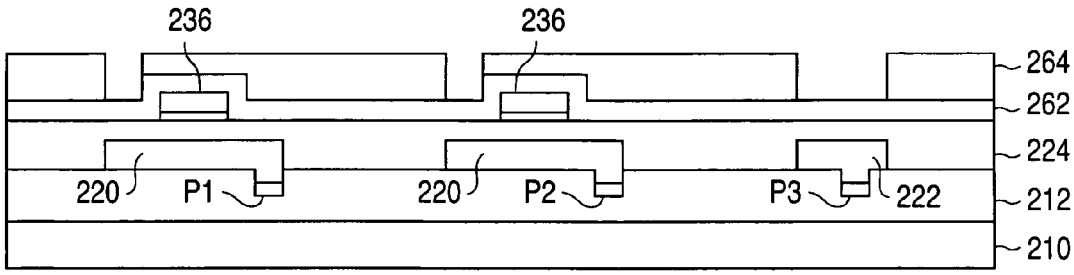
Figure 10C:
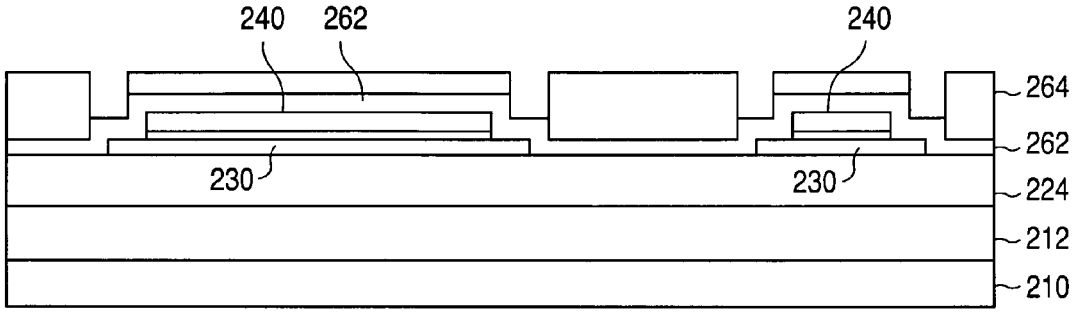
Figure 10D:
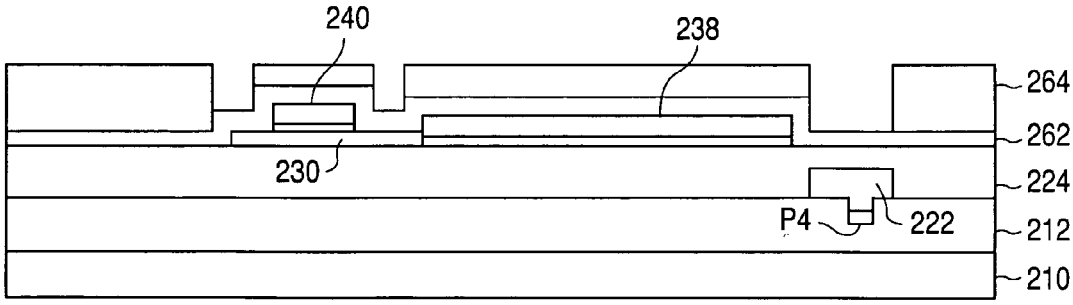
Figure 10E:
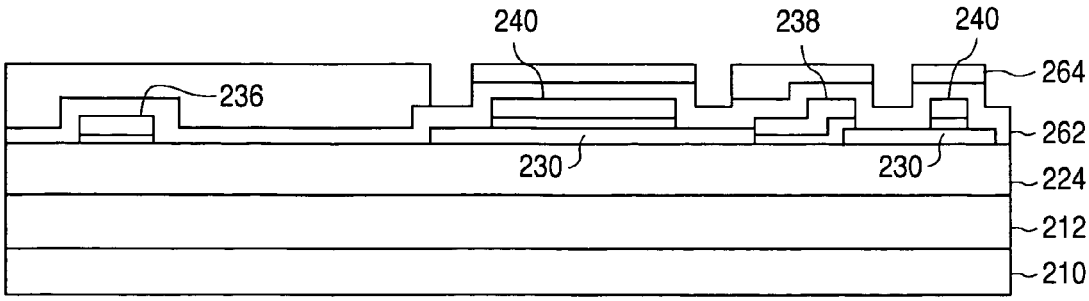
Figure 11A:
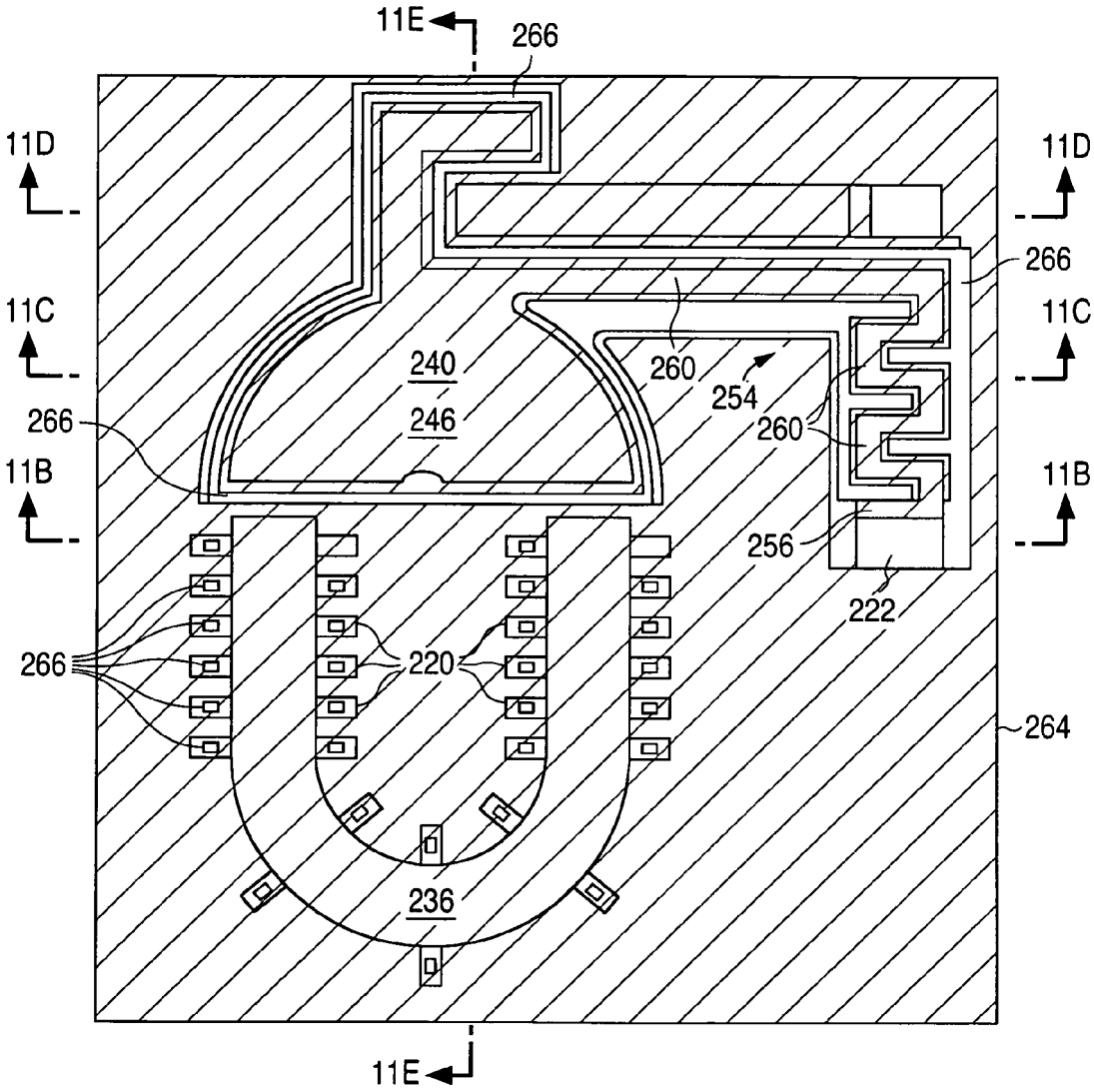
Figure 11B:
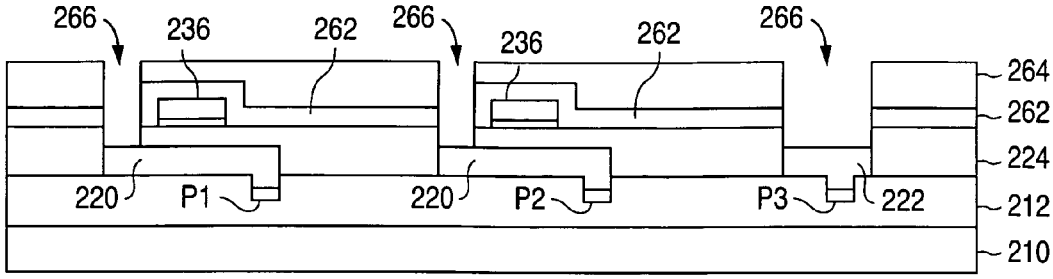
Figure 11C:
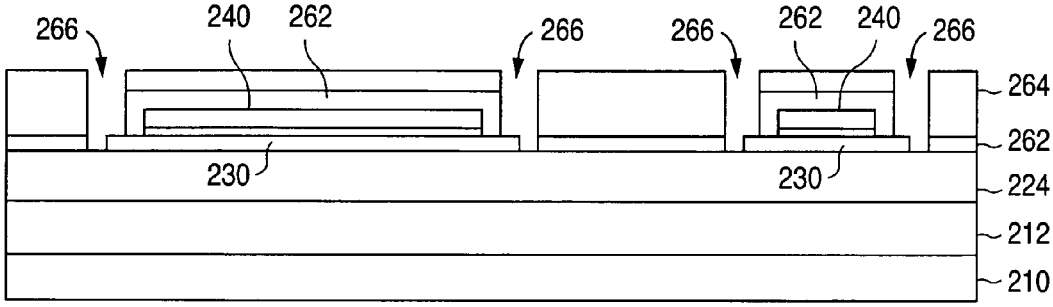
Figure 11D:
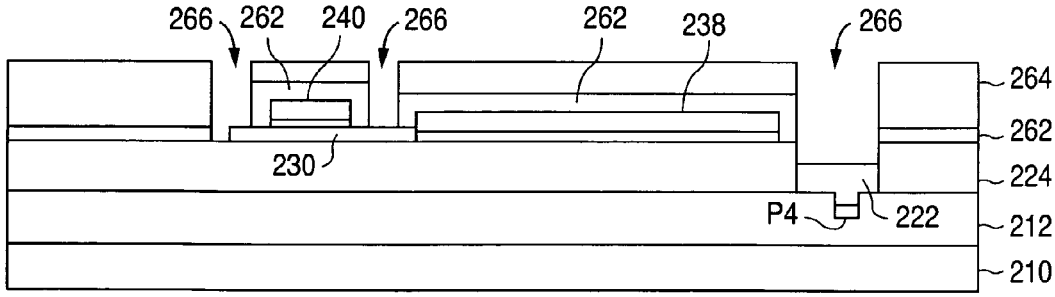
Figure 11E:
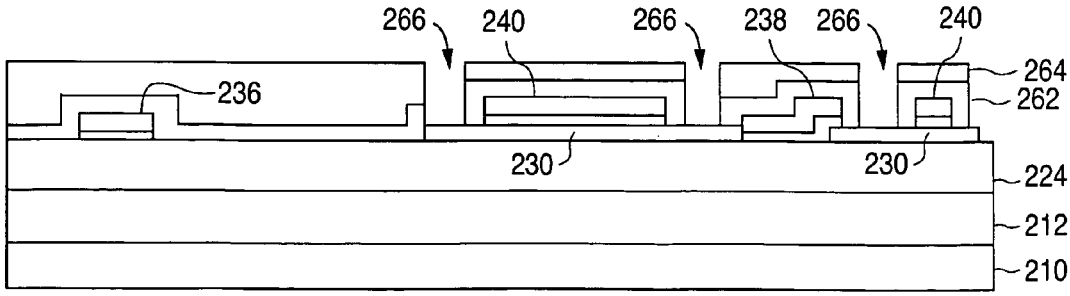
Figure 12A:
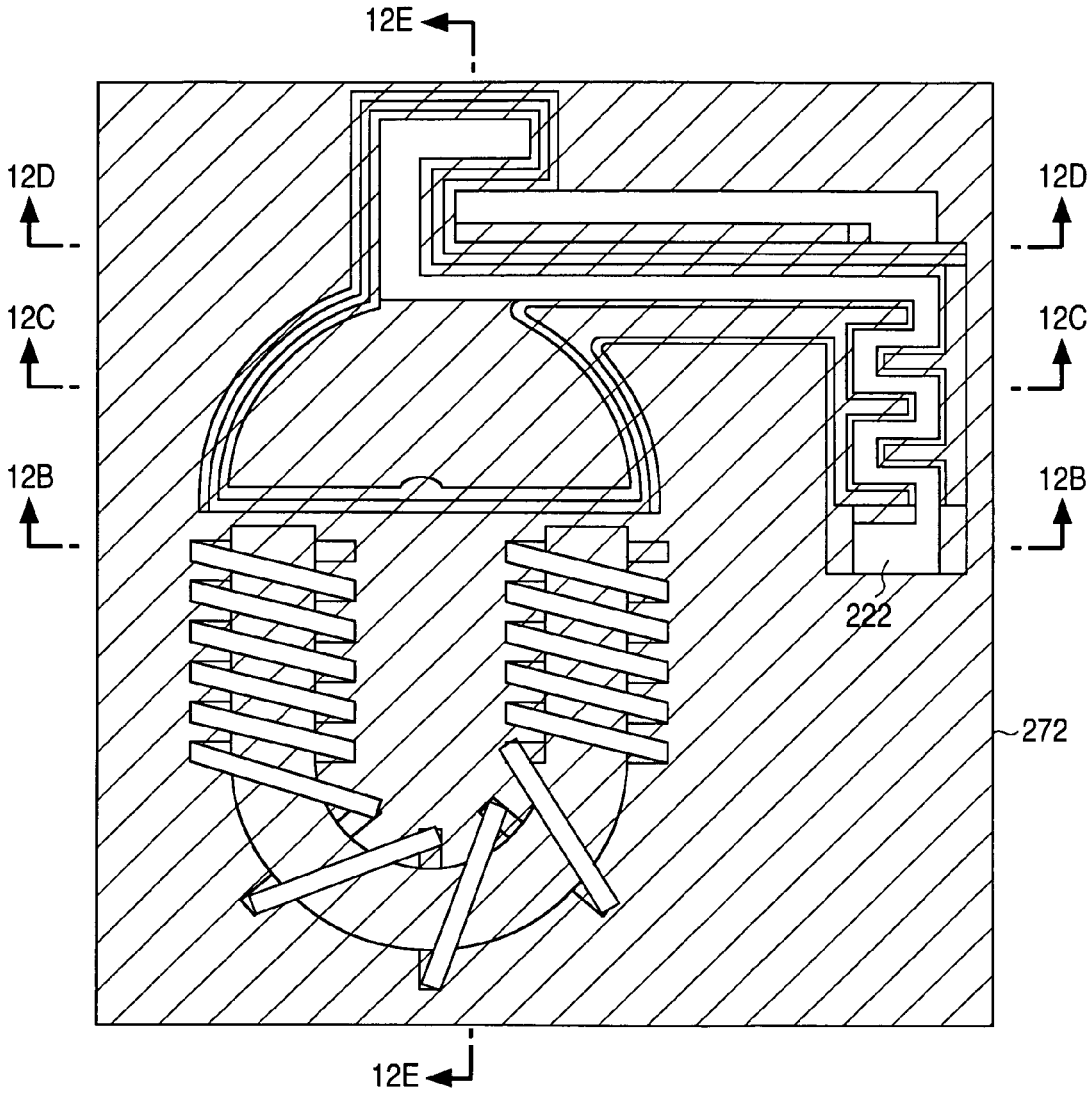
Figure 12B:
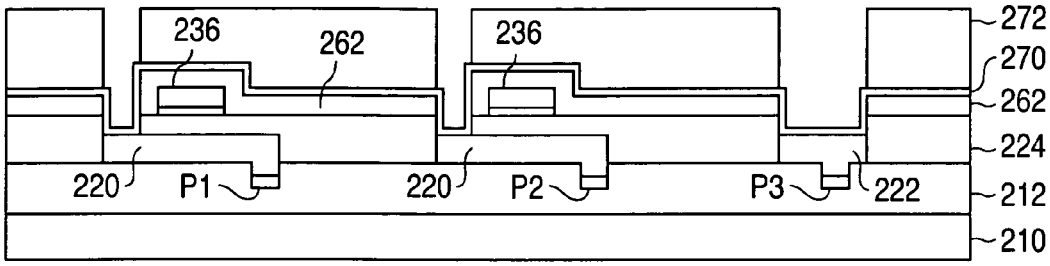
Figure 12C:
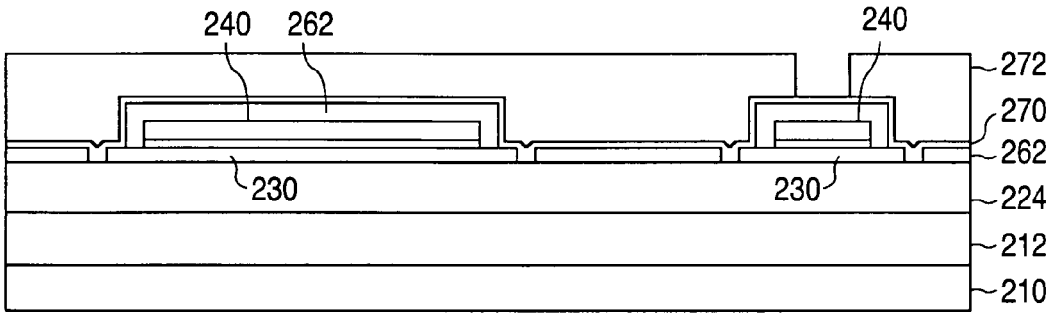
Figure 12D:
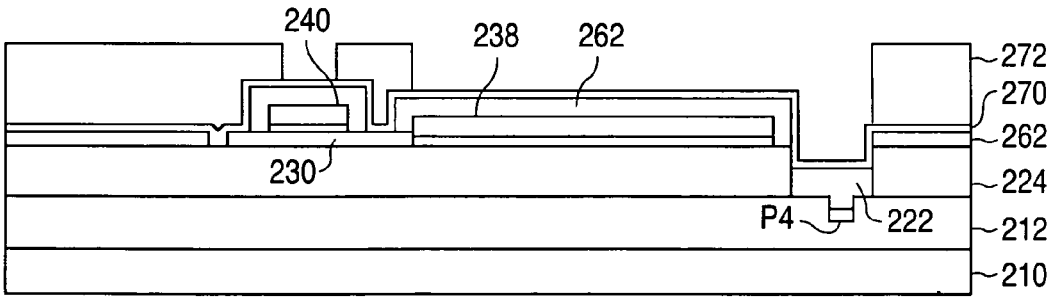
Figure 12E:
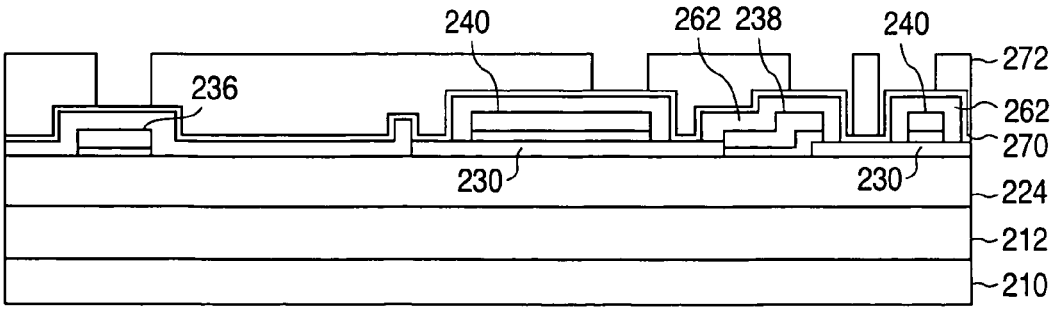
Figure 13A:
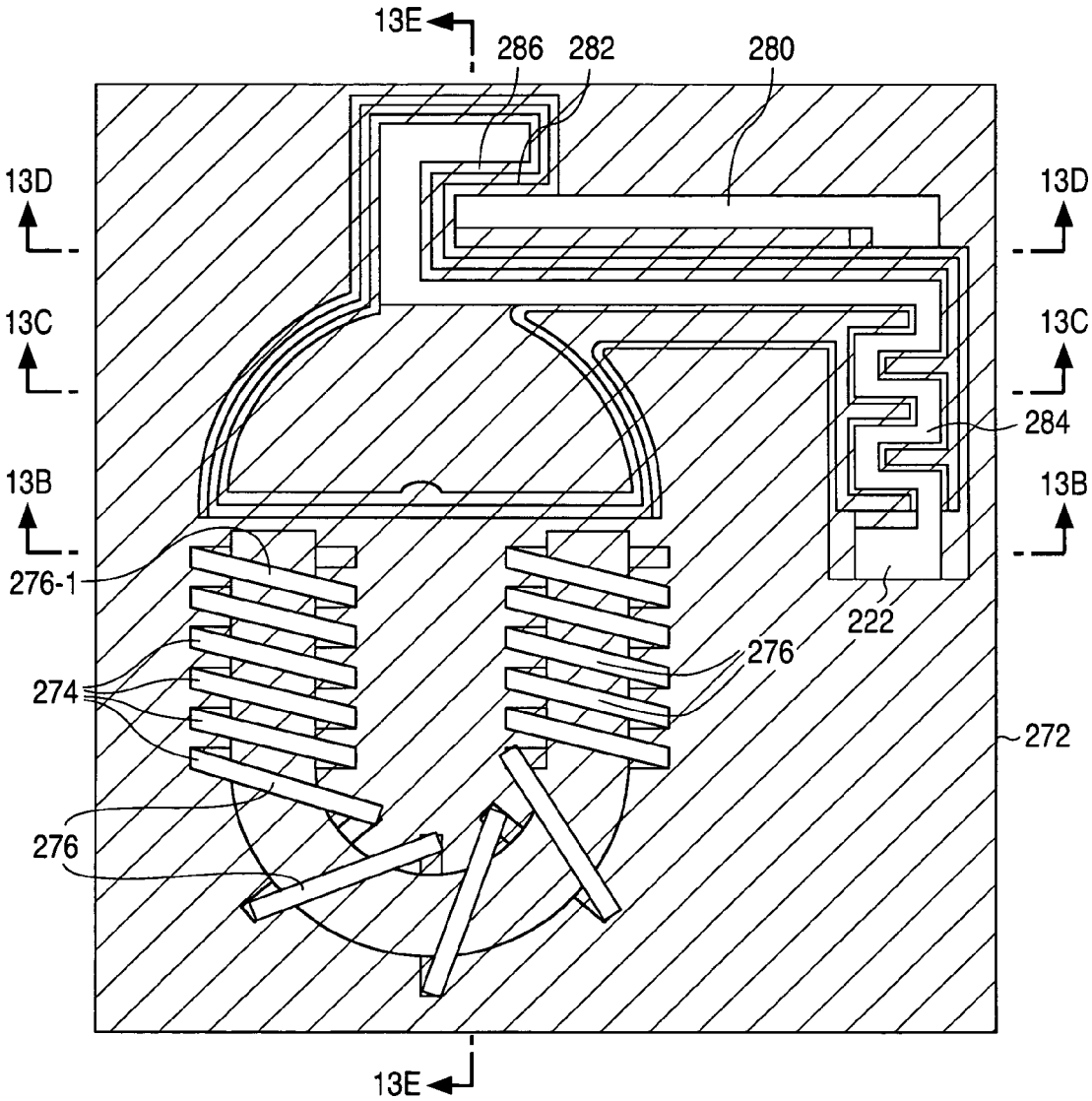
Figure 13B:
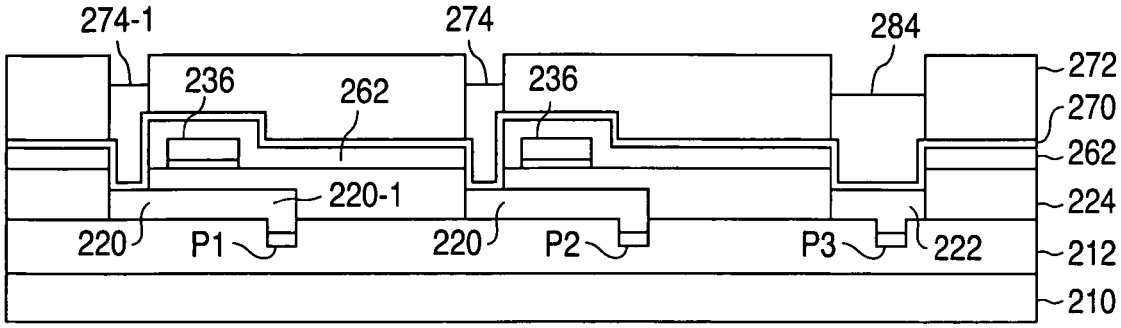
Figure 13C:
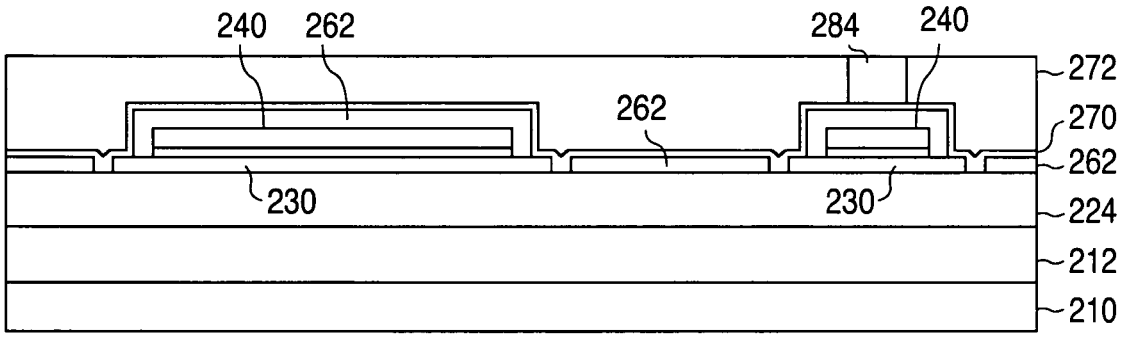
Figure 13D:
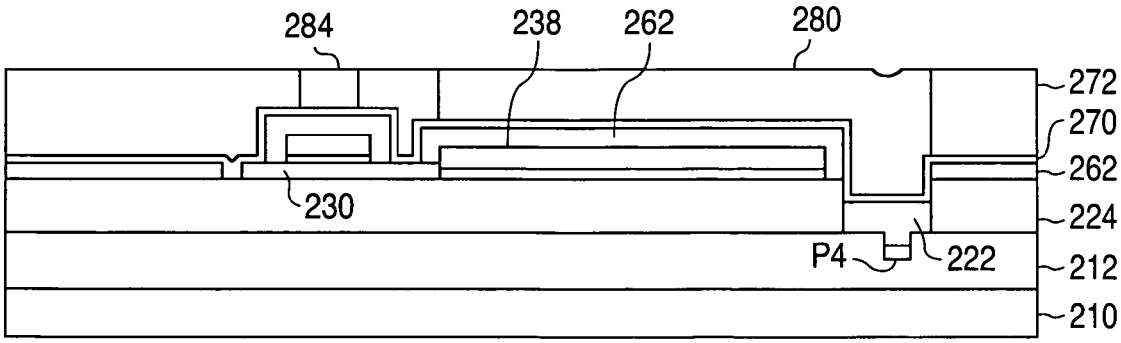
Figure 13E:
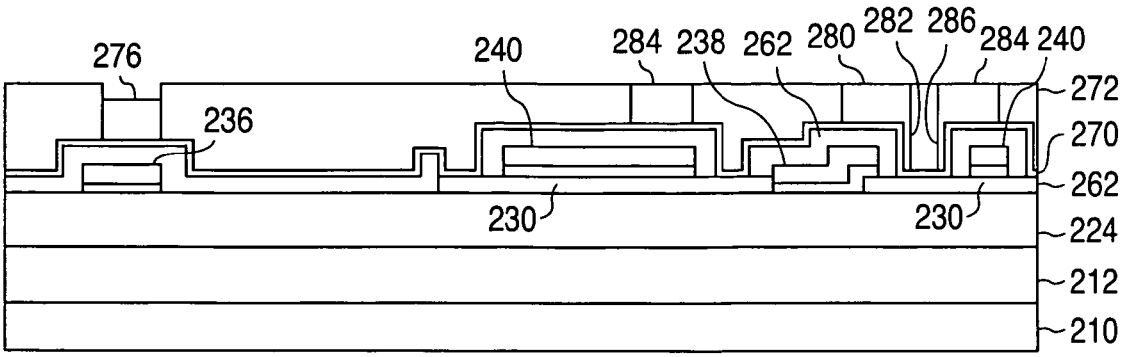
Figure 14A:
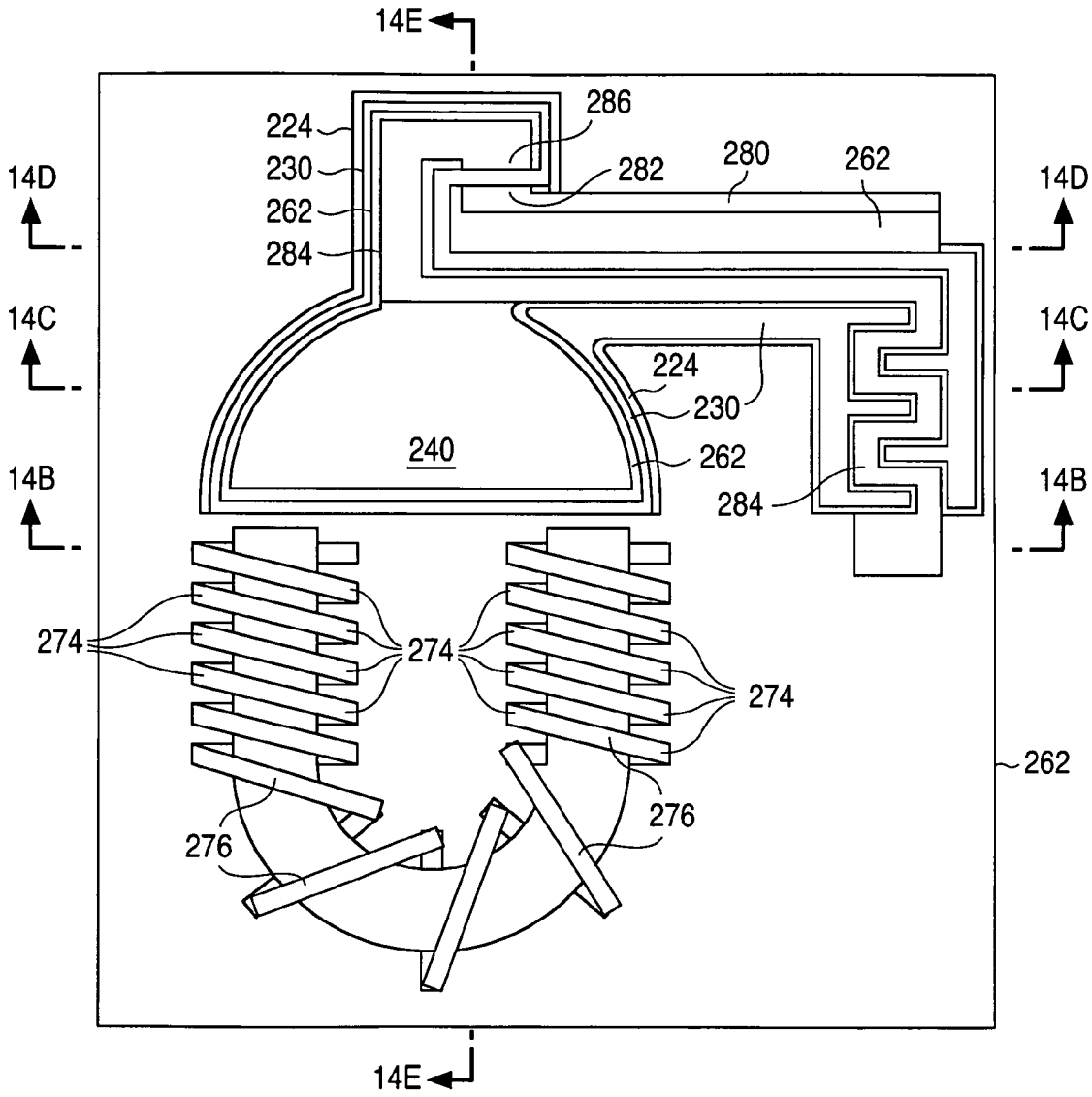
Figure 14B:
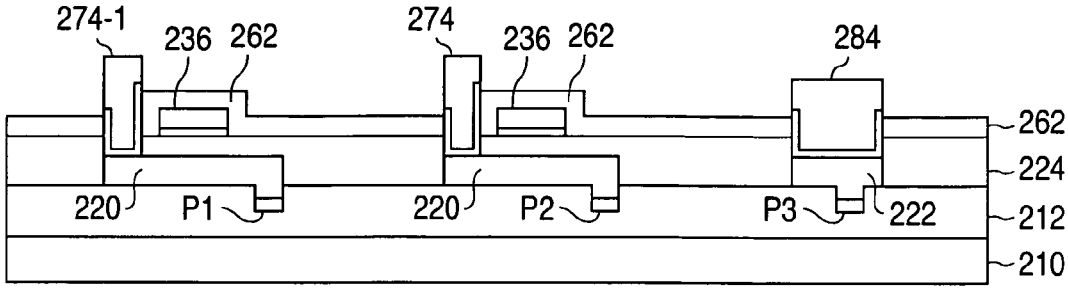
Figure 14C:
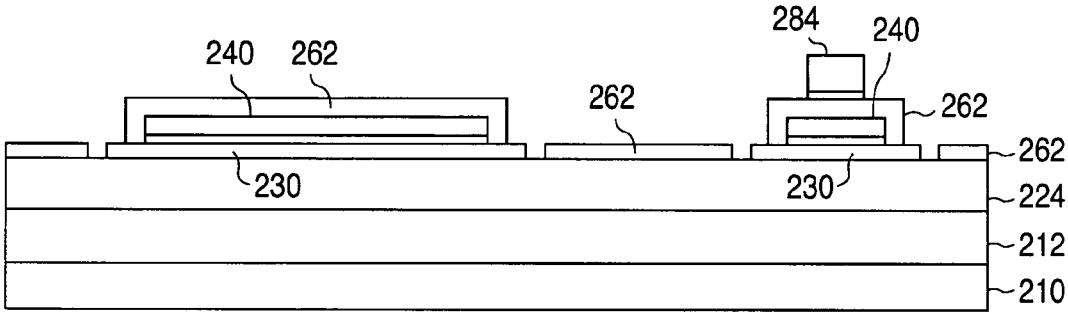
Figure 14D:
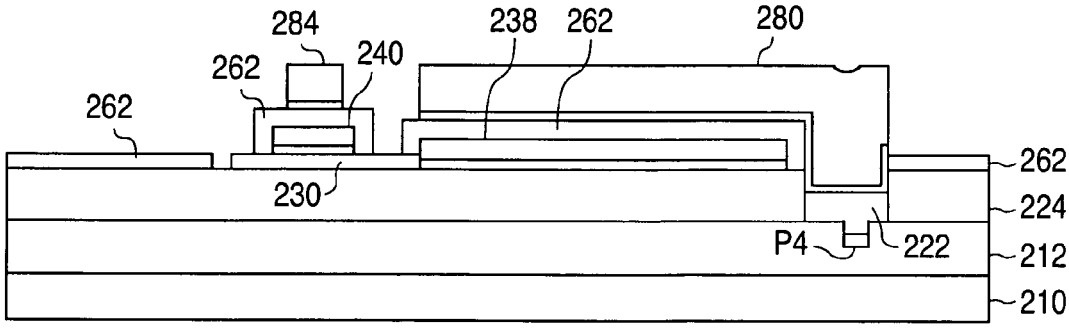
Figure 14E:
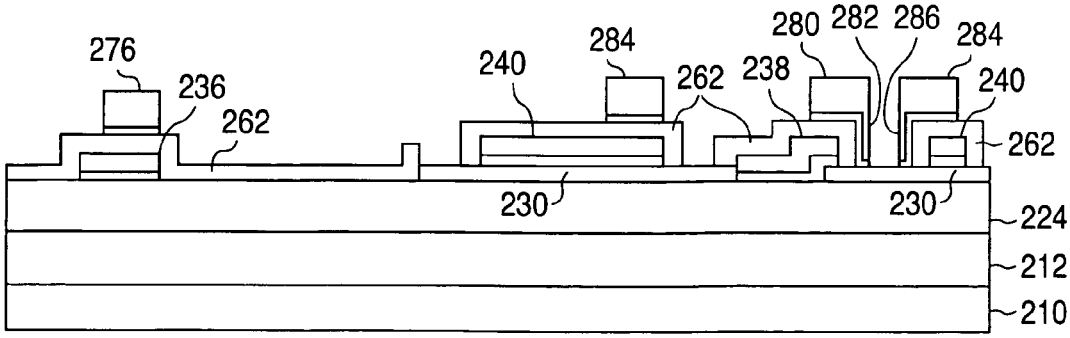

FIG. 1 shows an example of a method 100 of forming the MEMS relay in accordance with the present invention. As shown in FIG. 1, method 100 begins in 110 by forming a number of spaced-apart lower coil members that form the lower horizontal sections of a to-be-formed coil. In addition, a pair of lower input/output members can optionally be formed at the same time that the lower coil members are formed.

FIGS. 2A-15A, 2B-15B, 2C-15C, 2D-15D, and 2E-15E show a series of views that illustrate an example of method 100 in accordance with the present invention. FIGS. 2A-3A, 2B-3B, 2C-3C, 2D-3D, and 2E-3E show a series of views that illustrate an example of method 100 forming a number of spaced-apart lower coil members in accordance with the present invention.

As shown in FIGS. 2A-2E, method 100 utilizes a conventionally formed single-crystal silicon semiconductor wafer 210 that has an overlying base dielectric layer 212. Base dielectric layer 212 can represent a dielectric layer that includes no metal structures, or a dielectric layer that includes metal structures, such as the dielectric layer of a metal interconnect structure.

When formed as the dielectric layer of a metal interconnect structure, base dielectric layer 212 includes levels of metal traces, which are typically aluminum, a large number of contacts that connect the bottom metal trace to electrically conductive regions on wafer 210, and a large number of intermetal vias that connect the metal traces in adjacent layers together. Further, selected regions on the top surfaces of the metal traces in the top metal layer function as pads which provide external connection points.

In the present example, base dielectric layer 212 represents the dielectric layer of a metal interconnect structure that also includes pads P1-P4. Pads P1 and P2 are selected regions on the top surfaces of two of the metal traces in the top layer of metal traces that provide electrical connections for a to-be-formed coil, while pads P3 and P4 are selected regions on the top surfaces of the metal traces that provide electrical input/output connections for a to-be-formed switch. (Only pads P1-P4, and not the entire metal interconnect structure, are shown in cross-section for clarity.)

Referring again to FIGS. 2A-2E, method 100 begins by forming a metal layer 214 on the top surface of base dielectric layer 212. In the present example, since base dielectric layer 212 represents the dielectric layer of a metal interconnect structure, metal layer 214 is also formed on the top surfaces of the pads P1-P4.

Metal layer 214 can include, for example, a layer of titanium (e.g., 100 Å thick), a layer of titanium nitride (e.g., 200 Å thick), a layer of aluminum copper (e.g., 1.2 μm thick), a layer of titanium (e.g., 44 Å thick), and a layer of titanium nitride (e.g., 250 Å thick). Once metal layer 214 has been formed, a lower mask 216 is formed and patterned on the top surface of metal layer 214.

As shown in FIGS. 3A-3E, following the formation and patterning of mask 216, metal layer 214 is etched to remove the exposed regions of metal layer 214 and form a number of spaced-apart lower coil members 220. The lower coil members 220, which have a horseshoe shape, form the lower sides of the to-be-formed coil. Since base dielectric layer 212 represents the dielectric layer of a metal interconnect structure in the present example, the ends of the lower coil members 220 that correspond with the opposite ends of the to-be-formed coil are physically and electrically connected to pads P1 and P2.

In addition, the etch can optionally form a pair of lower input/output members 222 that are physically and electrically connected to the input/output pads P3 and P4. After the lower coil members 220 and the pair of lower input/output members 222 have been formed, mask 216 is removed.

Returning to FIG. 1, once the lower coil members and the pair of lower input/output members have been formed, method 100 moves to 112 to form a lower dielectric layer that touches the lower coil members and the pair of input/output members. FIGS. 4A, 4B, 4C, 4D, and 4E show a series of views that illustrate an example of method 100 forming a lower dielectric layer in accordance with the present invention.

As shown in FIGS. 4A-4E, a lower dielectric layer 224, such as an oxide layer, is formed on base dielectric layer 212, the lower coil members 220, and the pair of lower input/output members 222. For example, lower dielectric layer can be formed by depositing an oxide, and then chemically-mechanically polishing the oxide to have, for example, a target thickness of, for example, 2000 Å, over base dielectric layer 212.

Referring back to FIG. 1, after the lower dielectric layer has been formed, method 100 moves to 114 to form a sacrificial structure that touches the lower dielectric layer. FIGS. 5A-6A, 5B-6B, 5C-6C, 5D-6D, and 5E-6E show a series of views that illustrate an example of method 100 forming a sacrificial structure in accordance with the present invention.

As shown in FIGS. 5A-5E, once lower dielectric layer 224 has been formed, a sacrificial layer 226 is formed on the top surface of lower dielectric layer 224. For example, a layer of amorphous silicon that has a thickness of, for example, 2000 Å, can be formed on the top surface of lower dielectric layer 224. Once sacrificial layer 226 has been formed, a mask 228 is formed and patterned on the top surface of sacrificial layer 226.

As shown in FIGS. 6A-6E, following the formation and patterning of mask 228, sacrificial layer 226 is etched to remove the exposed regions of sacrificial layer 226 and form a sacrificial structure 230. After sacrificial layer 226 has been etched to form sacrificial structure 230, mask 228 is removed.

Referring again to FIG. 1, after the sacrificial structure has been formed, method 100 moves to 116 to form a core, a switch member, and a suspension member that touch the lower dielectric layer. No portion of the switch member touches the core. FIGS. 7A-9A, 7B-9B, 7C-9C, 7D-9D, and 7E-9E show a series of views that illustrate an example of method 100 forming a core, a switch member, and a suspension member in accordance with the present invention.

As shown in FIGS. 7A-7E, after the formation of sacrificial structure 230, a seed layer 232 is formed on the top surface of lower dielectric layer 224 and sacrificial structure 230. For example, seed layer can be formed by depositing 300 Å of titanium, 3000 Å of copper, and 300 Å of titanium. After seed layer 232 has been formed, a plating mold 234 (shown cross-hatched) is formed and patterned on the top surface of seed layer 232.

Next, following the formation of plating mold 234, as illustrated in FIGS. 8A-8E, the top titanium layer is stripped and a magnetic material, such as an alloy of nickel and iron like permalloy, is deposited by electroplating to a thickness of, for example, 10 μm, to form a core 236, a switch member 238, and a suspension member 240.

After this, plating mold 234 is removed, followed by the removal of the underlying regions of seed layer 232. As shown in FIGS. 9A-9E, core 236, which mirrors the shape of the to-be-formed coil, also has a horseshoe shape that lies over the lower coil members 220, while switch member 238 has a contact sidewall 244.

As further shown in FIGS. 9A-9E, suspension member 240 has an intermediate member 246. Intermediate member 246 lies between core 236 and switch member 238, and lies adjacent to the contact sidewall 244 of switch member 238. As a result, intermediate member 246 is separated from core 236 by an actuation gap 250, while intermediate member 246 is separated from the contact sidewall 244 of switch member 238 by a contact gap 252.

Actuation gap 250 can be made to be slightly larger than contact gap 252, thereby ensuring that an electrical connection will always be made when the relay is activated. The sizes of actuation gap 250 and contact gap 252 are defined by the pattern in plating mold 234. Further, in the present example, intermediate member 246 is also formed to have a half-circle shape, and is oriented towards core 236 to form a racetrack shape. Suspension member 240 also includes a spring member 254. In the present example, as shown in FIGS. 9A-9E, spring member 254 is implemented with a base section 256, which provides the only point where suspension member 240 touches lower dielectric layer 224, and an extension section 260 that, along with intermediate member 246, are spaced apart from dielectric layer 224.

Referring again to FIG. 1, after the core, the switch member, and the suspension member have been formed, method 100 moves to 118 to form tops and sides that touch the lower coil members to form a coil, a conductive first switch trace that sits over the switch member, and a conductive second switch trace that sits over and rides on the suspension member. No portion of the coil is wrapped around the suspension member.

FIGS. 10A-14A, 10B-14B, 10C-14C, 10D-14D, and 10E-14E show a series of views that illustrate an example of method 100 forming tops and sides that touch the lower coil members to form a coil, a conductive first switch trace that sits over the switch member, and a conductive second switch trace that sits over and rides on the suspension member in accordance with the present invention.

As shown in FIGS. 10A-10E, after the formation of core 236, switch member 238, and suspension member 240 have been formed, and after the removal of plating mold 234 and the underlying regions of seed layer 232, an upper dielectric layer 262, such as an oxide layer, is formed on lower dielectric layer 224, core 236, switch member 238, and suspension member 240. For example, upper dielectric layer 262 can be formed by conformally depositing an oxide to a thickness of, for example, 1 μm, over lower dielectric layer 224. After upper dielectric layer 262 has been formed, a mask 264, such as a layer of photoresist, is then formed and patterned on the top surface of upper dielectric layer 262.

Following the formation and patterning of mask 264, as shown in FIGS. 11A-11E, the exposed regions of the upper dielectric layer 262 and underlying lower dielectric layer 224 are etched to form a number of vertical openings 266. The vertical openings 266 include via-type openings that expose the top surfaces of the ends of the lower coil members 220 that form the lower sides of the to-be-formed coil. The vertical openings 266 also expose the pair of lower input/output members 222. In addition, the vertical openings 266 also form a trench that extends from base section 256 around suspension member 240 and back again to base section 256.

In accordance with the present invention, the exposed regions of sacrificial structure 230 are not to be removed during this etch. As a result, vertical openings 266 are formed with an etchant that is highly selective to the material used to form sacrificial structure 230. In addition, sacrificial structure 230, which was formed to have the same thickness as lower dielectric layer 224, can also be formed to be thicker than lower dielectric layer 224 to ensure that a significant portion of the exposed regions of sacrificial structure 230 remain after the etch. Following the etch, mask 264 is then removed.

Once mask 264 has been removed, as shown in FIGS. 12A-12E, a seed layer 270 is formed on the exposed ends of the lower coil members 220, the exposed input/output members 222, lower dielectric layer 224, sacrificial structure 230, and the top surface of upper dielectric layer 262. For example, seed layer can be formed by depositing 300 Å of titanium, 3000 Å of copper, and 300 Å of titanium. After seed layer 270 has been formed, a plating mold 272 (shown cross-hatched) is formed and patterned on the top surface of seed layer 270. The pattern in plating mold 272 is shown hatched in FIG. 12A.

Next, as shown in FIGS. 13A-13E, following the formation and patterning of plating mold 272, the top titanium layer is stripped and copper is deposited by electroplating to form a number of copper side sections 274 of the coil, and a number of copper upper sections 276 of the coil. In addition, the electroplating also forms a first switch trace 280 with a sidewall contact 282, and a second switch trace 284 with a sidewall contact 286. The first and second switch traces 280 and 284 also touch the input/output members 222 to make an electrical connection. As further shown in FIGS. 13A-13E, lower coil member 220-1, side section 274-1, and upper section 276-1 form three sides of one coil loop. Following this, as shown in FIGS. 14A-14E, plating mold 272 and the underlying regions of seed layer 270 are removed.

Referring again to FIG. 1, after the coil, the conductive first switch trace, and the conductive second switch trace have been formed, method 100 moves to 120 to remove the sacrificial structure so that the suspension member moves in response to changes in a current flowing through the coil.

In other words, the conductive second switch trace makes and breaks electrical contact with the first conductive switch trace as the suspension member moves in response to changes in a current flowing through the coil. In addition, a magnetic flux passes through a portion of the suspension member and substantially no magnetic flux passes through the first and the second conductive switch traces when a current flows through the coil.

FIGS. 15A-15E show a series of views that illustrate an example of method 100 removing sacrificial structure 230 in accordance with the present invention. As shown in FIGS. 15A-15E, after the coil, first switch trace 280, and second switch trace 284 have been formed, sacrificial structure 230 is removed. The removal of sacrificial structure 230 leaves intermediate member 246 and extension section 260 of spring member 254 floating. For example, in the example shown in FIGS. 15A-15E, intermediate member 246 and extension section 260 each float, connected to lower dielectric layer 224 only via base section 256.

Floating extension section 260 was vertically spaced apart from lower dielectric layer 224 by underlying sacrificial structure 230, and thereby floats after underlying sacrificial structure 230 has been removed. As a result, the thickness of sacrificial structure 230 determines an offset gap 290, which is the vertical spacing that lies between lower dielectric layer 224 and floating extension section 260.

Thus, as shown in FIGS. 15A-15E, the method of the present invention forms a MEMS relay 1500 that includes core 236 and a coil 1510 that is wrapped around core 236. Coil 1510 can be implemented with the lower coil members 220, the copper side sections 274, and the copper upper sections 276. In addition, both core 236 and coil 1510 touch lower dielectric layer 224.

As further shown in FIGS. 15A-15E, MEMS relay 1500 also includes a switch structure 1512 and a suspension structure 1514. Switch structure 1512 can be implemented with switch member 238, which touches lower dielectric layer 224, and upper dielectric layer 262. Suspension structure 1514 can be implemented with suspension member 240, which touches lower dielectric layer 224, and upper dielectric layer 262. Further, no portion of coil 1510 is wrapped around suspension structure 1514.

As additionally shown in FIGS. 15A-15E, MEMS relay 1500 includes first switch trace 280 that touches and extends along switch structure 1512, and second switch trace 284 that touches and extends along suspension structure 1514. Further, first switch trace 280 has a first sidewall contact 282, and second switch trace 284 has a second sidewall contact 286.

Figure 15A:
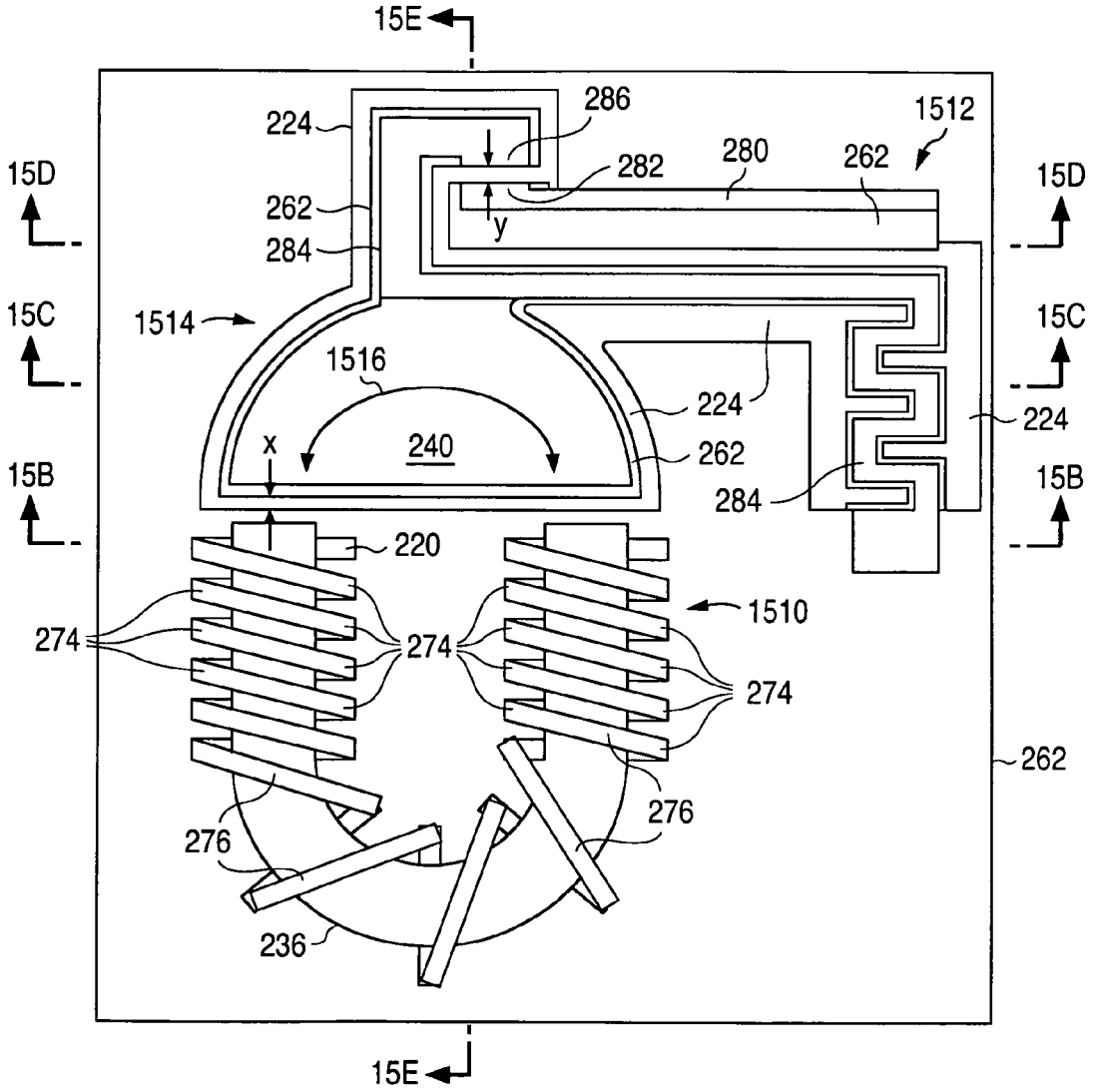
Figure 15B:
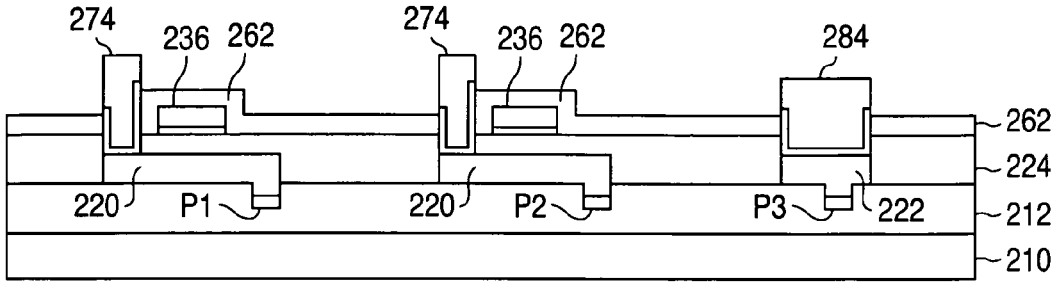
Figure 15C:
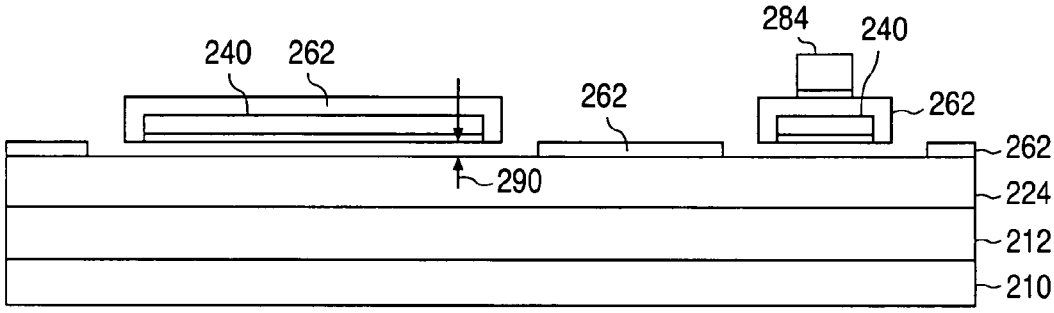
Figure 15D:
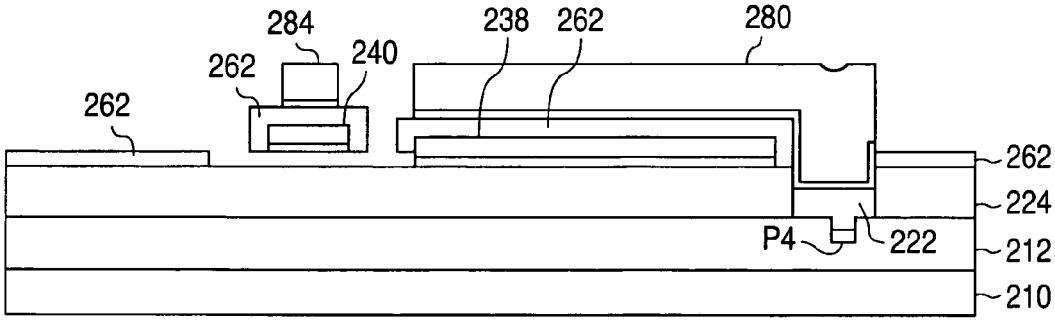
Figure 15E:
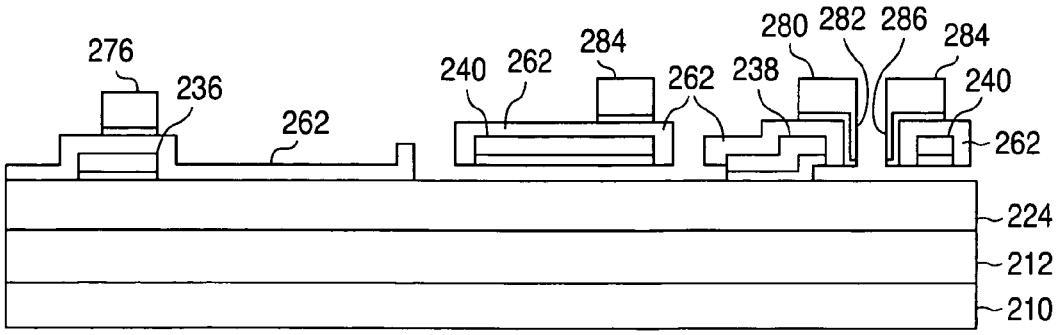
Figure 16A:
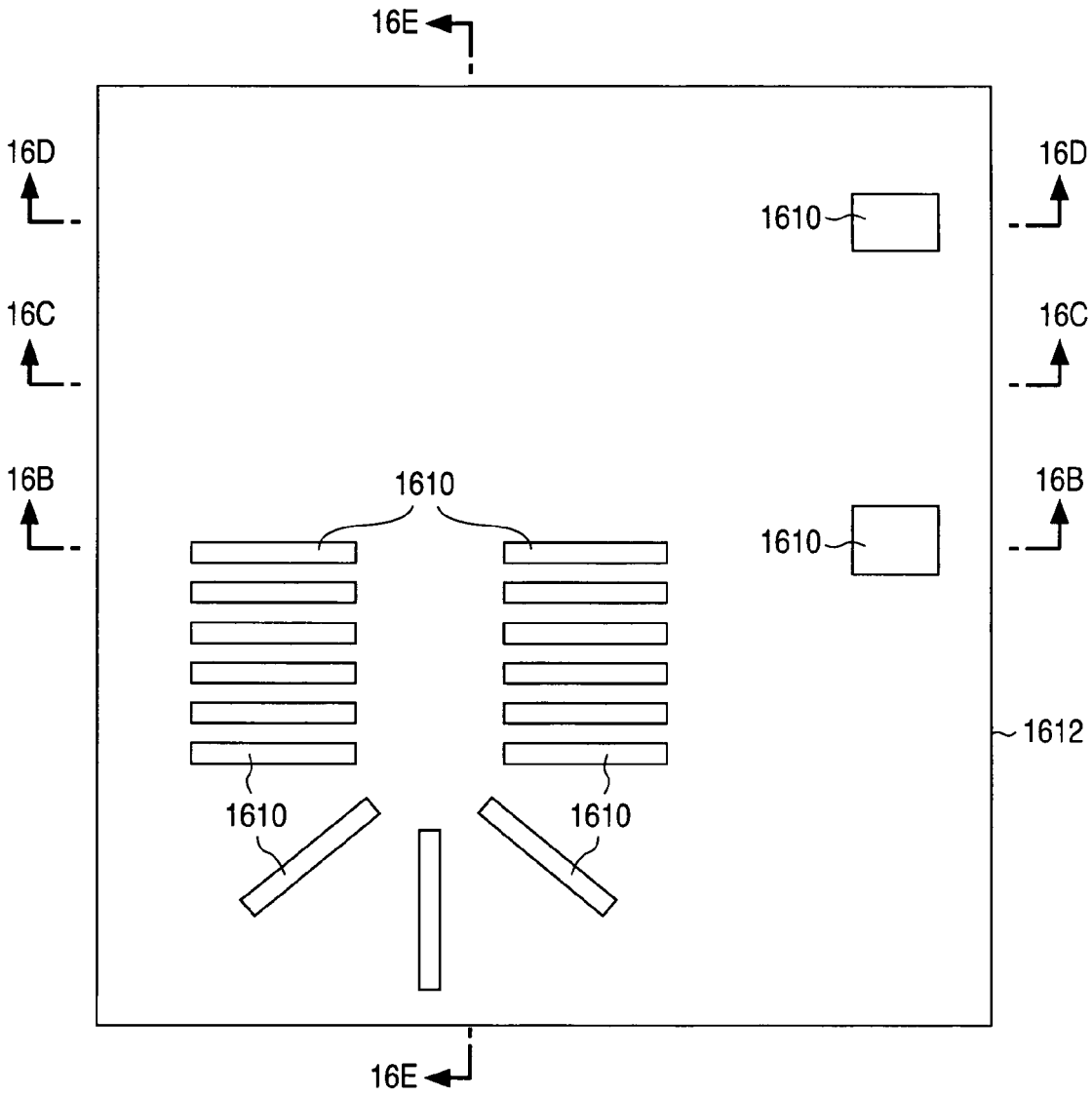
Figure 16B:
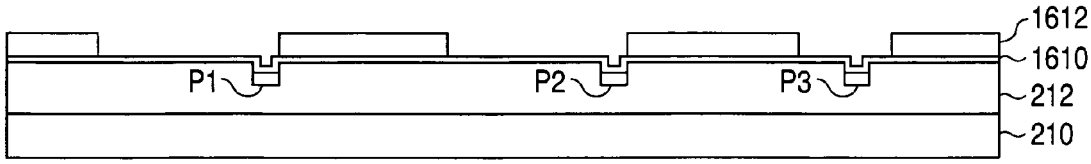
Figure 16C:
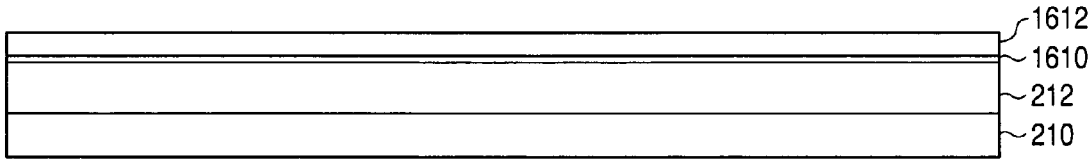
Figure 16D:
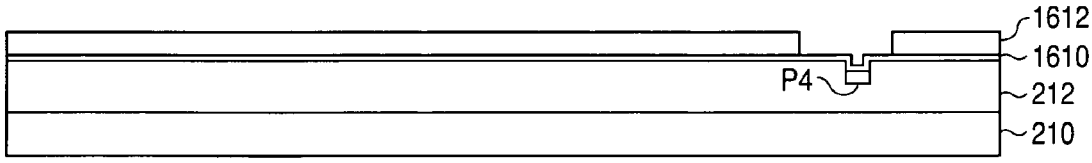
Figure 16E:
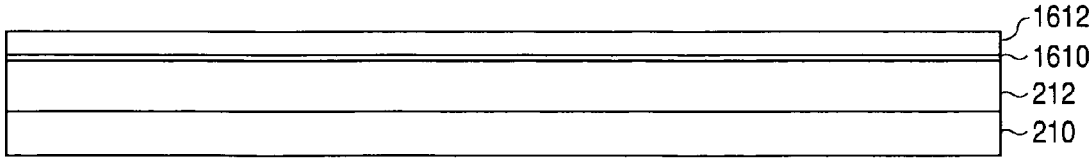
Figure 17A:
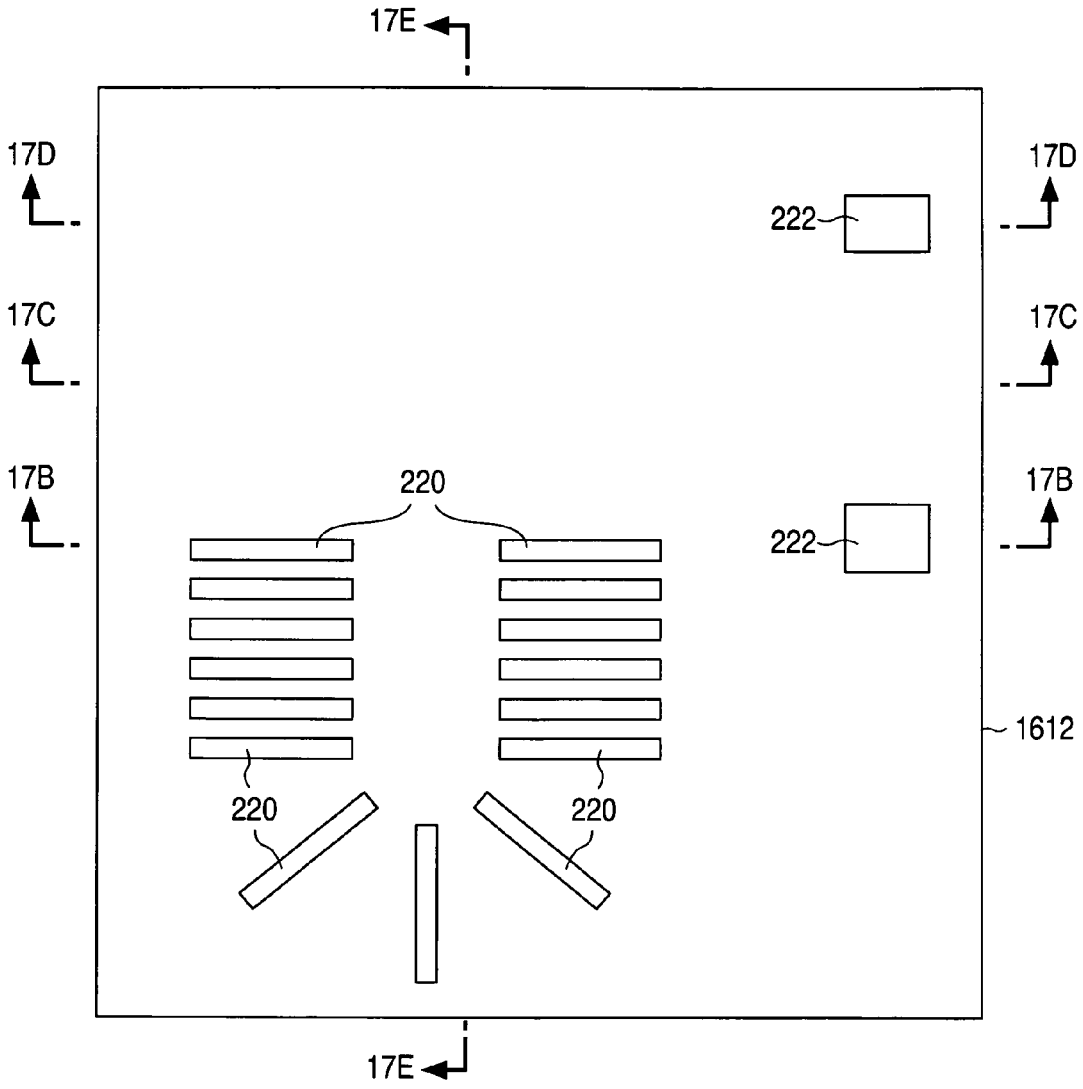
Figure 17B:
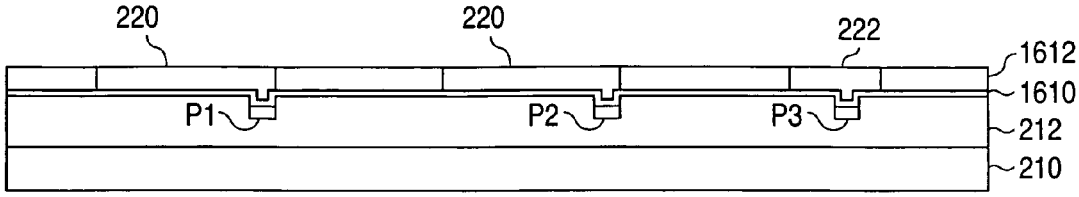
Figure 17C:
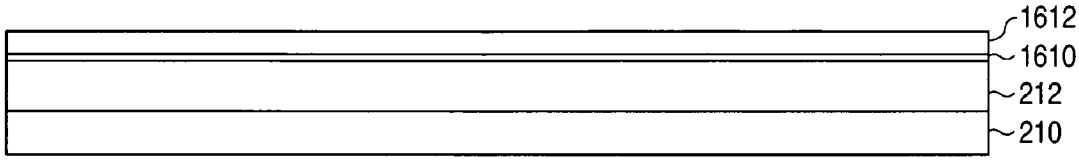
Figure 17D:
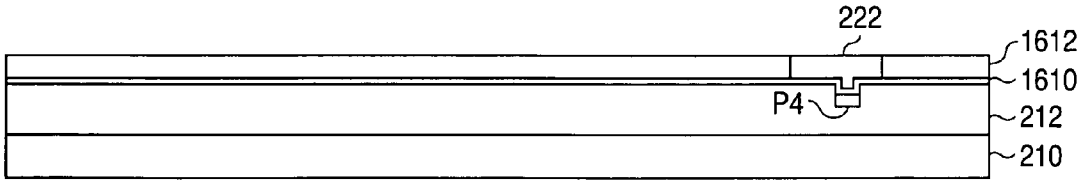
Figure 17E:
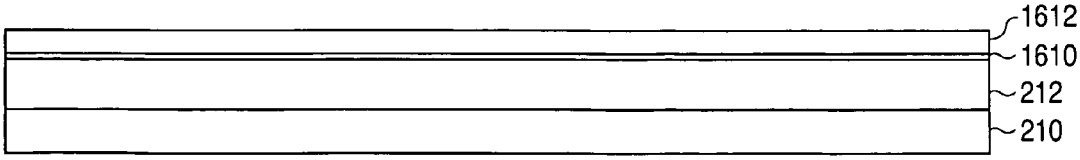
Figure 18A:
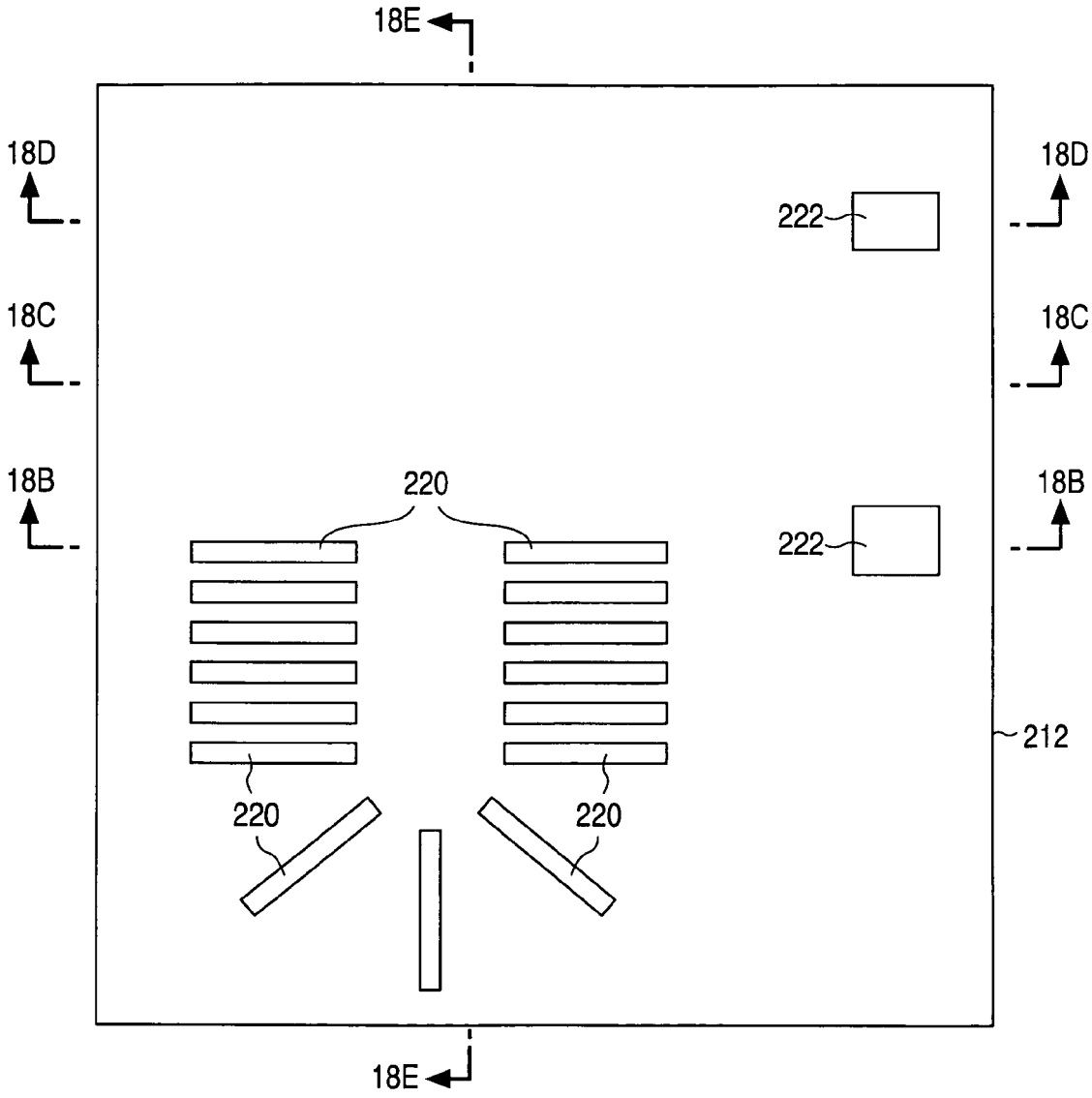
Figure 18B:
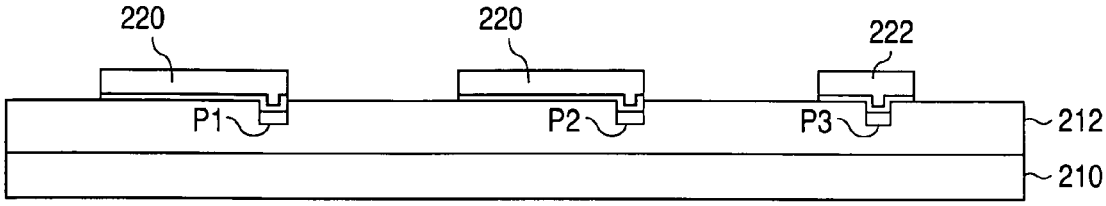
Figure 18C:
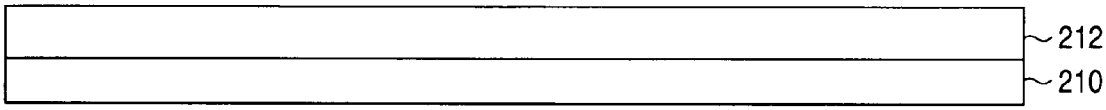
Figure 18D:
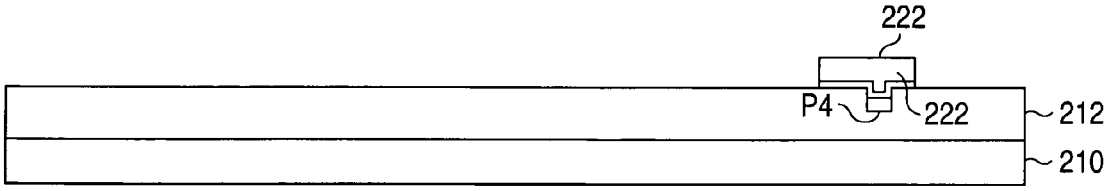
Figure 18E:
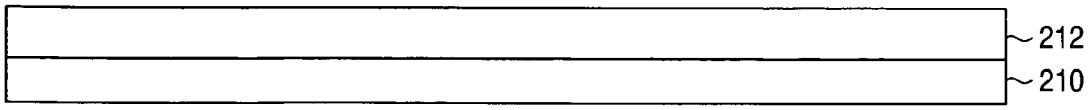
Figure 19A:
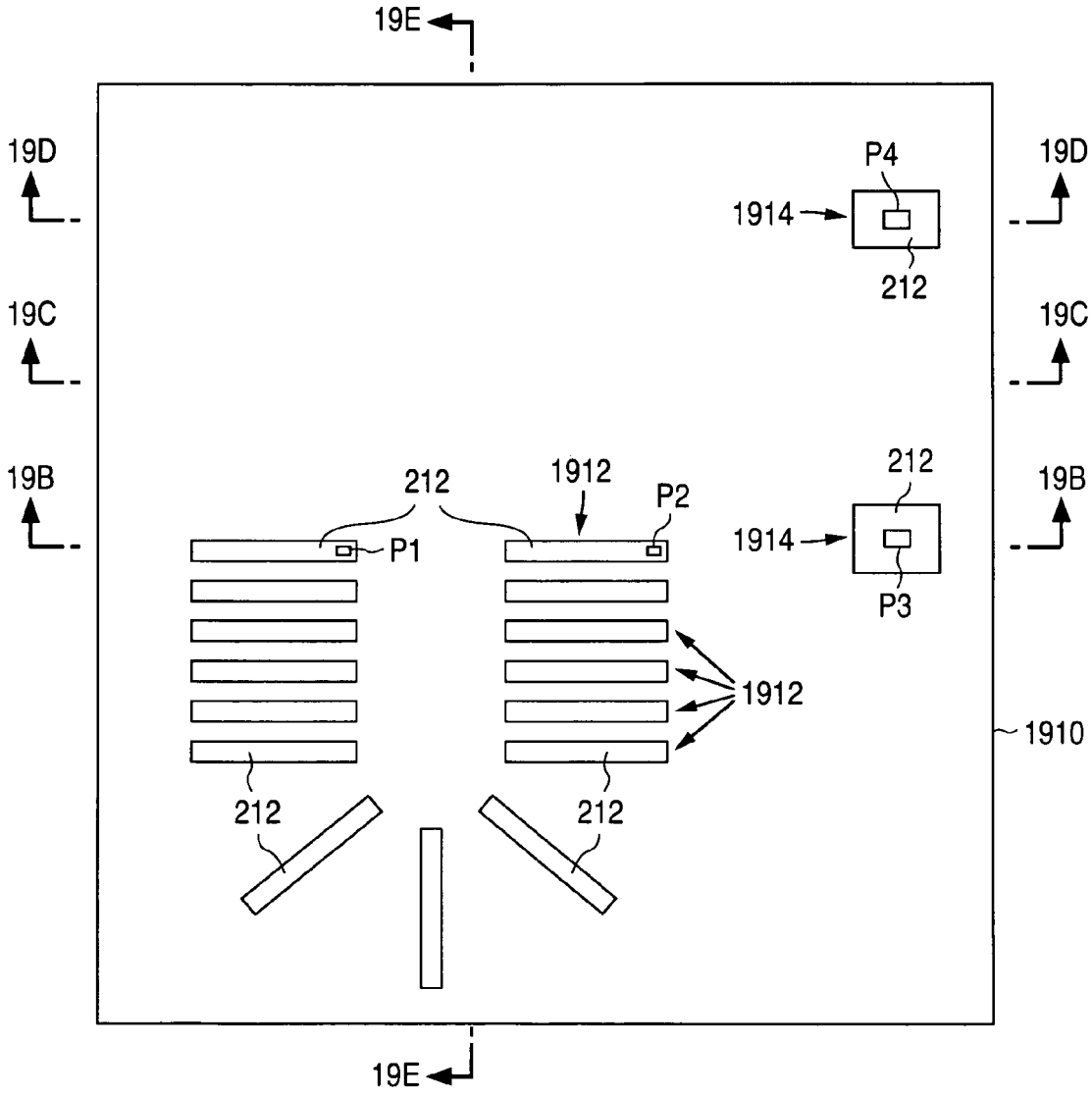
Figure 19B:
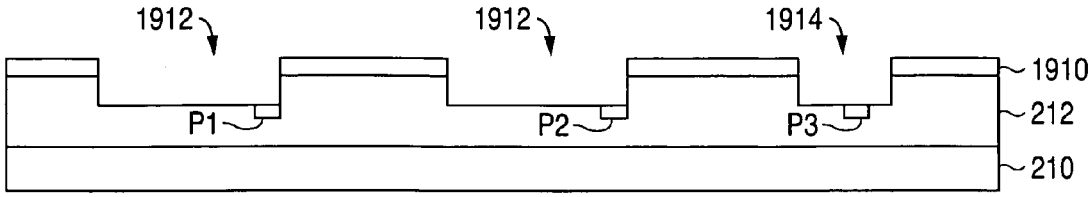
Figure 19C:
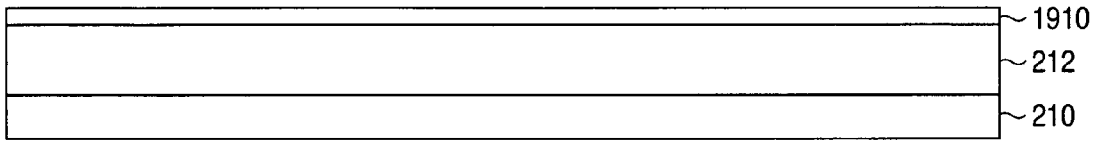
Figure 19D:
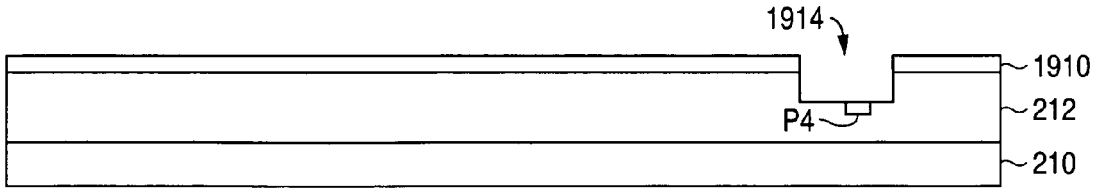
Figure 19E:
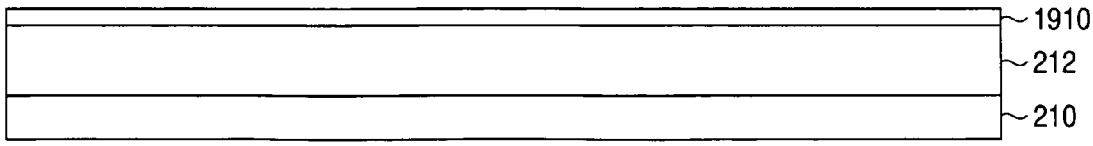
Figure 20A:
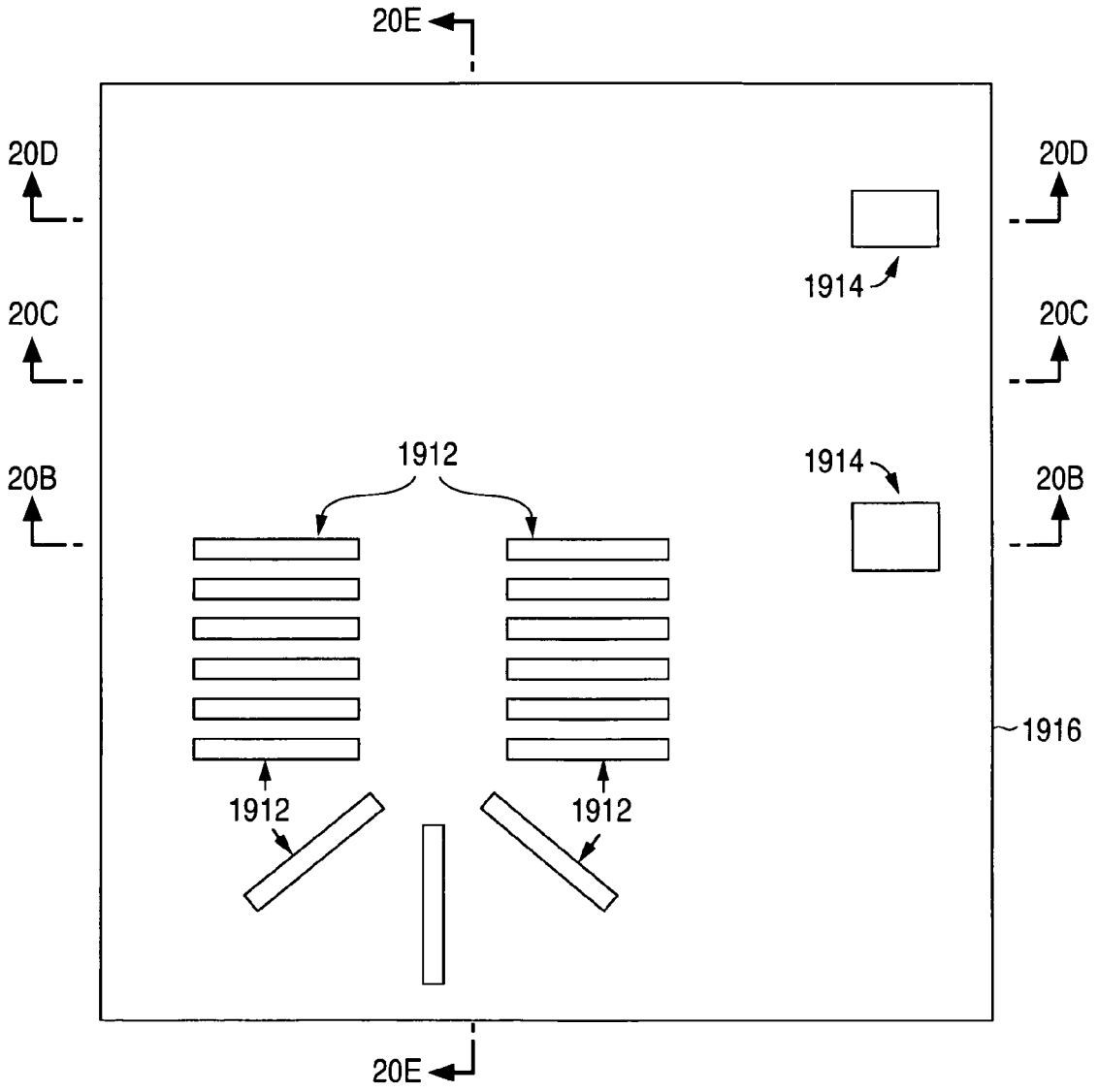
Figure 20B:
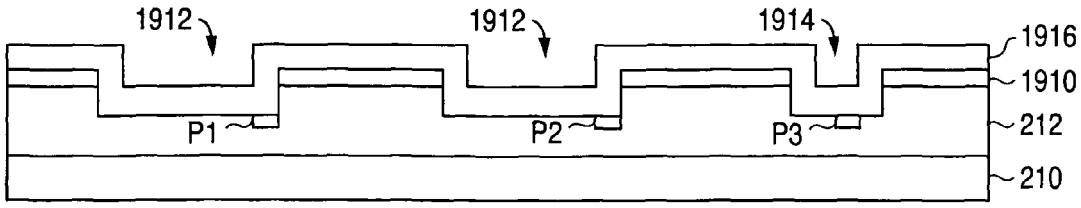
Figure 20C:
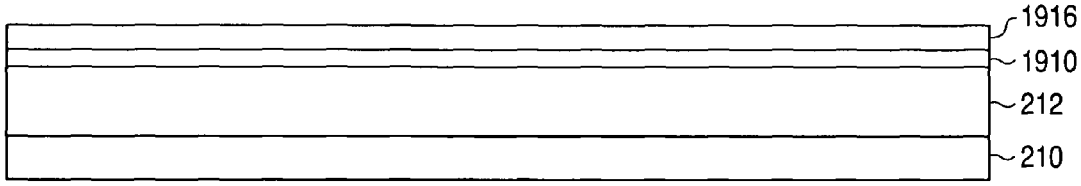
Figure 20D:
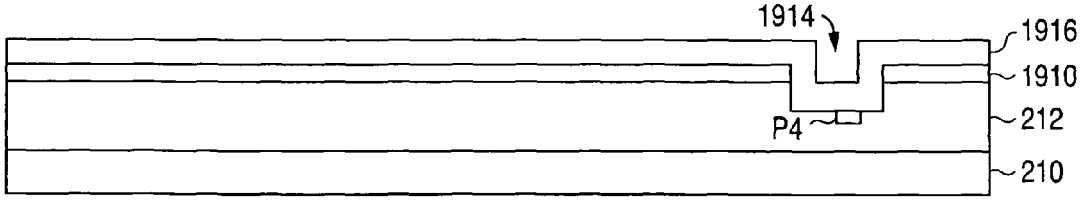
Figure 20E:
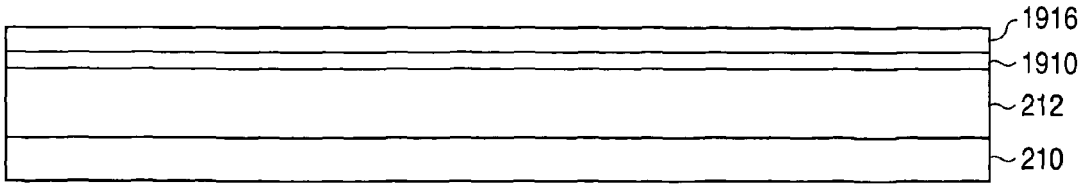
Figure 21A:
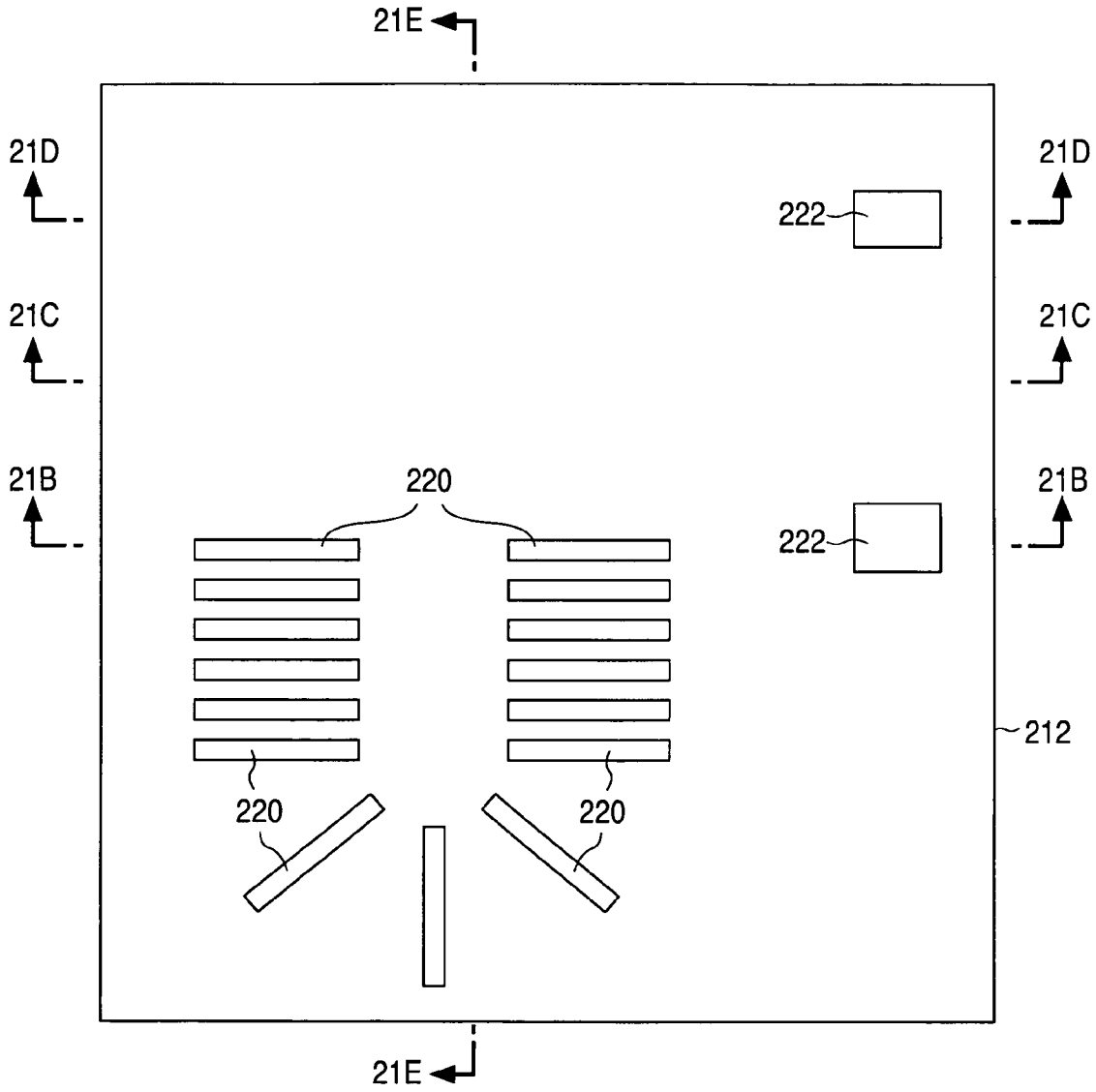
Figure 21B:
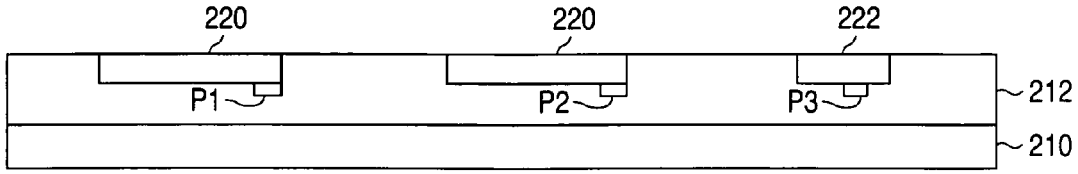
Figure 21C:
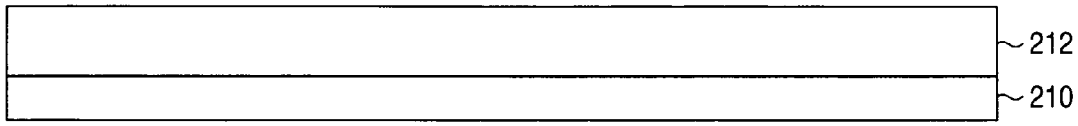
Figure 21D:
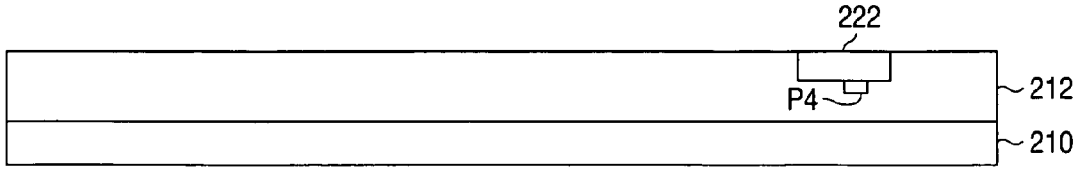
Figure 21E:
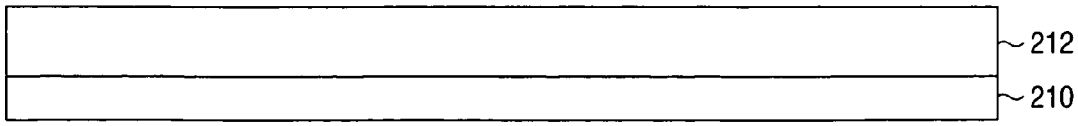
Figure 22A:
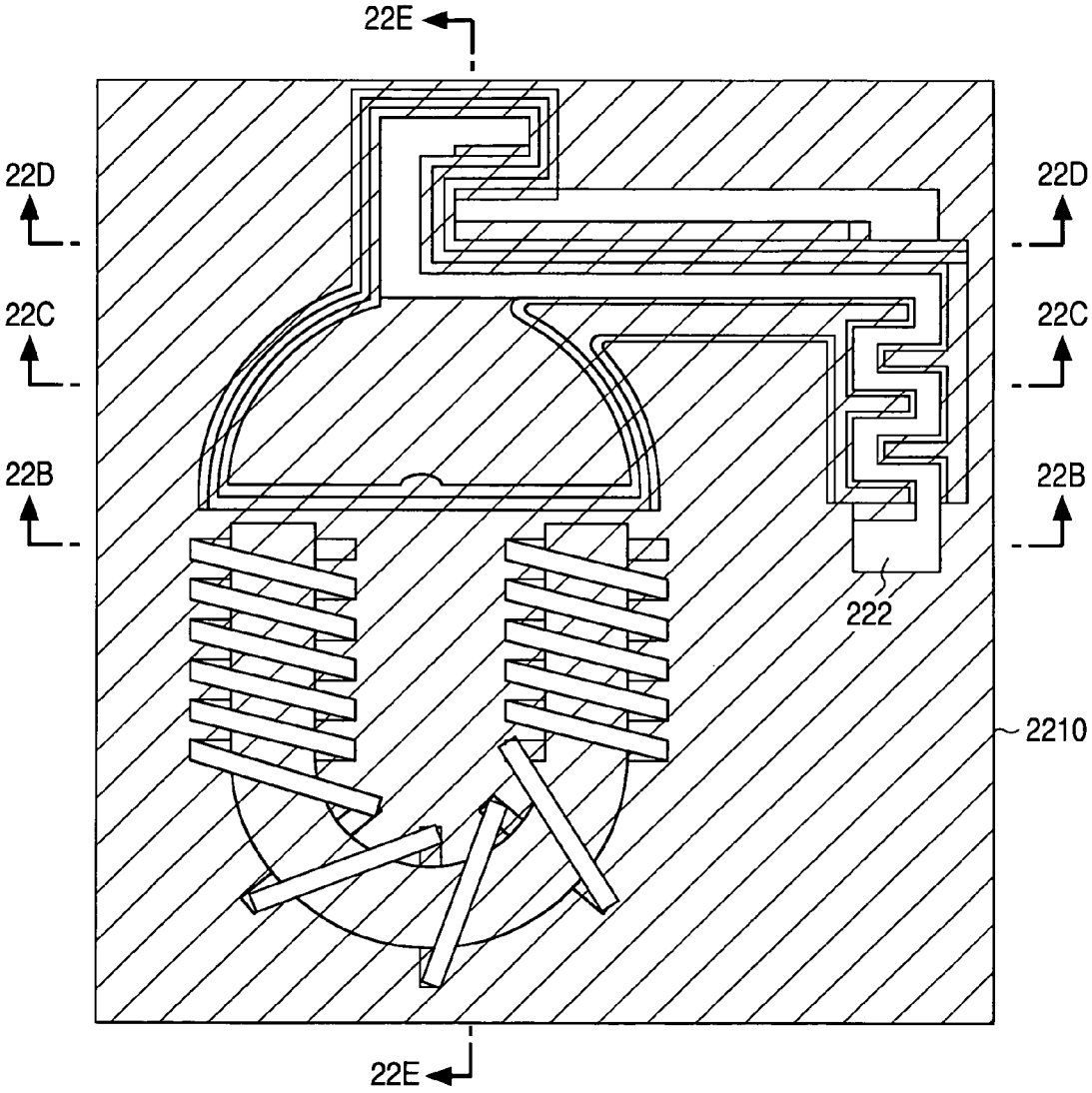
Figure 22B:
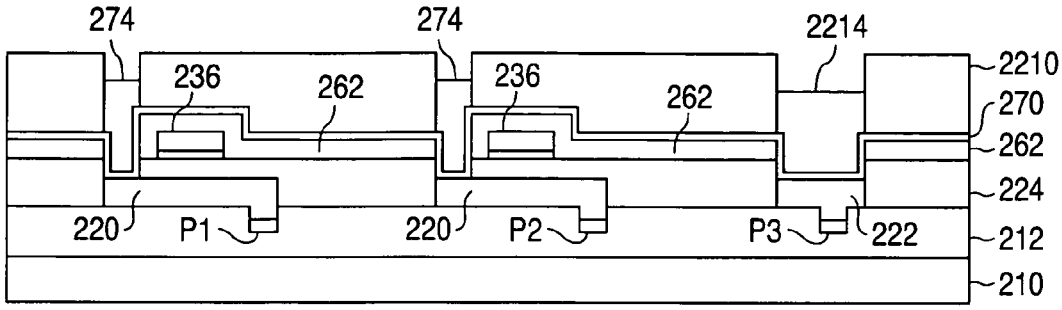
Figure 22C:
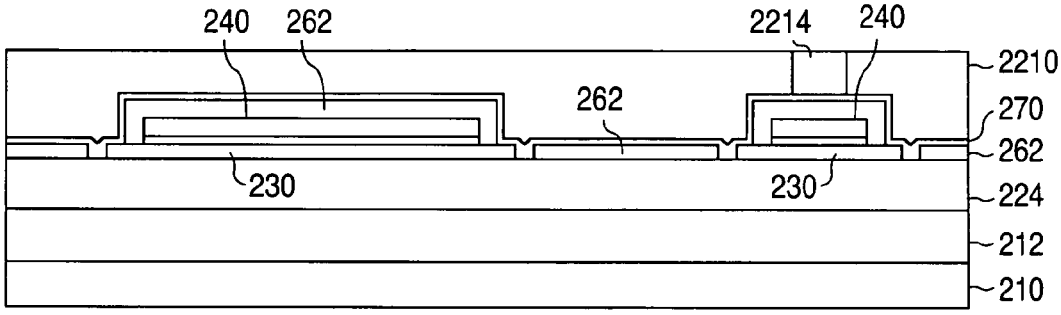
Figure 22D:
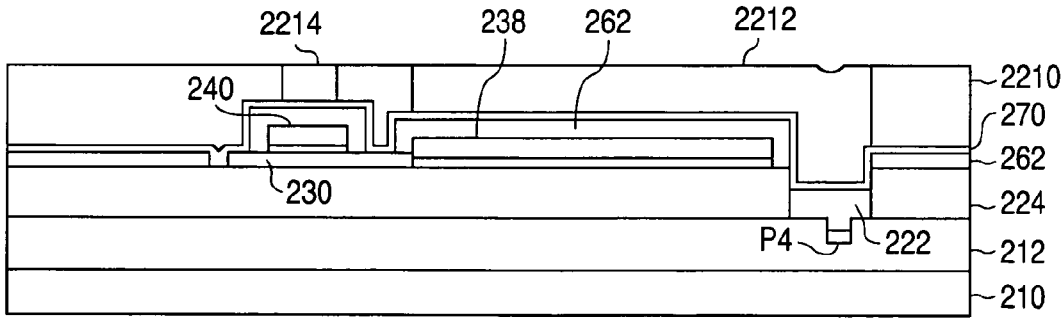
Figure 22E:
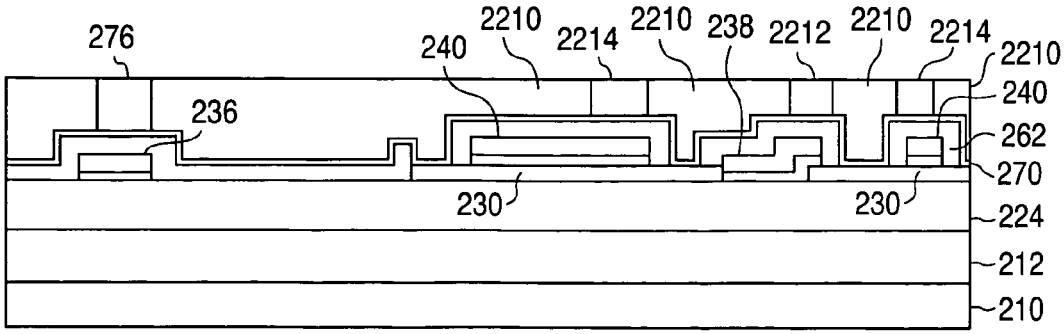
Figure 23A:
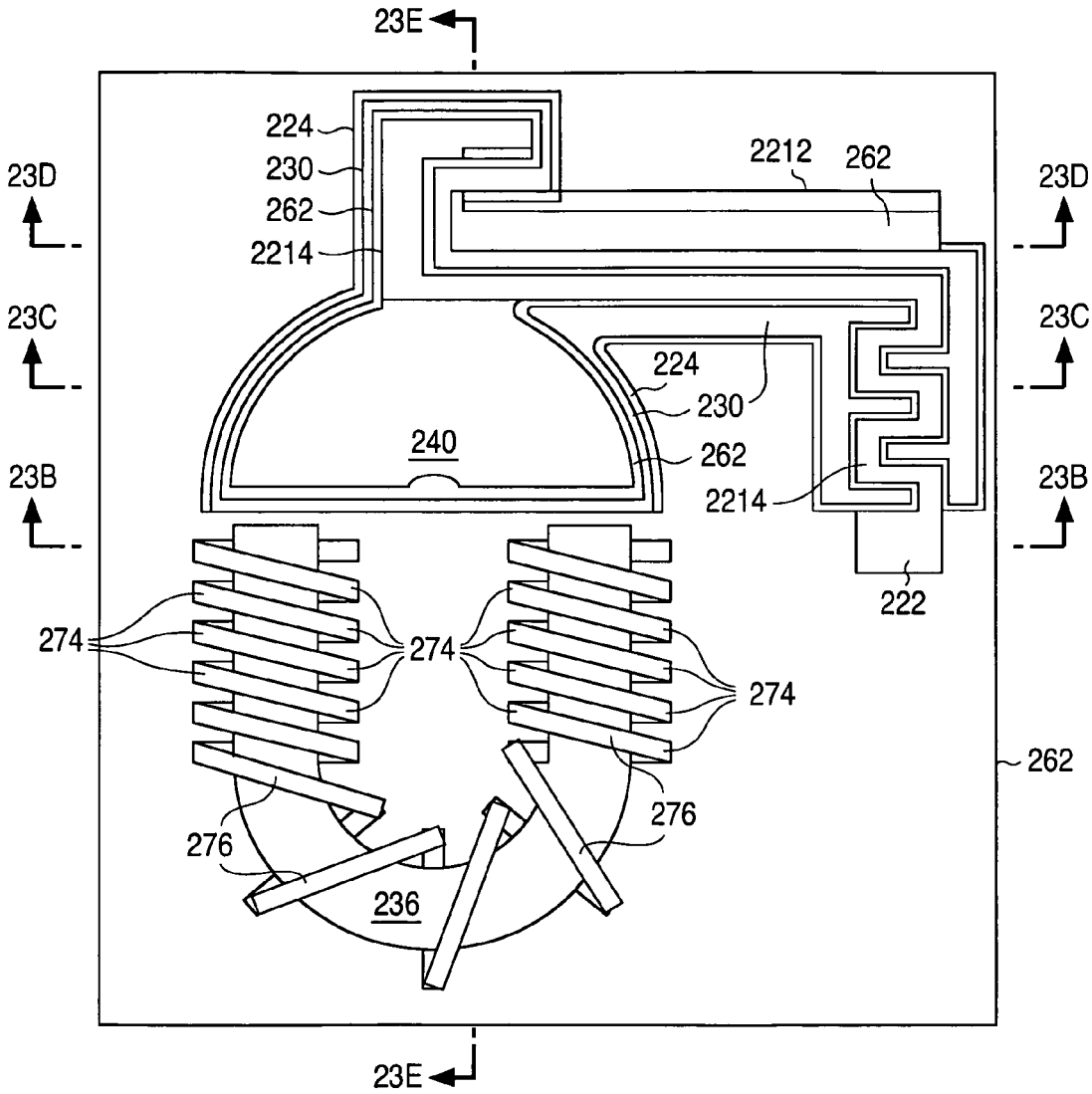
Figure 23B:
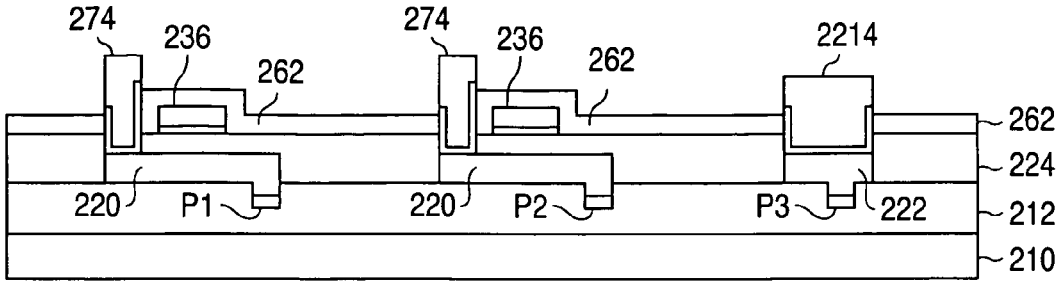
Figure 23C:
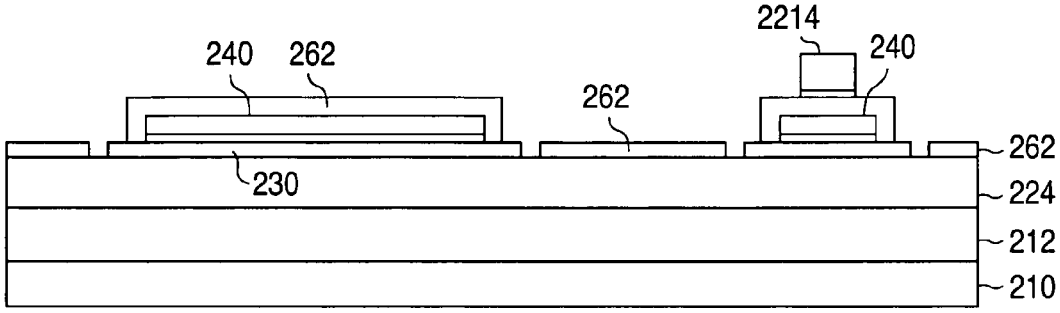
Figure 23D:
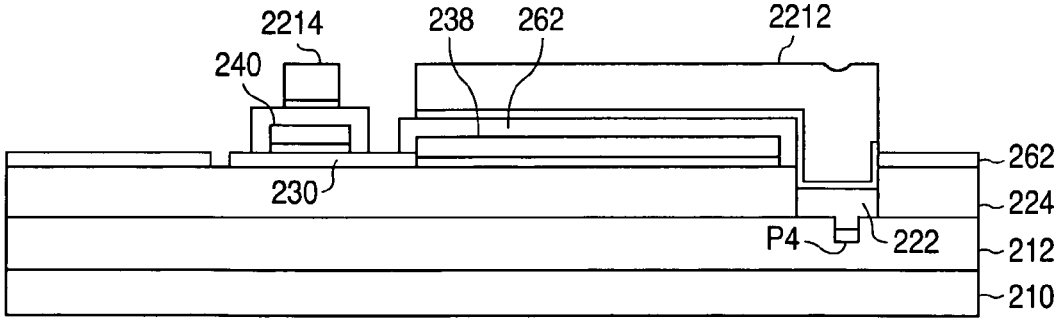
Figure 23E:
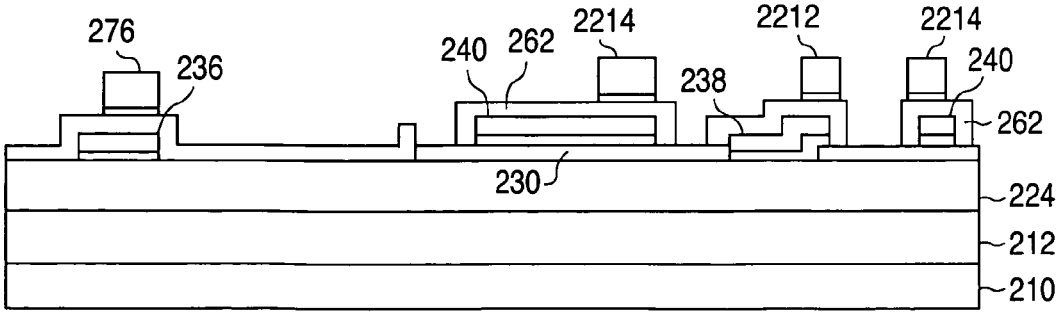
Figure 24A:
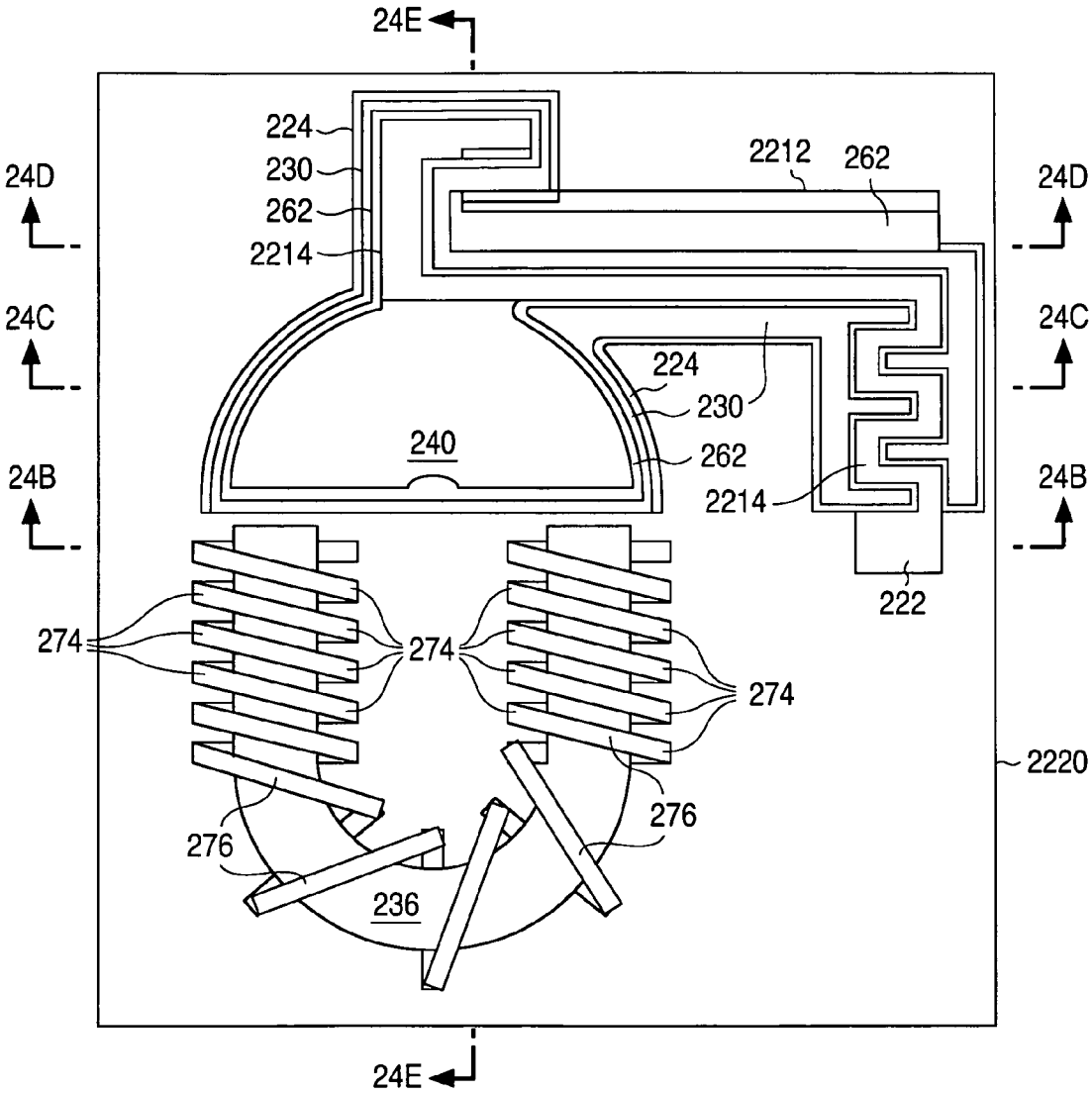
Figure 24B:
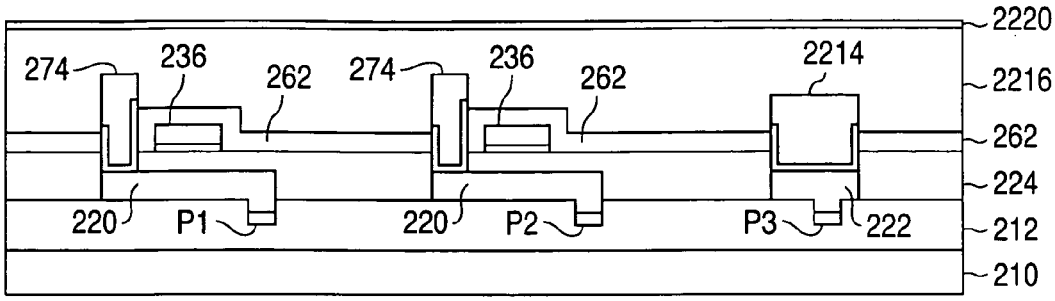
Figure 24C:
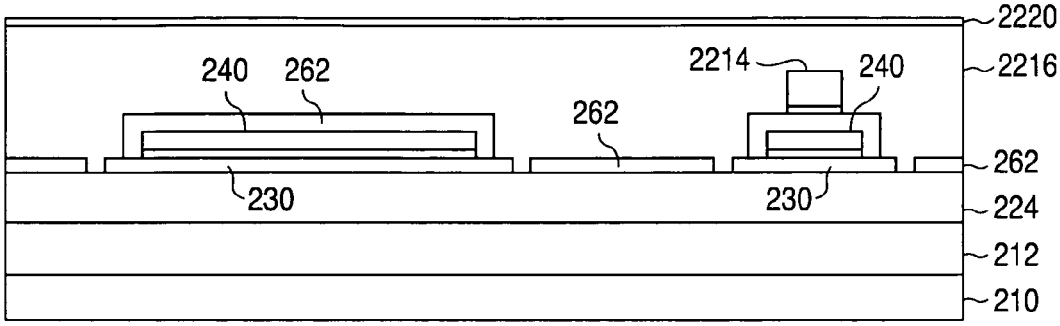
Figure 24D:
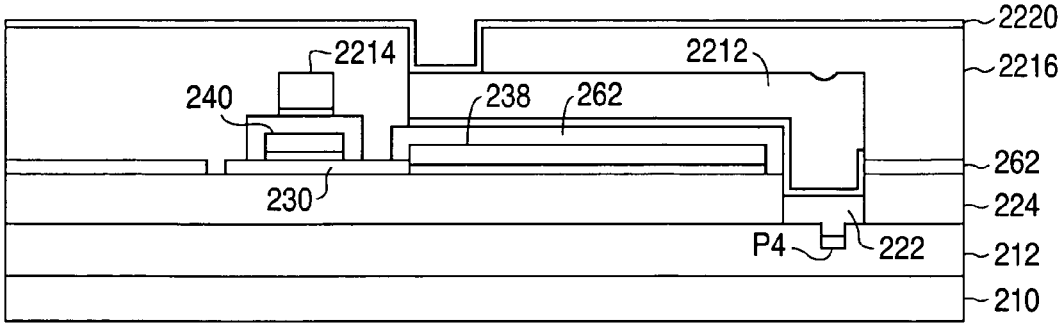
Figure 24E:
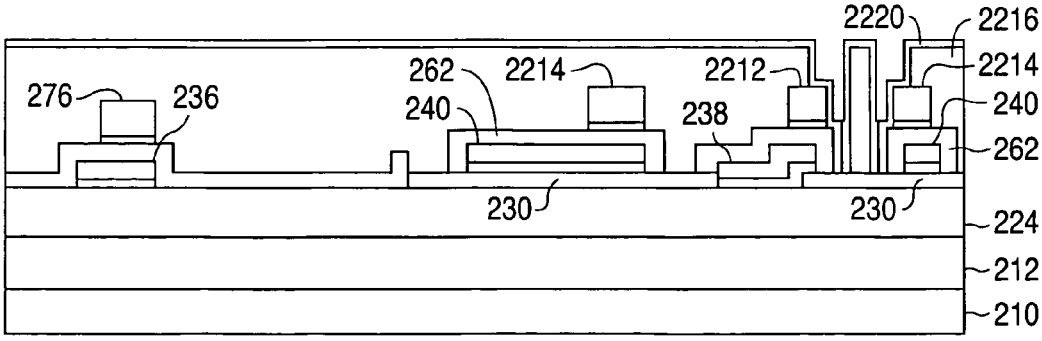
Figure 25A:
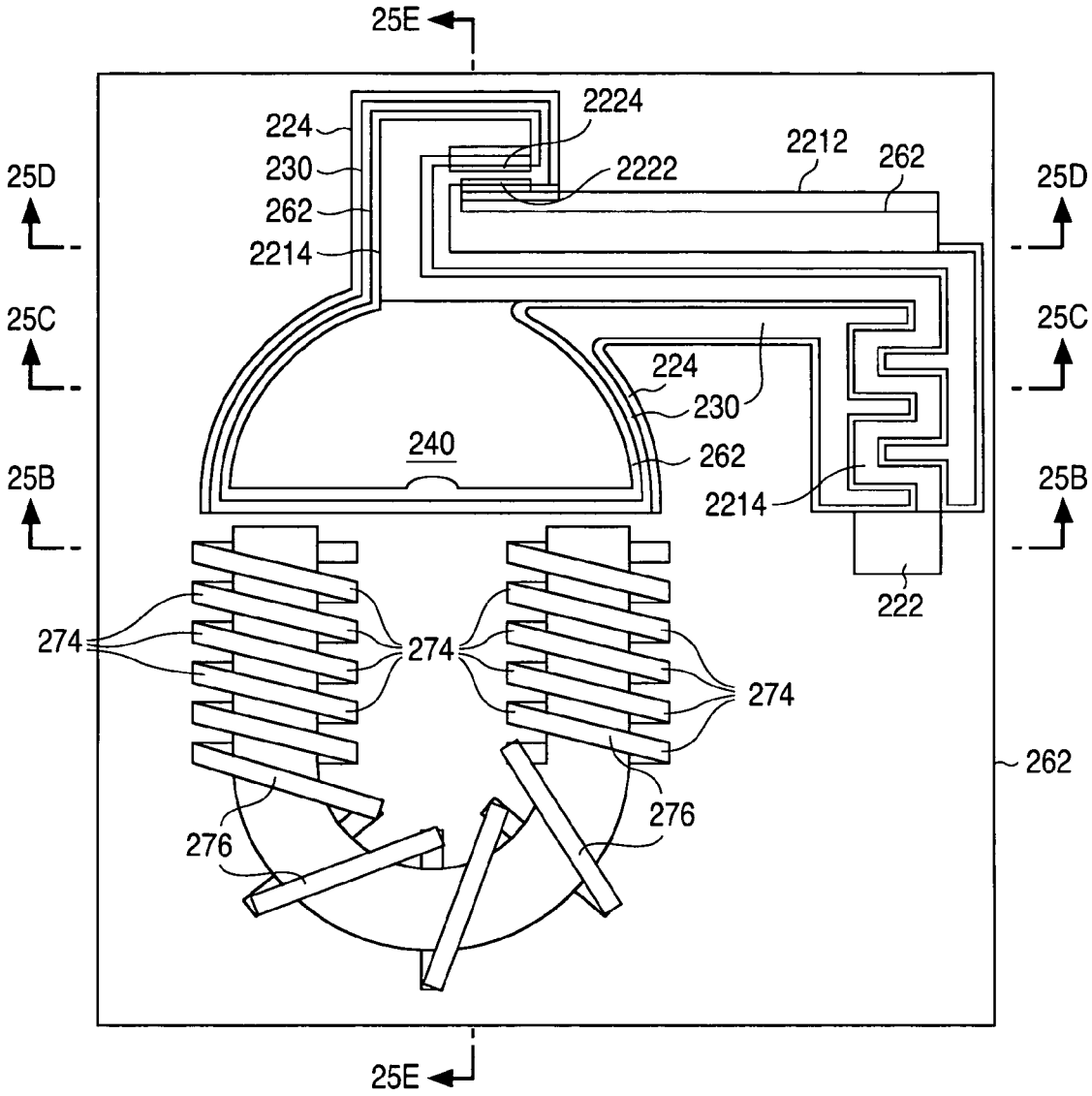
Figure 25B:
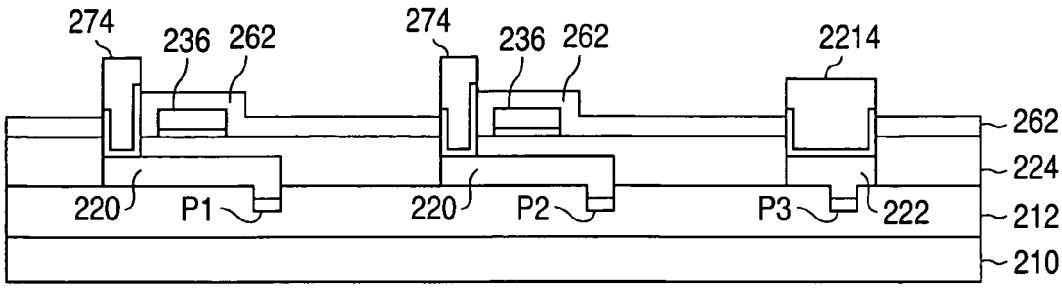
Figure 25C:
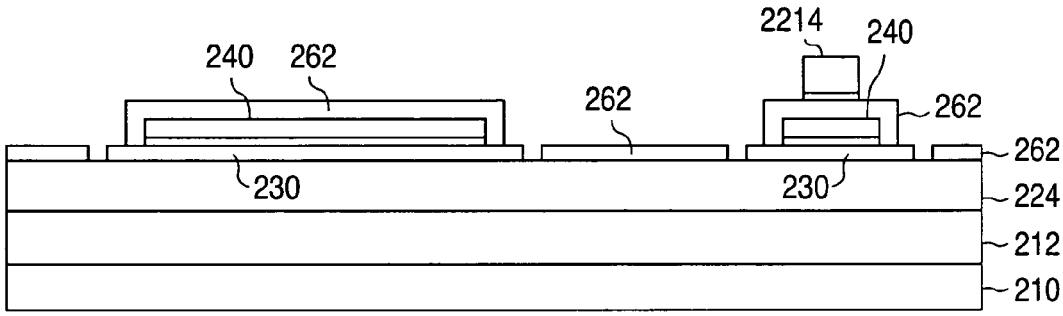
Figure 25D:
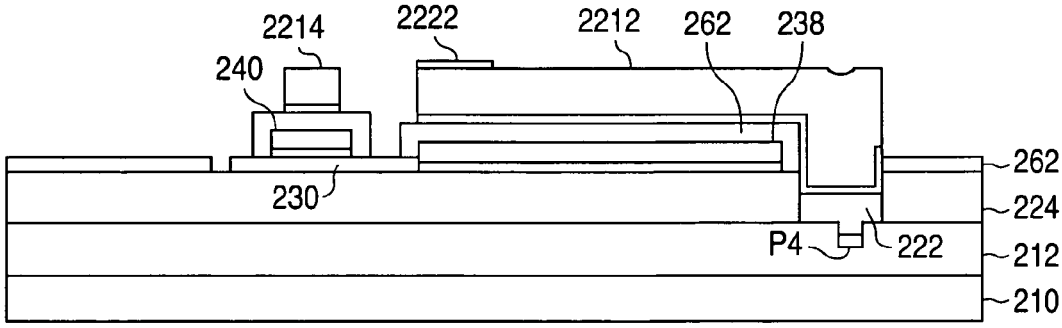
Figure 25E:
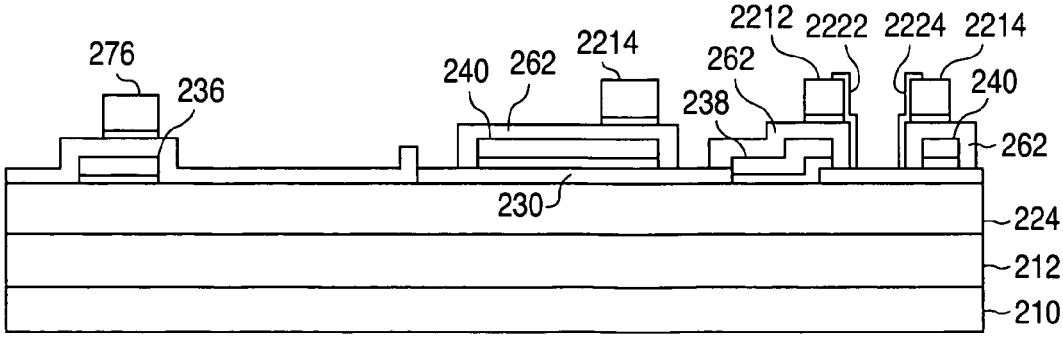
Figure 26A:
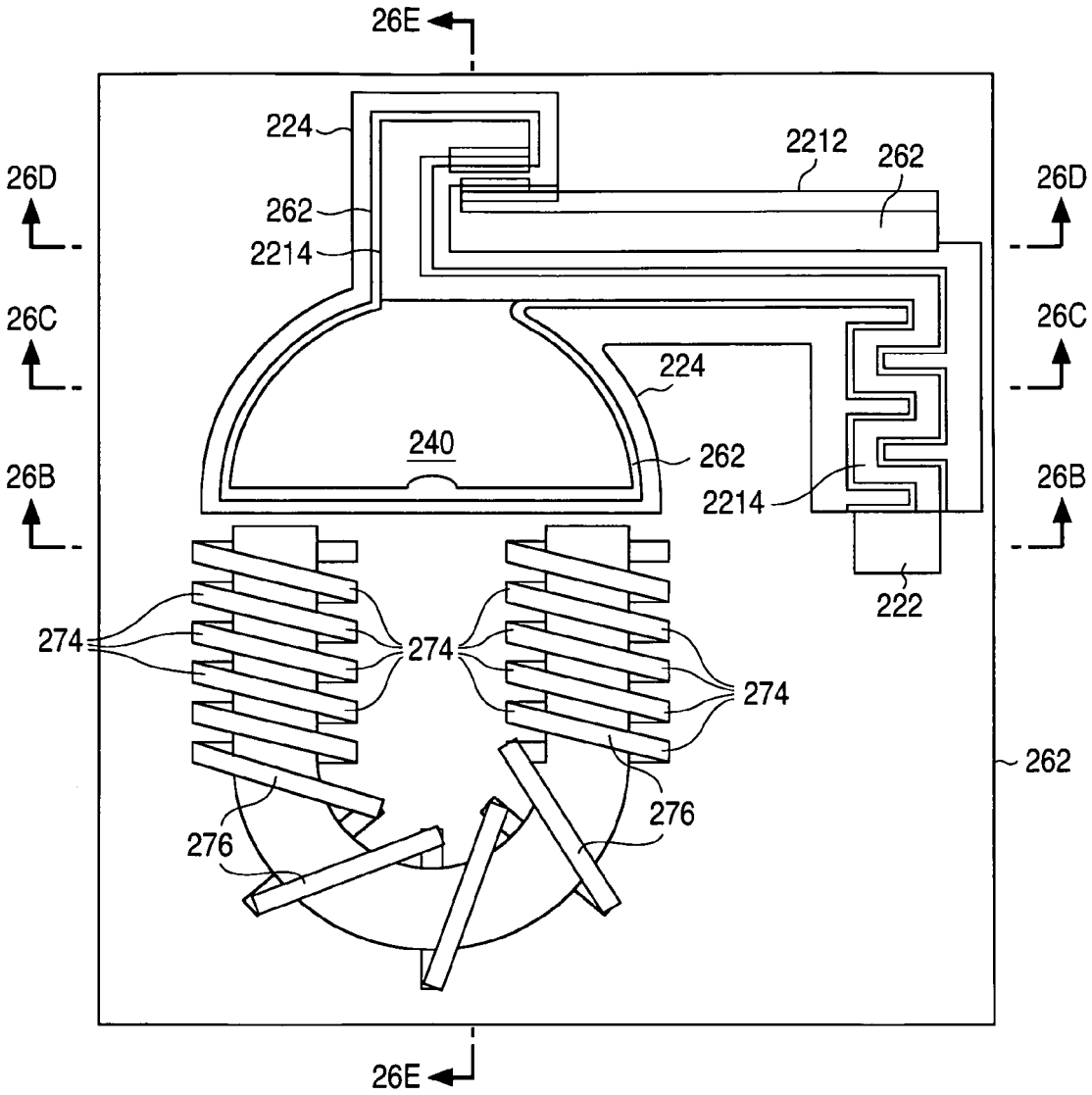
Figure 26B:
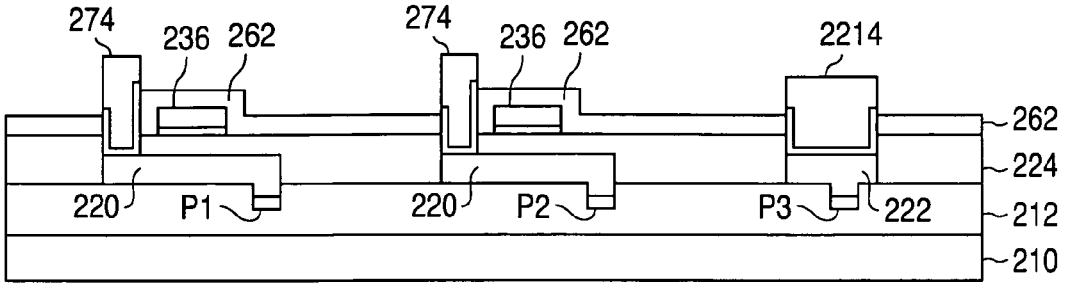
Figure 26C:
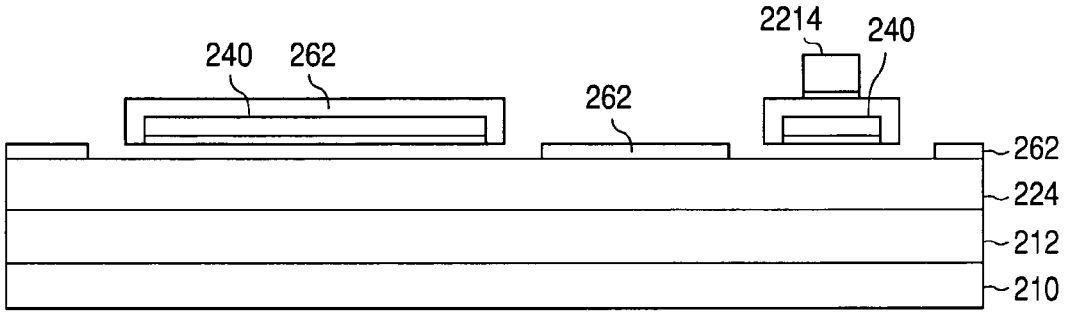
Figure 26D:
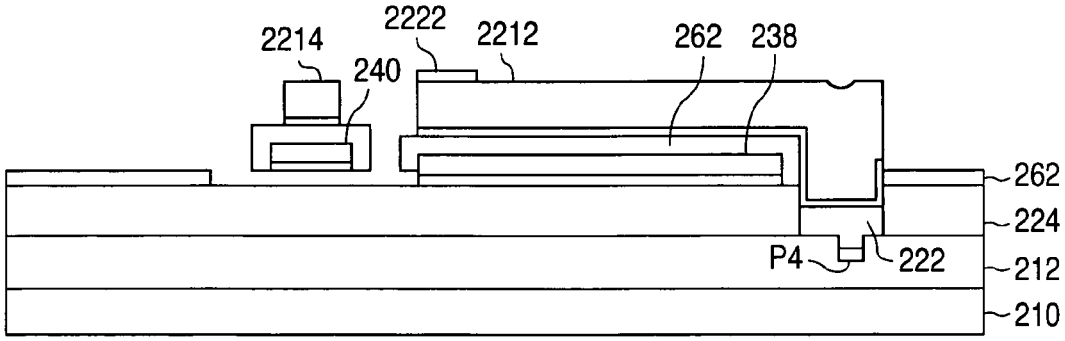
Figure 26E:
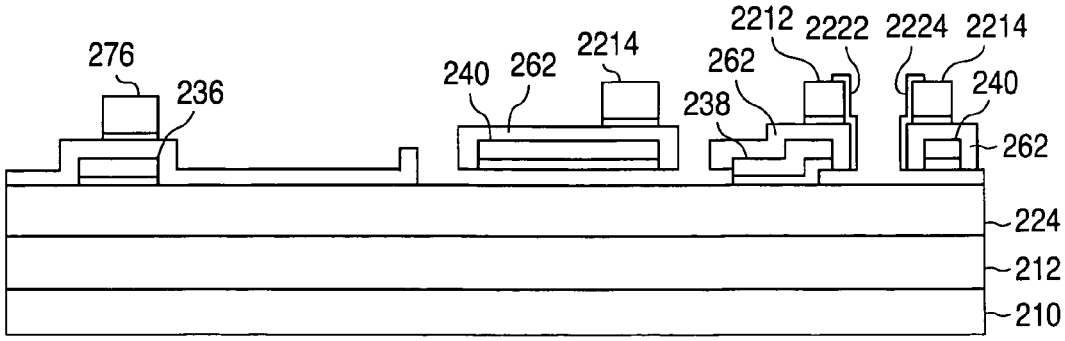
Figure 27A:
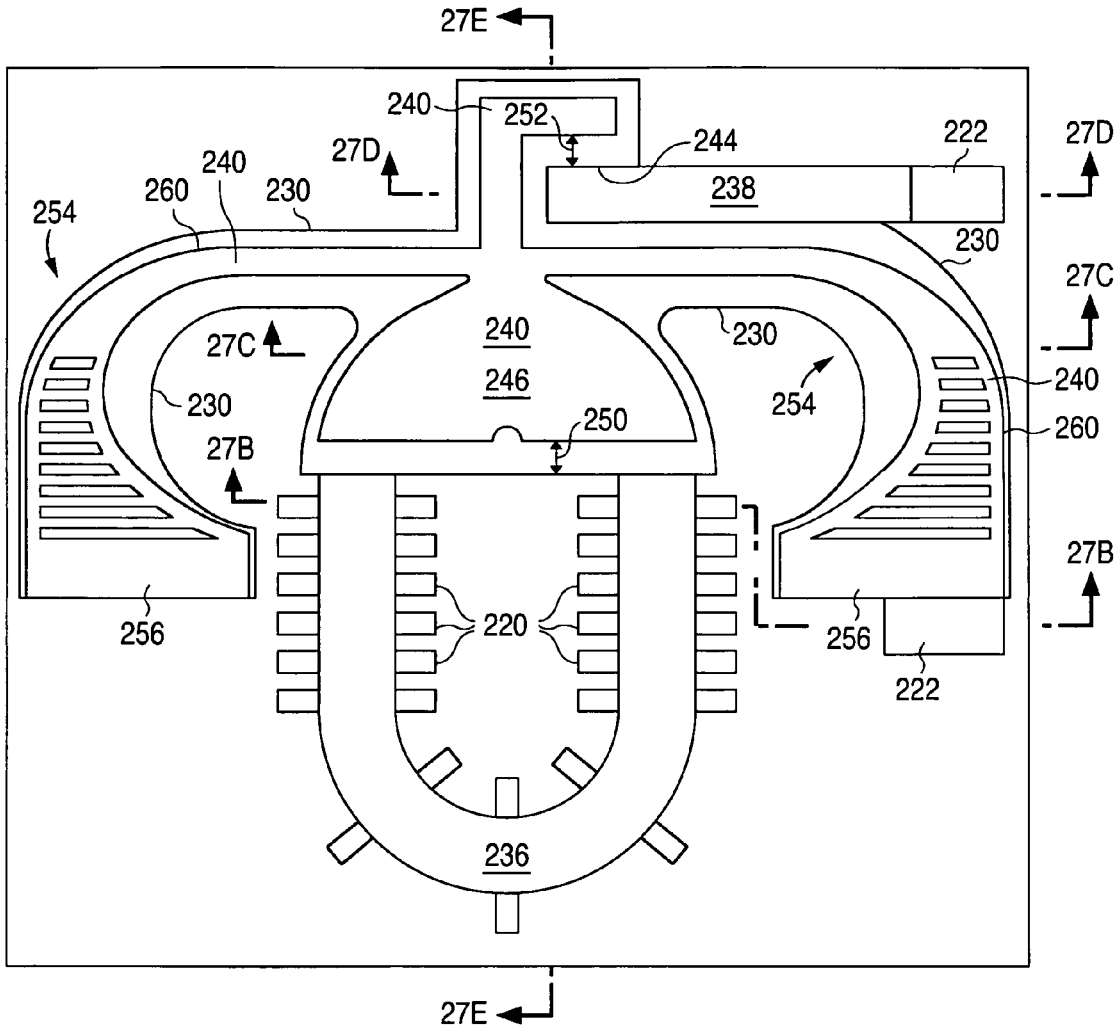
FIGS. 27A-27E are a series of views illustrating an example of sacrificial structure 230 and spring member 254 with a different shape in accordance with the present invention.
Figure 27B:
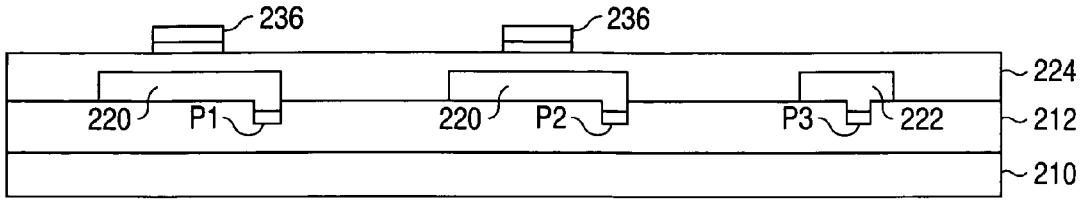
Figure 27C:
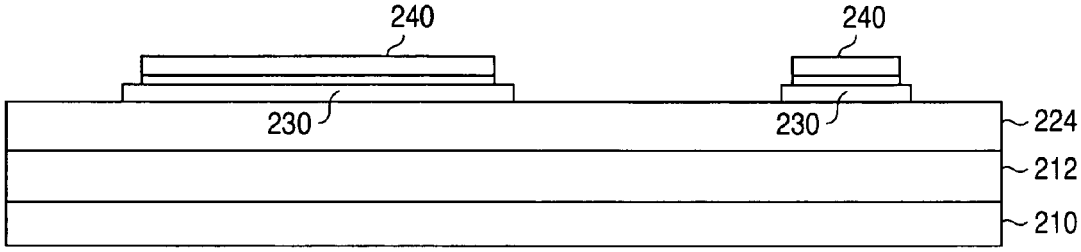
Figure 27D:
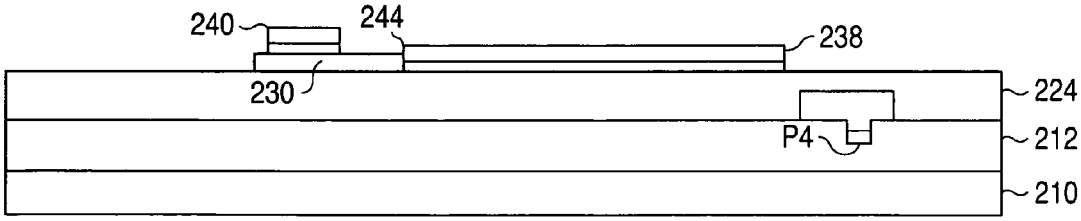
Figure 27E:
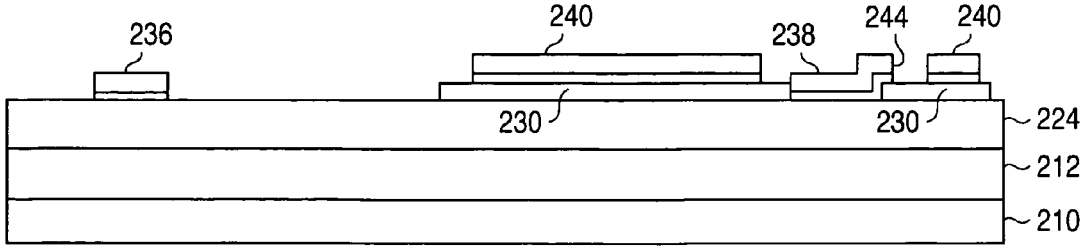
Figure 28A:
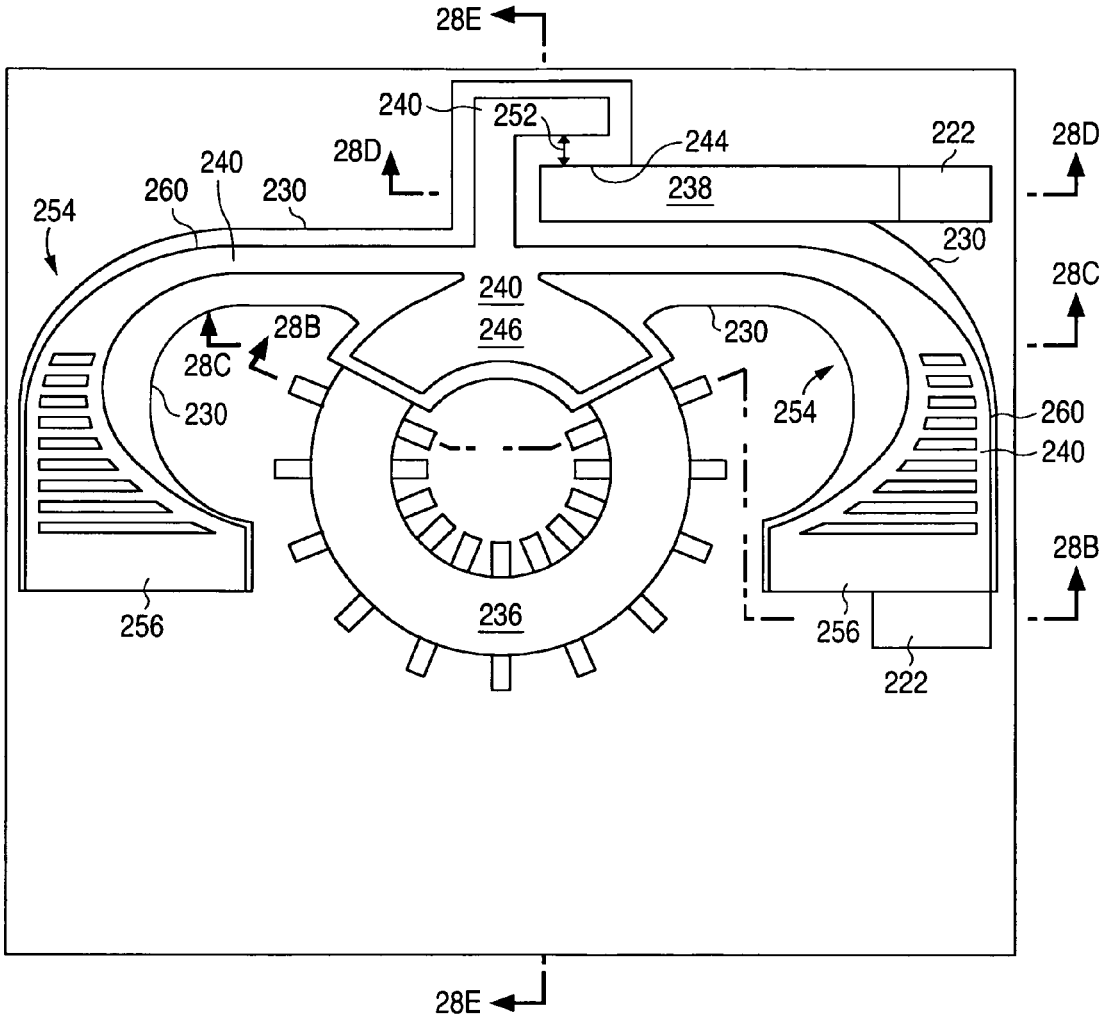
FIGS. 28A-28E are a series of views illustrating an example of sacrificial structure 230, core 236, intermediate member 246, and spring member 254 with a different shape in accordance with the present invention.
Figure 28B:
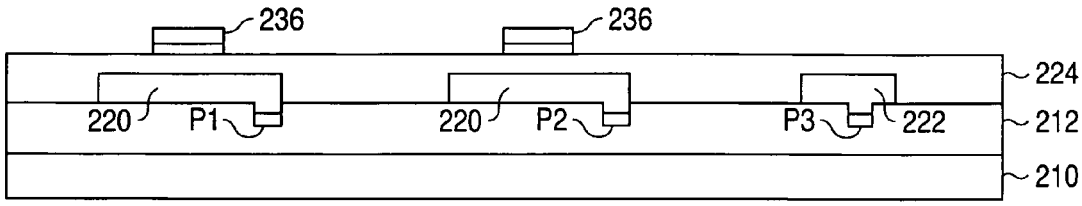
Figure 28C:
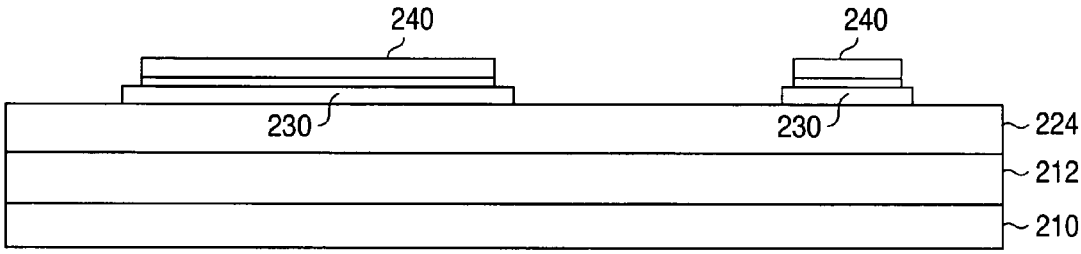
Figure 28D:
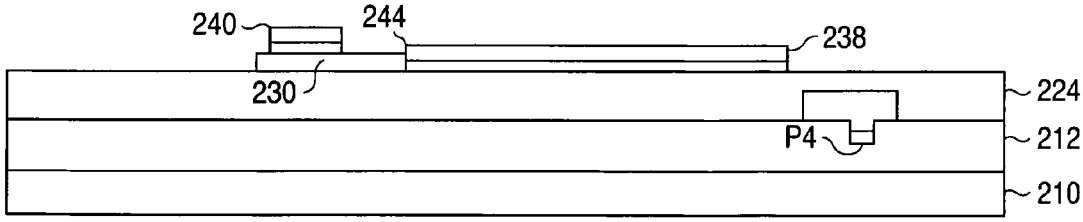
Figure 28E:
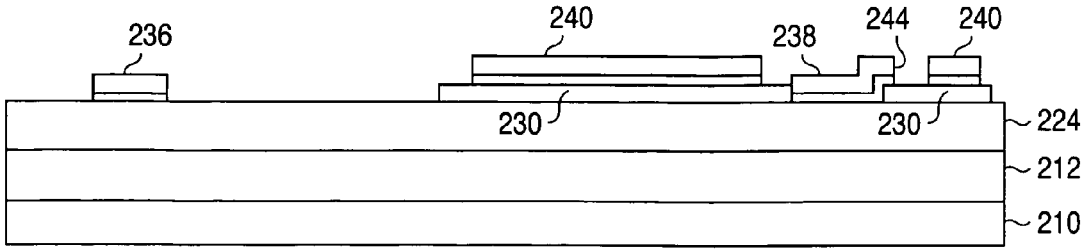

In operation, when no current is present in coil 1510, suspension structure 1514 lies in a rest position as shown in FIG. 15A. In addition, suspension structure 1514 and core 236 are spaced apart by a minimum distance X when no current is present in coil 1510, while first sidewall contact 282 and second sidewall contact 286 are spaced apart by a minimum distance Y when no current is present in coil 1510 that is equal to or less than the minimum distance X. The minimum distance Y, in turn, provides a high-impedance electrical pathway.

Thus, one of the advantages of MEMS relay 1500 is that suspension structure 1514 is independent of core 236 (i.e., no portion of suspension structure 1514 touches core 236 when no current flows through coil 1510). Thus, the suspension structure 1514 can be optimized to reduce the stiffness of the spring while core 236 can be optimized for a short flux path.

On the other hand, when a current flows through coil 1510 and generates an electromagnetic field that is stronger than the spring force of suspension structure 1514, suspension structure 1514 moves towards core 236 so that the first and second sidewall contacts 282 and 286 touch, thereby providing a low-impedance electrical pathway.

Thus, the second sidewall contact 286 of second switch trace 284 moves towards and touches the first sidewall contact 282 of first switch trace 280 when a current flows through coil 1510, and moves away from the first sidewall contact 282 of first switch trace 280 when no current flows through coil 1510. Thus, no portion of suspension structure 1514 touches core 236 when no current flows through coil 1510.

Further, as shown in FIG. 15A, in accordance with the present invention, a magnetic flux 1516 passes through a portion of suspension member 240 when a current flows through coil 1510, while and substantially no magnetic flux passes through the first and the second switch traces 280 and 284 when a current flows through coil 1510. Thus, one of the advantages of the present invention is that MEMS relay 1500 is insensitive to fluctuations in the current around the core and, thereby the flux. As a result, signals with very small amplitudes can pass through relay 1500 with no flux-based distortion.

Thus, a method of forming a MEMS relay in accordance with the present invention has been described. The elements shown in FIG. 1 can be implemented in a number of different ways. For example, the spaced-apart lower coil members that form the lower horizontal sections of the coil described in element 110 of FIG. 1 can be alternately formed.

FIGS. 16A-18A, 16B-18B, 16C-18C, 16D-18D, and 16E-18E show a series of views that illustrate a first example of an alternate way of implementing element 110 of method 100, which forms a number of spaced-apart lower coil members of the to-be-formed coil, in accordance with the present invention.

As with the example shown in FIGS. 2A-3E, the example shown in FIGS. 16A-18E also utilizes single-crystal silicon semiconductor wafer 210 with overlying base dielectric layer 212. The FIGS. 16A-18E example begins by forming a seed layer 1610 on base dielectric layer 212 and the pads P1-P4 which are exposed via openings in base dielectric layer 212.

Once seed layer 1610 has been formed, a plating mold 1612 is formed on the top surface of seed layer 1610. As shown in FIGS. 17A-17E, following the formation of plating mold 1612, copper is deposited by electroplating to form the number of spaced-apart lower coil members 220 and the pair of lower input/output members 222.

As shown in FIGS. 18A-18E, after the lower coil members 220 and the pair of lower input/output members 222 have been formed, plating mold 1612 is removed, followed by the removal of the underlying regions of seed layer 1610. As shown, the structure illustrated in FIGS. 18A-18E is similar to the structure shown in FIGS. 3A-3E.

FIGS. 19A-21A, 19B-21B, 19C-21C, 19D-21D, and 19E-21E show a series of views that illustrate a second example of an alternate way of implementing element 110 of method 100, which forms a number of spaced-apart lower coil members of the to-be-formed coil, in accordance with the present invention.

As with the example shown in FIGS. 2A-3E, the example shown in FIGS. 19A-21E also utilizes single-crystal silicon semiconductor wafer 210 with overlying base dielectric layer 212. The FIGS. 19A-21E example begins by forming a mask 1910 on the top surface of base dielectric layer 212. Following this, the exposed regions of base dielectric layer 212 are etched to form a number of spaced-apart trenches 1912, which will define the spaced-apart lower coil members of the to-be-formed coil, in the top surface of base dielectric layer 212. One of the trenches 1912 exposes pad P1, while another of the trenches 1912 exposes pad P2. In addition, the etch also forms a pair of openings 1914 in base dielectric layer 212 that expose the pair of pads P3 and P4.

Following the etch, as shown in FIGS. 20A-20E, with mask 1910 in place, a copper structure 1916 is formed in the trenches 1912 and the openings 1914 on the exposed regions of base dielectric layer 212, pads P1-P4, and mask 1910. Copper structure 1916 can be formed by, for example, evaporating, in sequence, 300 Å of titanium, 1 μm copper, and 300 Å of titanium.

Next, as shown in FIGS. 21A-21E, after copper structure 1916 has been formed, mask 1910 is stripped which, in turn, lifts off the overlying layer of copper structure 1916. The removal of mask 1910 leaves the copper structure 1916 only on base dielectric layer 212, thereby forming the number of spaced-apart lower coil members 220 and the pair of lower input/output members 222. As shown, other than being recessed, the structure illustrated in FIGS. 21A-21E is similar to the structure shown in FIGS. 3A-3E.

FIGS. 22A-26A, 22B-26B, 22C-26C, 22D-26D, and 22E-26E show a series of views that illustrate an example of an alternate way of implementing element 118 of method 100, which forms the tops and the sides of the to-be-formed coil and the traces for the switch, in accordance with the present invention.

The FIGS. 22A-26E example is the same as the FIGS. 2A-15E example up through the formation of seed layer 270, and differs by forming a plating mold 2210 on the top surface of seed layer 270 in lieu of plating mold 272. Plating mold 2210 differs from plating mold 272 in that plating mold 2210 prevents the first and second sidewall contacts 282 and 286 from being formed from the to-be-formed copper. The pattern in mold 2210 is shown hatched in FIG. 22A.

Next, following the formation of mold 2210, copper is deposited by electroplating to form the number of copper side sections 274 of the coil, and the number of copper upper sections 276 of the coil. In addition, the electroplating also forms a first switch trace 2212, which is the same as switch trace 280 except that there is no sidewall contact 282, and a second switch trace 2214, which is the same as switch trace 284 except that there is no sidewall contact 286. Following this, as shown in FIGS. 23A-23E, mold 2210 and the underlying regions of seed layer 270 are removed.

Following this, as shown in FIGS. 24A-24E, a mask 2216 is formed and patterned on upper dielectric layer 262, the copper upper sections 276, first switch trace 2212, and second switch trace 2214. Once mask 2216 has been formed and patterned, a conductive layer 2220, such as a layer of titanium, nickel, or chrome, and an overlying layer of gold, is deposited on the exposed regions of upper dielectric layer 262 that surround switch member 238, the exposed regions of upper dielectric layer 262 that surround suspension member 240, the exposed regions of sacrificial structure 230, and mask 2216. When sputtered, titanium, nickel, chrome, and gold provide good coverage on the high-aspect ratio (vertical) sidewalls of the switch member 238 and suspension member 240 that face each other. Titanium, nickel, and chrome, in turn, improve the adhesion of gold.

As shown in FIGS. 25A-25E, after conductive layer 2220 has been formed, mask 2216 is stripped which, in turn, lifts off the overlying layer of conductive layer 2220. The removal of mask 2216 leaves the conductive layer 2220 on the sidewalls of upper dielectric layer 262 over switch member 238 and first switch trace 2212, and the sidewalls of upper dielectric layer 262 over suspension member 240 and second switch trace 2214, thereby forming a sidewall contact 2222 of first switch trace 2212 and a sidewall contact of 2224 of second switch trace 2214 that faces sidewall contact 2222.

Following this, as shown in FIGS. 26A-26E, sacrificial structure 230 is removed. The removal of sacrificial structure 230 leaves intermediate member 246 and extension section 260 of spring member 254 floating as before, but with gold contacts.

In addition to the above, the structures can be formed to have different shapes. For example, mask 228 can be formed to have different shapes so that sacrificial structure 230 has different shapes. In addition, plating mold 234 can be formed to have different shapes that correspond with the shapes of sacrificial structure 230 so that core 236, switch member 238, and suspension member 240 have different shapes.

For example, FIGS. 27A-27E show a series of views that illustrate an example of sacrificial structure 230 and spring member 254 with a different shape in accordance with the present invention. In the FIGS. 27A-27E example, spring member 254 is formed with a pair of facing structures that each include a base section 256 and a C-shaped extension section 260.

Further, FIGS. 28A-28E show a series of views that illustrate an example of sacrificial structure 230, core 236, intermediate member 246, and spring member 254 with a different shape in accordance with the present invention. In the FIGS. 28A-28E example, core 236 is formed as a nearly complete doughnut shape, while intermediate member 246 is formed with a wedge or pie shape that fits into the opening in the nearly complete doughnut shape. In addition, spring member 254 is also formed with a pair of facing structures that each include base section 256 and a C-shaped section 260.

As noted above, dielectric layer 212 can represent a dielectric layer that is free of metal structures. When free of metal structures, the electrical connections to coil 1510 can be made, for example, by wire bonding to points on the copper upper sections 276 that represent opposite ends of coil 1510. In addition, connections to the first and second switch traces 280 and 284 can be made, for example, by wire bonding. Another of the advantages of the present invention is that the present invention requires relatively low processing temperatures. As a result, the present invention is compatible with conventional backend CMOS processes.

It should be understood that the above descriptions are examples of the present invention, and that various alternatives of the invention described herein may be employed in practicing the invention. For example, the various seed layers can be implemented as copper seed layers, or as tungsten, chrome, or combination seed layers as need to provide the correct ohmic and mechanical (peel) characteristics. In addition, a double throw switch can be easily fabricated by using two MEMS relays 1500 which are positioned as mirror images of each other. Thus, it is intended that the following claims define the scope of the invention and that structures and methods within the scope of these claims and their equivalents be covered thereby.

What is claimed is:

1. A microelectromechanical system (MEMS) structure comprising:

a semiconductor body having a non-conductive top surface;

a coil having a plurality of coil segments that touch the non-conductive top surface;

a dielectric structure touching the plurality of coil segments and the non-conductive top surface;

a plurality of structures, the plurality of structures including:

a first magnetic member touching the dielectric structure, the first magnetic member lying directly vertically above the plurality of coil segments;

a second magnetic member touching the dielectric structure, the second magnetic member being completely spaced apart from the first magnetic member when no current flows in the coil, and moving towards the first magnetic member in response to a current flowing in the coil;

a stationary structure touching the dielectric structure and having a first conductive member;

a non-conductive region touching the second magnetic member; and a second conductive member touching the non-conductive region, lying directly vertically above the second magnetic member, being completely spaced apart from the first conductive member when the second magnetic member is spaced apart from the first magnetic member, and moving towards and making an electrical connection to the first conductive member when the second magnetic member moves towards the first magnetic member.

2. The MEMS structure of claim 1 wherein when the second conductive member makes an electrical connection to the first conductive member, only a first surface region of the first conductive member physically touches the second conductive member and only a second surface region of the second conductive member physically touches the first conductive member, the second surface region moving substantially only in a horizontal direction towards the first surface region when the second magnetic member moves towards the first magnetic member.

3. The MEMS structure of claim 1 wherein when the second conductive member makes an electrical connection to the first conductive member, only a first surface region of the first conductive member physically touches the second conductive member and only a second surface region of the second conductive member physically touches the first conductive member, the first surface region being substantially vertical, the second surface region being substantially vertical.

4. The MEMS structure of claim 1 wherein no portion of the second conductive member is electrically connected to the second magnetic member.

5. The MEMS structure of claim 1 wherein none of the plurality of coil segments lie directly vertically below any portion of the second magnetic member.

6. The MEMS structure of claim 1 wherein the first magnetic member lies between a first portion of the second magnetic member and a second portion of the second magnetic member.

7. A method of forming a microelectromechanical system (MEMS) structure on a semiconductor body having a non-conductive top surface comprising:

forming a coil having a plurality of coil segments that touch the non-conductive top surface;

forming a dielectric structure to touch the plurality of coil segments and the non-conductive top surface;

forming a plurality of structures, the plurality of structures including:

a first magnetic member touching the dielectric structure, the first magnetic member lying directly vertically above the plurality of coil segments;

a second magnetic member touching the dielectric structure, the second magnetic member being completely spaced apart from the first magnetic member when no current flows in the coil, and moving towards the first magnetic member in response to a current flowing in the coil;

a stationary structure touching the dielectric structure and having a first conductive member;

a non-conductive region touching the second magnetic member; and a second conductive member touching the non-conductive region, lying directly vertically above the second magnetic member, being completely spaced apart from the first conductive member when the second magnetic member is spaced apart from the first magnetic member, and moving towards and making an electrical connection to the first conductive member when the second magnetic member moves towards the first magnetic member.

8. The method of claim 7 wherein forming the plurality of structures includes:

forming a sacrificial layer that touches the dielectric structure; and etching the sacrificial layer to form a sacrificial region that touches the dielectric structure.

9. The method of claim 8 wherein forming the plurality of structures further includes:

forming a seed layer that touches the dielectric structure and the sacrificial region;

forming a mold that touches the seed layer, the mold having a first opening that exposes a region of the seed layer that lies above the dielectric structure and the plurality of coil segments, a second opening spaced apart from the first opening that exposes a region of the seed layer that lies above the dielectric structure and the sacrificial region, and a third opening spaced apart from the first and second openings that exposes a region of the seed layer that lies above the dielectric structure; and forming a magnetic material in the mold to form the first magnetic member in the first opening, the second magnetic member in the second opening, and a third magnetic member in the third opening.

10. The method of claim 9 wherein forming the plurality of structures further includes:

forming a non-conductive layer to touch the first, second, and third magnetic members;

forming a sacrificial opening through the non-conductive layer to expose the sacrificial region;

forming a layer of seed material that touches the non-conductive layer and the sacrificial region exposed by the sacrificial opening;

forming a mold structure that touches the layer of seed material, the mold structure having a first opening that exposes a region of the seed layer that lies above the third magnetic member, and a second opening that exposes a region of the seed layer that lies above the second magnetic member;

forming a conductive material in the mold structure to form the first conductive member in the first opening of the mold structure, and the second conductive member in the second opening of the mold structure; and removing the sacrificial region from below the second magnetic member.

11. The method of claim 10 wherein the stationary structure includes the third magnetic member and a portion of the non-conductive layer.

12. The method of claim 10 wherein forming the plurality of structures further includes:

forming a plurality of coil openings in the non-conductive layer and the dielectric structure to expose a plurality of portions of the plurality of coil segments simultaneously with forming the sacrificial opening;

forming the layer of seed material to touch the plurality of portions of the plurality of coil segments exposed by the plurality of coil openings simultaneously with forming the layer of seed material to touch the sacrificial region exposed by the sacrificial opening;

forming the mold structure to have a plurality of coil openings simultaneously with forming the first opening of the mold structure, and the second opening of the mold structure; and forming the conductive material in the mold structure to form a plurality of coil sections in the plurality of coil openings simultaneously with forming the conductive material in the first and second openings of the mold structure, the plurality of coil sections touching the plurality of coil segments to form the coil.

13. The method of claim 10 wherein forming the plurality of structures further includes:

forming a seed material layer that touches the first conductive member and the second conductive member;

forming a mold layer that touches the seed material layer, the mold layer having a first opening that exposes a side wall of the first conductive member, and a second opening that exposes a side wall of the second conductive member;

forming a conductive material in the first opening and the second opening of the mold layer to form a first conductive contact that touches the side wall of the first conductive member, and a second conductive contact that touches a side wall of the second conductive member; and removing the mold layer, an air gap lying between the first contact and the second contact, the first contact facing the second contact, the sacrificial region being removed after the mold layer is removed.

14. The method of claim 7 wherein forming the plurality of coil segments of the coil includes:

forming a layer of conductive material to touch the non-conductive top surface; and etching the layer of conductive material to form the plurality of coil segments.

15. The method of claim 7 wherein forming the plurality of coil segments of the coil includes:

forming a layer of seed material to touch the non-conductive top surface;

forming a mold structure to touch the layer of seed material; and forming a conductive material in the mold structure to form the plurality of coil segments.

16. The method of claim 7 wherein forming the plurality of coil segments of the coil includes:

etching the non-conductive top surface to expose a plurality of spaced apart conductive regions;

forming a layer of conductive material to touch the non-conductive top surface and the plurality of conductive regions; and planarizing the layer of conductive material to form the plurality of coil segments.

17. A microelectromechanical system (MEMS) structure comprising:

a semiconductor body having a non-conductive top surface;

a coil having a plurality of coil segments that touch the non-conductive top surface;

a dielectric structure touching the plurality of coil segments and the non-conductive top surface;

a plurality of structures, the plurality of structures including:

a first magnetic member touching the dielectric structure, the first magnetic member lying directly vertically above the plurality of coil segments;

a second magnetic member touching the dielectric structure, the second magnetic member being completely spaced apart from the first magnetic member when no current flows in the coil, and moving towards the first magnetic member in response to a current flowing in the coil;

a plurality of pads that touch the non-conductive top surface, the plurality of pads being conductive, lying substantially in a single horizontal plane, and including a first pad, a second pad, and a third pad, the third pad lying directly vertically below a coil segment of the plurality of coil segments;

a stationary structure touching the dielectric structure and having a first conductive member, the first conductive member being permanently electrically connected to the first pad;

a non-conductive region touching the second magnetic member; and a second conductive member touching the non-conductive region, being permanently electrically connected to the second pad, being completely spaced apart from the first conductive member when the second magnetic member is spaced apart from the first magnetic member, and moving towards and making an electrical connection to the first conductive member when the second magnetic member moves towards the first magnetic member.

18. The MEMS structure of claim 17 wherein the plurality of pads are spaced apart from the dielectric structure.

19. The MEMS structure of claim 17 wherein:

no portion of the second conductive member is electrically connected to the second magnetic member; and no portion of the coil is wrapped around any portion of the second magnetic member.

20. The MEMS structure of claim 17 wherein the first magnetic member lies between a first portion of the second magnetic member and a second portion of the second magnetic member.

* * * * *